US009943982B2

(12) United States Patent
Connard, III

(10) Patent No.: US 9,943,982 B2
(45) Date of Patent: Apr. 17, 2018

(54) CONCRETE MIXING TRANSPORT TRUCK CHUTE WASHOUT SYSTEM

(71) Applicant: Leslie R. Connard, III, Upland, CA (US)

(72) Inventor: Leslie R. Connard, III, Upland, CA (US)

( * ) Notice: Subject to any disclaimer, the term of this patent is extended or adjusted under 35 U.S.C. 154(b) by 301 days.

(21) Appl. No.: 15/009,742

(22) Filed: Jan. 28, 2016

(65) Prior Publication Data

US 2016/0221221 A1 Aug. 4, 2016

Related U.S. Application Data

(63) Continuation-in-part of application No. 14/611,058, filed on Jan. 30, 2015.

(51) Int. Cl.
*B28C 5/42* (2006.01)
*B03B 9/06* (2006.01)

(52) U.S. Cl.
CPC ..... *B28C 5/4203* (2013.01); *B03B 9/063* (2013.01); *B28C 5/4234* (2013.01); *B28C 5/4244* (2013.01)

(58) Field of Classification Search
CPC ..... B28C 5/4203; B28C 5/4244; B28C 7/168; B28C 5/4234; B03B 9/063
See application file for complete search history.

(56) References Cited

U.S. PATENT DOCUMENTS 5,685,978 A * 11/1997 Petrick ..... B01D 29/03 209/249
6,155,277 A * 12/2000 Barry ..... B01F 13/0035 134/104.4
6,491,070 B1 * 12/2002 Espina Frutos ..... B01D 45/00 141/285
7,117,995 B2 10/2006 Connard, III
7,506,672 B2 * 3/2009 Manno ..... B03B 9/063 134/104.4
7,594,524 B2 * 9/2009 DeCollibus ..... B03B 9/063 134/104.4
7,913,704 B1 * 3/2011 Abney, Sr. ..... B01D 21/0012 134/109
8,083,394 B2 * 12/2011 Fischer ..... B08B 9/08 366/41
8,734,587 B2 * 5/2014 Pruyn ..... B28C 5/4203 134/10
9,701,041 B2 * 7/2017 McFarlane ..... B28C 5/4248
2004/0159595 A1 * 8/2004 Connard, III ..... B28C 5/4203 209/680
2006/0000490 A1 * 1/2006 Barragan ..... B08B 3/02 134/10

(Continued)

OTHER PUBLICATIONS

Innovative Concrete Solutions LLC, brochure for Chute Wash Recovery, date 2011, pp. 1-2.

(Continued)

*Primary Examiner* — Tony G Soohoo
(74) *Attorney, Agent, or Firm* — Karish & Bjorgum, PC

(57) ABSTRACT

A concrete mixing transport truck chute washout system with a container unit with an upper region located above and fluidly communicating with a lower region, the upper region having a container unit sealing and seating feature, the upper region having a container unit open mouth, and a rack unit that receives the container portion and which can have a stationary portion and a movable portion.

19 Claims, 55 Drawing Sheets

(56) References Cited

U.S. PATENT DOCUMENTS

| | | | | |
|---|---|---|---|---|
| 2007/0002677 | A1* | 1/2007 | DeCollibus | B03B 9/063 366/68 |
| 2007/0008814 | A1* | 1/2007 | Johnson | B28C 5/4248 366/68 |
| 2007/0086270 | A1* | 4/2007 | Harris | B08B 9/08 366/59 |
| 2008/0175092 | A1* | 7/2008 | Manno | B03B 9/063 366/68 |
| 2010/0232253 | A1* | 9/2010 | Lundberg | B08B 9/00 366/68 |
| 2010/0294730 | A1* | 11/2010 | Weston | B03B 9/063 210/767 |
| 2011/0197980 | A1* | 8/2011 | Sullivan | B03B 9/063 137/544 |
| 2012/0037231 | A1* | 2/2012 | Janson | B03B 9/063 137/1 |
| 2012/0111364 | A1* | 5/2012 | Pruyn | B08B 3/04 134/10 |
| 2014/0332546 | A1* | 11/2014 | Connard | B08B 17/025 220/789 |
| 2014/0356119 | A1* | 12/2014 | Kasahara | B28C 5/4251 414/523 |
| 2016/0114497 | A1* | 4/2016 | McFarlane | B03B 9/063 210/435 |
| 2016/0221218 | A1* | 8/2016 | Connard, III | B28C 5/4203 |
| 2016/0221221 | A1* | 8/2016 | Connard, III | B28C 5/4203 |

OTHER PUBLICATIONS

A-1 Truck Sales & Equipment, LLP, brochure for Booster Washout Tank, date 2011, pp. 1-2.

* cited by examiner

CONCRETE MIXING TRANSPORT TRUCK CHUTE WASHOUT SYSTEM

CROSS-REFERENCE TO RELATED APPLICATIONS

This patent application is a continuation-in-part and claims priority to U.S. patent application Ser. No. 14/611,058, filed on Jan. 30, 2015, and having the title of "CONCRETE MIXING TRANSPORT TRUCK CHUTE WASHOUT SYSTEM".

FIELD OF THE INVENTION

The invention relates to devices and systems for washing out concrete mixing transport trucks (commonly referred to as "concrete trucks"), and more precisely to a concrete mixing transport truck chute washout system

BACKGROUND OF THE INVENTION

Concrete is an amalgam of various materials, including water, aggregate (e.g., sand and gravel), and cement, and may include fly ash, fiberglass, chemicals and other additives depending upon the concrete processing plant's abilities and the intended end uses. Concrete is commonly transported to a construction site in concrete mixing transport trucks. The concrete within the delivery vehicles can be loaded at a concrete ready mix facility and prepared and retained within a large rotatable mixing drum. During transportation within the mixing drum, the concrete is in a wet, relatively fluid state. More recently volumetric delivery trucks have come into use where the various separate and unmixed concrete ingredients are separately stored in the truck and are mixed together at the job site as needed to provide the perfect quantity and quality of cement as required.

Regardless of how the concrete is made and delivered, at the construction site, the wet concrete mixture is typically gravitated from the delivery vehicle via pour chutes, which includes a main chute that extends downwardly from an exit of the drum or the concrete feeder, a flop over chute that is hinged to the distal end of the main chute, and sometimes chute extensions. The wet concrete fed from the chutes is poured either directly into the forms at the job site, or is channeled into a concrete pump.

After the concrete mixture has been poured from the delivery vehicle, wet concrete mixture commonly continues to adhere to the pour chutes. In the past, it was common practice for contractors and concrete delivery drivers to hose off the remaining wet concrete mixture on the chutes (and even inside the drum) and allow the now diluted concrete to run onto the ground, onto the street, road, or storm drains systems. However, the rinse water used to clean the pour chutes is considered a groundwater contaminant, can cause substantial damage to storm drain systems, and it more or less universally prohibited across the U.S. and many foreign countries. Consequently, environmental laws generally prohibit the disbursal of such rinse waters and runny concrete onto the ground or at the construction side, unless it is deposited in special receiving pools, tanks, and the like. All such rinse waters must be recouped and recycled without being allowed to flow into streets, storm drains or gutters or allowed to percolate into the soil.

Indeed, one way of dealing with concrete mixture rinse waters at large construction sites is to deposit such rinse waters in a prefabricated lined evaporation pit. The construction of a prefabricated evaporation pit at smaller commercial and residential construction sites is not practical, however. U.S. Pat. Nos. 5,741,065, 6,155,277 and 6,354,439 disclose a variety of equipment for allowing the removal of concrete chute rinse water in the delivery vehicle. However, each such proposed equipment requires the use of expensive and bulky hydraulic, pneumatic or electrical components which must be carried on the delivery vehicle. Such hydraulic or electrical components are expensive to purchase and maintain and awkward to carry on the delivery vehicle. Also, such hydraulic, pneumatic or electrical components leave the driver of the delivery vehicle vulnerable to hydraulic, pneumatic and electrical system failures which would prevent use of the equipment at the construction site. Still further, proposed equipment in the prior art frequently suffers from leakage of contaminated water during the disconnecting of hoses from collection vessels. Finally, several of the proposed equipment requires the use of the vehicle's mixing drum to store the recovered rinse water. Storing such rinse water in the mixing drum can adversely affect the integrity of the next load of concrete mixture prepared and transported within the mixing drum, unless the rinse water is thoroughly drained from the mixing drum prior to the preparation of the next batch of concrete mixture. From a practical standpoint, this is a major disadvantage of such proposed equipment because there is a strong temptation among individual concrete mixture preparation personnel to reuse the rinse water (already in the mixing drum) rather than to take the time to thoroughly drain and reconstitute the rinse water and to replace it in the mixing drum with fresh water.

With this in mind, the inventor previously invented and patented as U.S. Pat. No. 7,117,995 a concrete reclamation apparatus. This prior invention is useful for in the separation of solids from a diluted, wet, concrete mixture. This prior device includes (a) a free-standing first container with a drain port and a top opening, (b) a strainer disposed within the first container, (c) a drain port shut-off valve, (d) a second container capable of providing a reservoir for recovered liquid, and (e) a transfer conduit (a hose) for allowing effluent from the drain port of the first container to be gravity feed into the second container. While Applicant's prior system does provide excellent utility, its use requires numerous steps, as follows. A user will need to detach the free-standing first container from a truck mounted rack on hang in on the end of the concrete chute (with provided hooks), connect the transfer conduit between the free-standing first container and the second container (typically retained on the truck), and wash concrete debris on the chutes into the first container. Thereafter, the first container is elevated by raising the pour chute until the drain port of the first container is higher in elevation than the inlet port of the second container. At this point, the first container drain port shut-off valve is opened and the liquid effluent within the second portion of the first container is allowed to gravitate from the first container to the second container. After the first container has been drained, and all effluent has flowed from the first container to the second container via the transfer conduit, the drain port shut-off valve is closed, and the transfer conduit is disconnected from the two containers and stored away. At this point, the user will disengage the free-standing first container from the end of a chute and re-secure it on the concrete truck.

All of these steps require time, effort, and care. Users will need to exercise caution to avoid overfilling the second container since if it is overfilled, the transfer conduit will be full of effluent and this will need to be specially handled to avoid spillage. If more rinse water is needed than is capable of being stored in second container, user may choose to retainer some of the resulting effluent in the first container. If this is the case, a worker will need to lift and move what can be a very heavy effluent and aggregate filled first container from the end of the chute, and reposition it on the truck.

Accordingly, there is a need for a concrete reclamation apparatus which avoids the aforementioned problems in the prior art in an efficient and inexpensive manner.

SUMMARY OF THE INVENTION

The present invention provides a concrete mixing transport truck chute washout system, comprising: a container unit with an upper region located above and fluidly communicating with a lower region, the upper region having a container unit sealing and seating feature, the upper region having a container unit open mouth; and a rack unit that comprises a base with a footprint having a length and a width that is sized to carry the container unit.

The present invention further provides a concrete mixing transport truck chute washout system, comprising a container unit with an upper region located above and fluidly communicating with a lower region, the upper region having a container unit sealing and seating feature, the upper region having a container unit open mouth; a detachable cover that detachably fits in the upper region of the container unit in the container unit open mouth to block the mouth and prevent egress of contents from the container; and a rack unit that comprises a base with a footprint having a length and a width that is sized to carry the container unit

BRIEF DESCRIPTION OF THE DRAWINGS

These and other features, aspects and advantages of the present invention will become better understood with reference to the following description, appended claims and accompanying drawings where:

DETAILED DESCRIPTION

Figure 1:
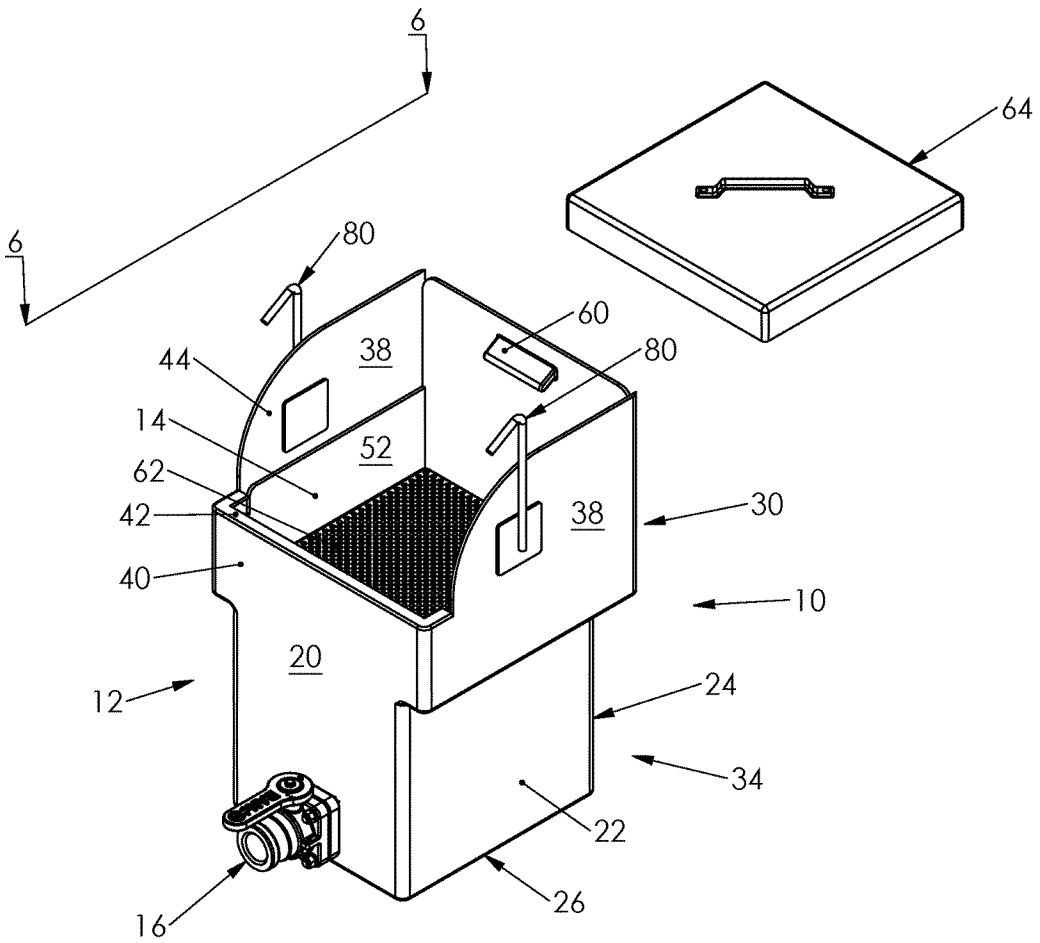
FIG. 1 is a top front right isometric view of an exemplary embodiment of a concrete mixing transport truck chute washout system of the invention.
Figure 2:
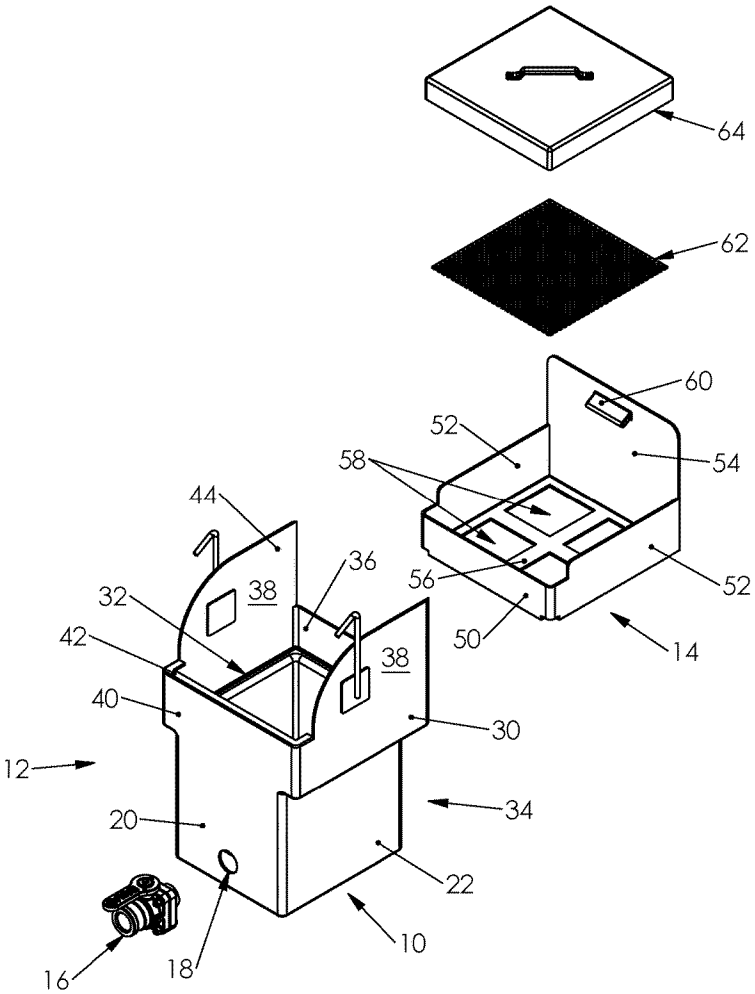
FIG. 2 is an exploded view of the concrete mixing transport truck chute washout system of FIG. 1.
Figure 3:
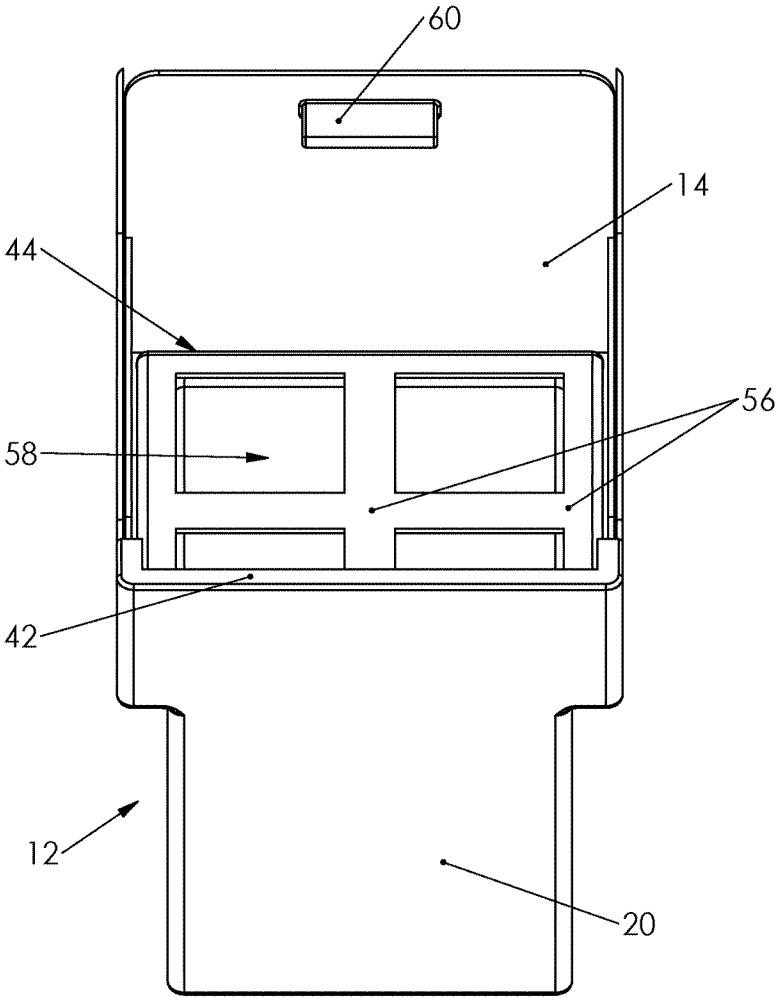
FIG. 3 is a top front isometric view looking down into the concrete mixing transport truck chute washout system of FIG. 1.
Figure 4:
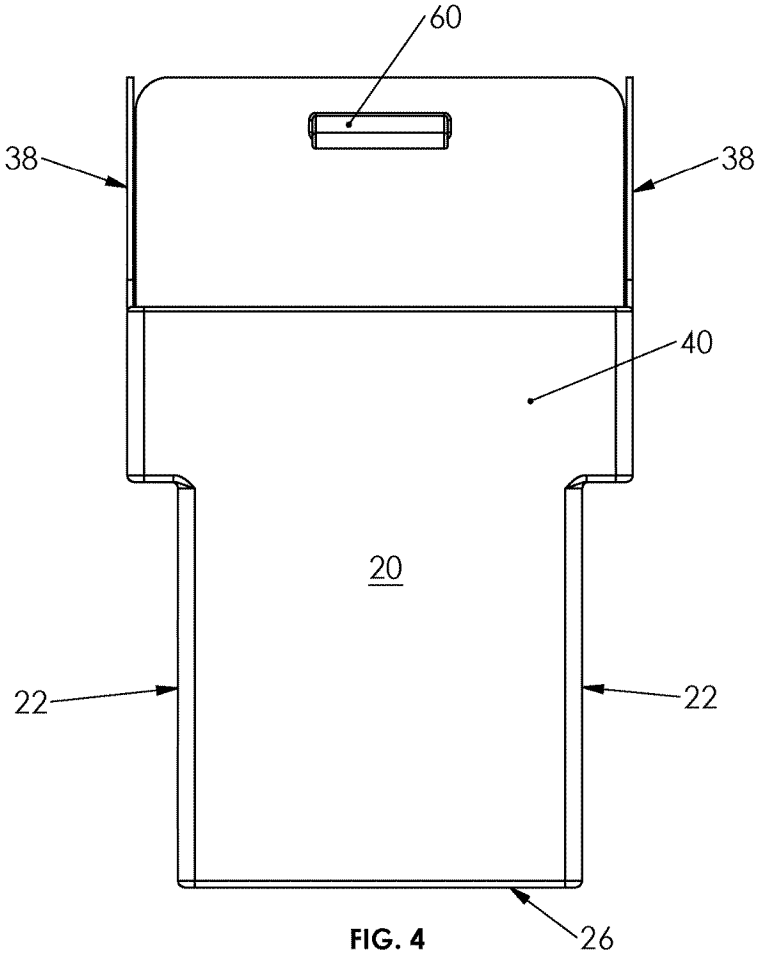
FIG. 4 is a front view of concrete mixing transport truck chute washout system of FIG. 1.
Figure 5:
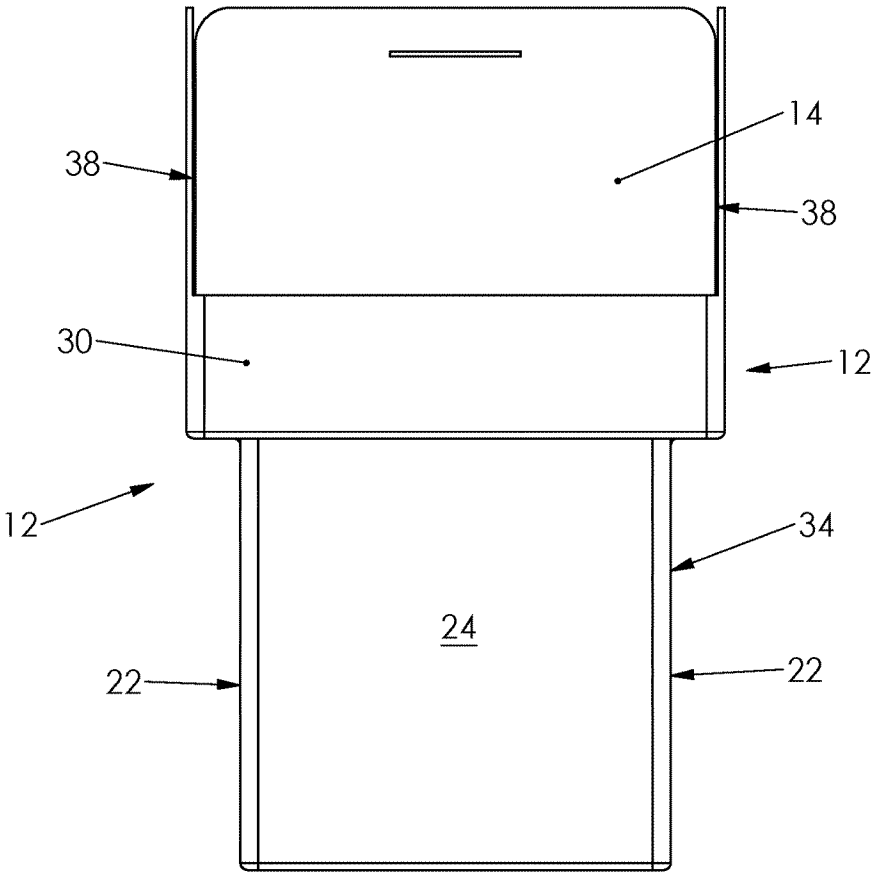
FIG. 5 is a rear view of concrete mixing transport truck chute washout system of FIG. 1.
Figure 6:
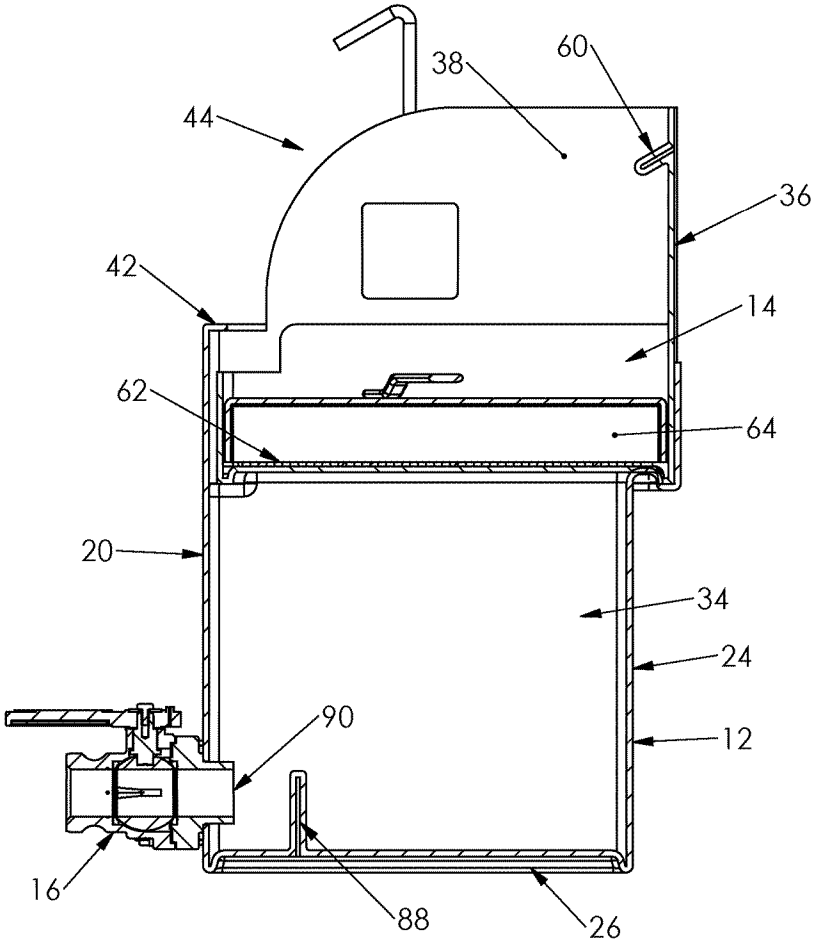
FIG. 6 is a cross-sectional view of the concrete mixing transport truck chute washout system along view lines 6-6 of FIG. 1
Figure 7A:
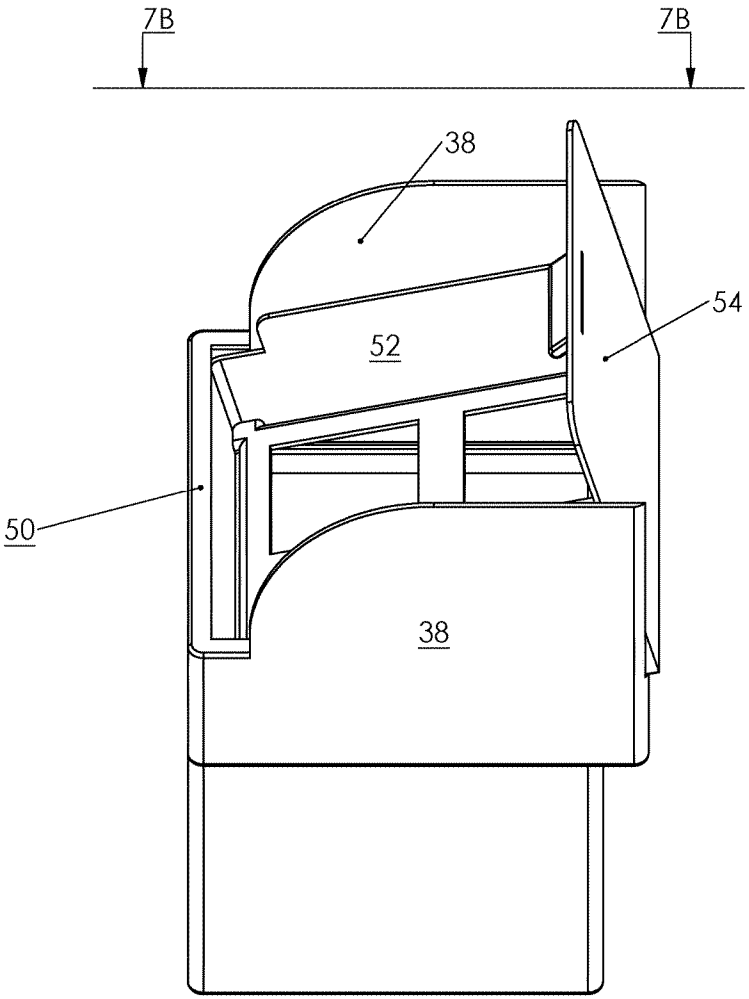
FIG. 7A is a top front isometric view looking down into the concrete mixing transport truck chute washout system of FIG. 1 but with its tray unit partially removed.
Figure 7B:
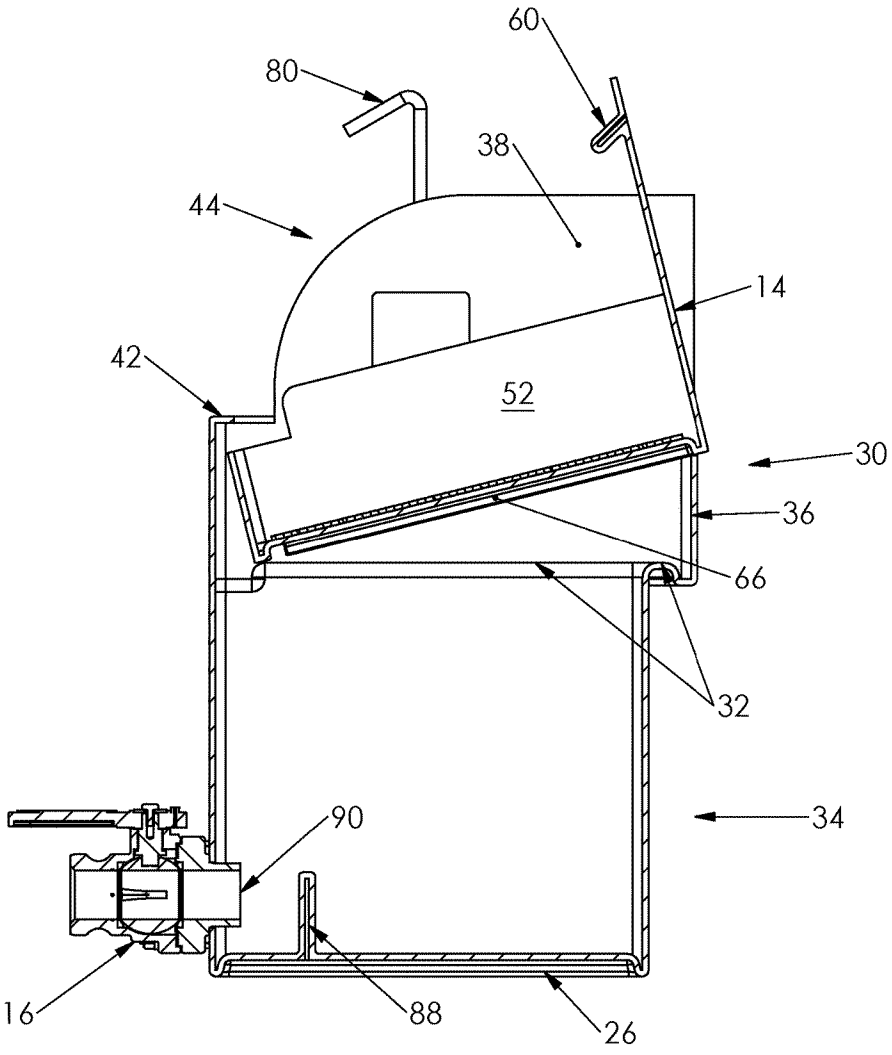
FIG. 7B is a cross-sectional view along view lines 7B-7B of FIG. 7A.
Figure 8:
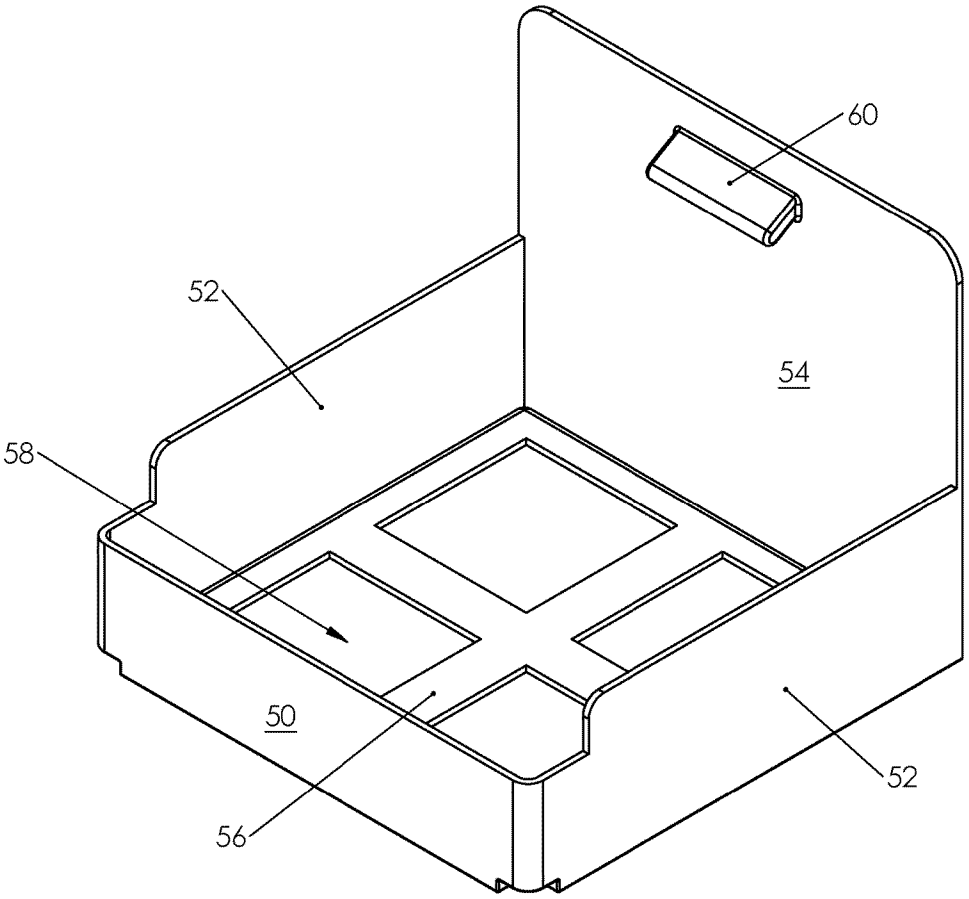
FIG. 8 is a top front isometric view looking down into an exemplary tray unit of the exemplary concrete mixing transport truck chute washout system of FIG. 1.
Figure 25:
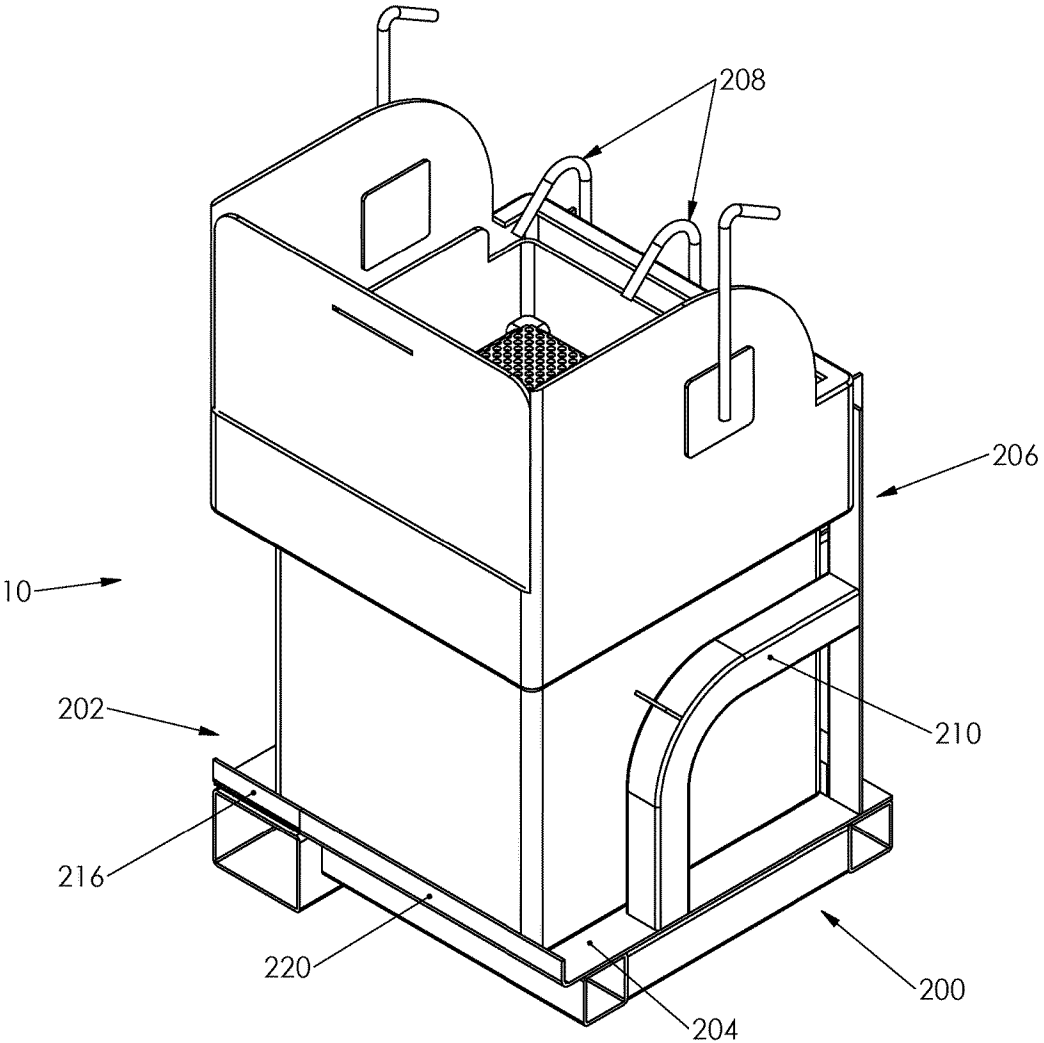
FIG. 25 is a right rear isometric view showing the exemplary concrete mixing transport truck chute washout system seated on an exemplary rack of FIGS. 23A-B with the washout system seated against its restraining arm.

Turning first to FIGS. 1-7A and 7B are various views of exemplary embodiment of a concrete mixing transport truck chute washout system 10 of the invention, wherein FIG. 1 is a top front right isometric view, FIG. 2 is an exploded view, FIG. 3 is a top front isometric view looking down into open tray 14, FIG. 4 is a front view, FIG. 5 is a rear view, FIG. 6 is a cross-sectional view of the concrete mixing transport truck chute washout system 10 along view lines 6-6 of FIG. 1, FIG. 7A is a top front isometric view looking down into the concrete mixing transport truck chute washout system 10 of FIG. 1 but with its tray unit 14 partially removed from the container unit 12, and FIG. 7B is a cross-sectional view along view lines 7B-7B of FIG. 7A. The concrete mixing transport truck chute washout system 10 has a container unit 12 and a tray unit 14 that sits at an upper region 30 of the container unit 12. The container unit 12 has a raised seat 32 at its upper region 30 that engages with the tray 14 to provide a sealing and seating feature. A drainage valve 16 connects via a drain hole 18 in a front wall 20 of the container unit 12. The container unit 12 has opposing side walls 22, a back wall 24, and a bottom 26. The upper region 30 preferably has a larger cross-sectional area than that of a lower region 34. The upper region 30 has a back wall 36 and opposing side walls 38. The front wall 40 is shorter than the back wall 36, and the front wall 40 may be a continuation of the front wall 20 of the container 12. The back wall 36 is made higher than the front wall 40 so that when a cement truck's chute is positioned over an open mouth 44 of the concrete mixing transport truck chute washout system 10, as best shown in FIG. 25, there is less chance for the material being cleaned from the chutes will overflow or overspray. A rim 42 preferably extends inwardly from a top of the front wall 40 towards the back wall 36. The tray unit 14 is adapted to slide into the upper region 30 of the container 12 and slide under the rim 42 and sit on the raised seat 32 and fit snuggly into the upper region 30. The tray unit 14 has a front wall 50, two side walls 52, a back wall 54, and a bottom 56 with openings 58 formed therein. A handle 60 can be formed in the back wall 54 for use in removing the tray 14 from the upper region 30 of the container 12. A strainer 62, such as sheet of perforated metal with predetermined sized hole, will sit on top of an upper surface of the bottom 56 of the tray 14 and will serve to prevent rocks, bits of concrete, or debris larger than the hole size of the strainer 62 from passing through the tray and into the lower region 34 of the container and is the main liquid collection zone. However, water and water with dissolved cement may pass through the tray 14 and drain into the lower region 34 of the container 12. Although the bottom 56 of the tray 14 is shown with a perimeter end and cross bars leaving four openings 58, other arrangement can be provided so long as adequate drainage and support for the strainer 62 is provided. If desired, the strainer 62 may be permanently attached in place to the tray 14, or can be left to be sitting freely on the bottom of the tray 14. As best shown in the cross-sectional view of FIG. 6, a dam 88 preferably extends upwardly from the bottom 26 of the container 12 in front of an entrance 90 of the drainage valve 16. The dam 88 will help prevent any non-liquid debris, e.g., small rocks or sand that may have passed into the lower region 34 of the container 12 from possibly clogging or damaging the valve 16. Referring to FIG. 7A, there is shown a top front isometric view looking down into the concrete mixing transport truck chute washout system 10 of FIG. 1 but with its tray unit 14 partially removed from the container unit 12. As can be seen, the front wall 50 of the tray 14 is slid under the rim 42 extending from the container's front wall 40, and the back wall 54 is lifted up to remove the tray unit 14. When the tray unit 14 is secured in place (as shown in FIG. 1), the side walls 52 of the tray unit 14 will be adjacent to the side walls 38 at the upper region 30 of the container unit 12, and the back wall 54 of the tray unit 14 will be adjacent to the back wall 36 at the upper region 30 of the container unit 12. And as previously noted the rim 42 will extend over the front wall 50 of the tray unit so that liquid and debris will be prevented from splashing up and out of the tray unit 14. During transportation of the concrete mixing transport truck chute washout system 10, the user may choose to leave gravel and loose concrete sitting in the tray unit 14 on top of the strainer 62 as this will further prevent liquid from splashing up and out of the concrete mixing transport truck chute washout system 10. Alternatively, an optional cover 64 (see FIGS. 1 and 2) may be placed over the open mouth 44 as a further barrier to prevent liquid from splashing out. The concrete mixing transport truck chute washout system 10 can be molded out of high strength materials, such as polypropylene, which can take shock and impact without cracking or disintegrating, and will be resistant to corrosion. FIG. 1 shows the container unit 10 fitted with optional suspension hooks 80, which allows the concrete mixing transport truck chute washout system 10 to be hung on the end of a concrete truck chute if desired.

Figure 9:
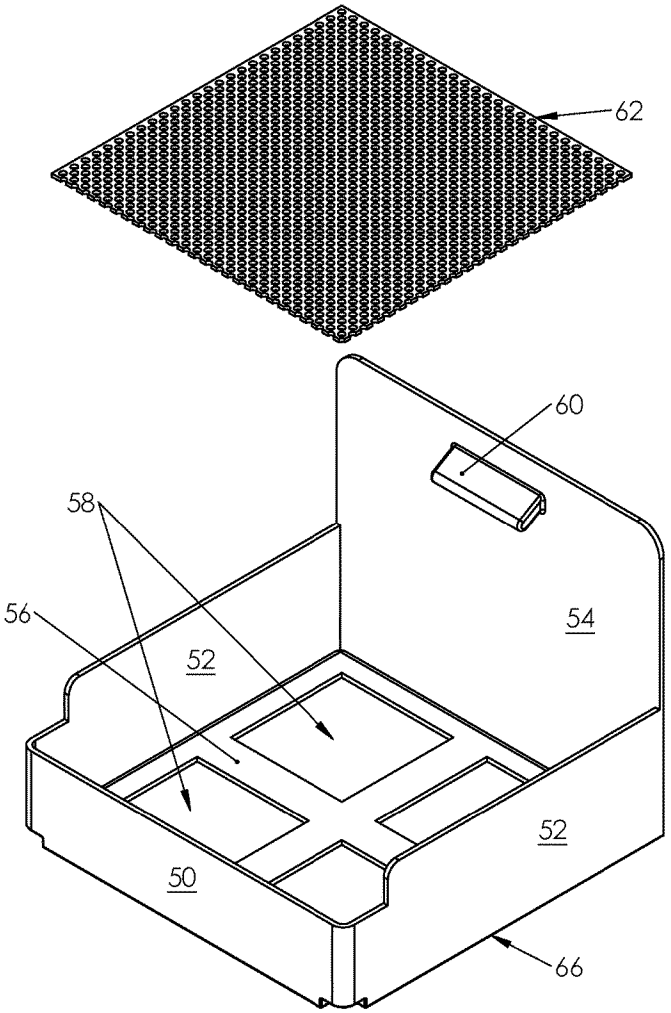
FIG. 9 is a top front exploded view of the tray unit.
Figure 10:
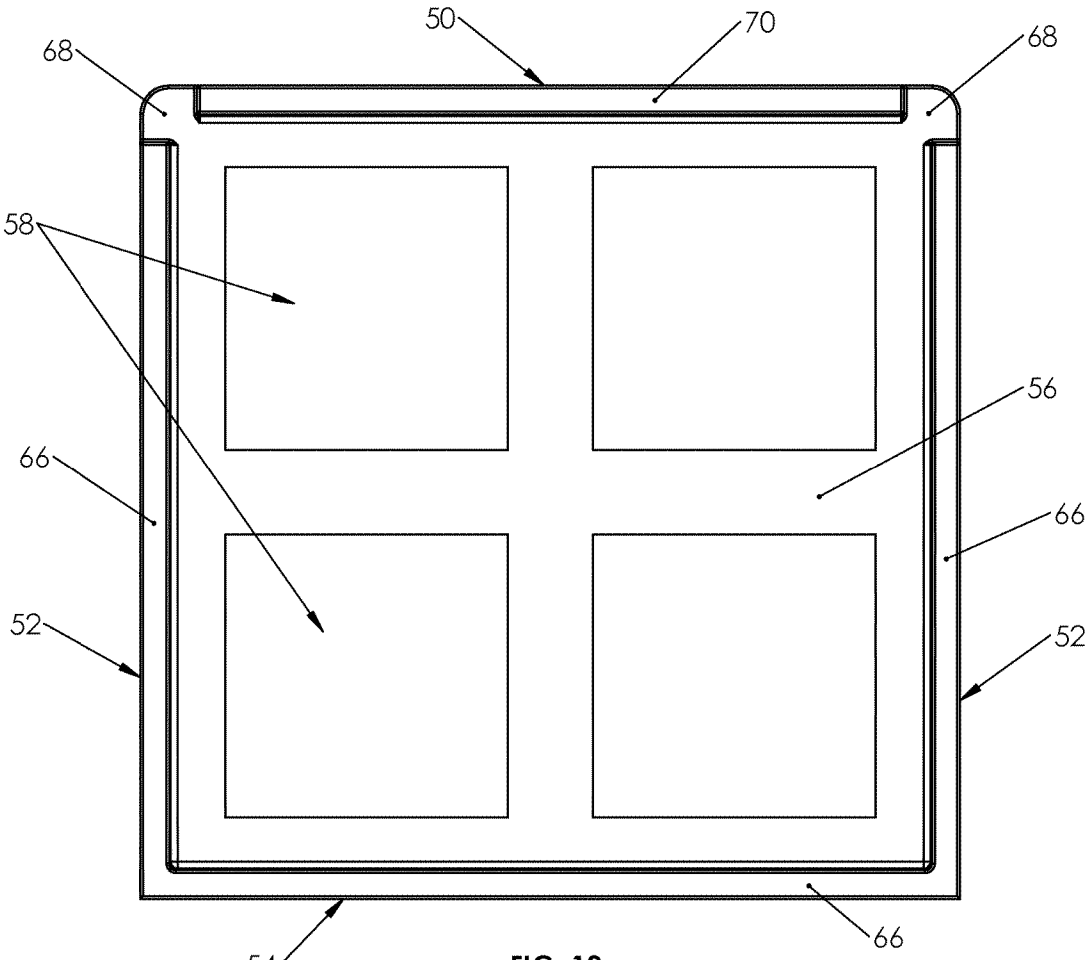
FIG. 10 is a bottom view of the tray unit.
Figure 11:
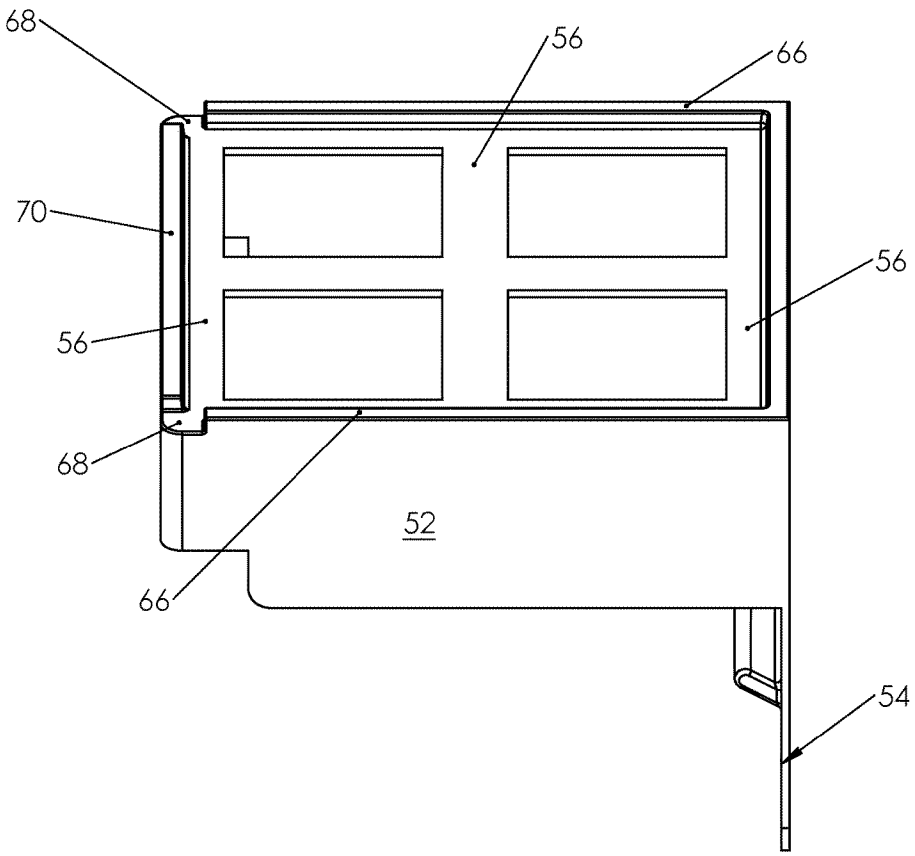
FIG. 11 is a right bottom isometric view of the tray unit.
Figure 12:
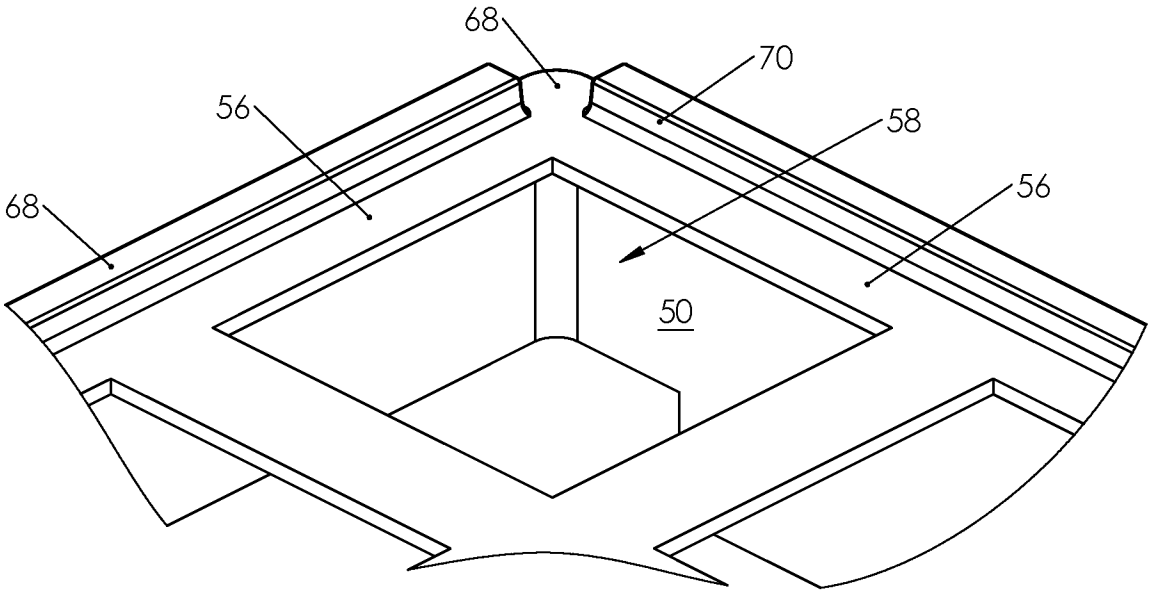
FIG. 12 is a detail view of the bottom of the tray unit showing perimeter ridging.
Figure 13:
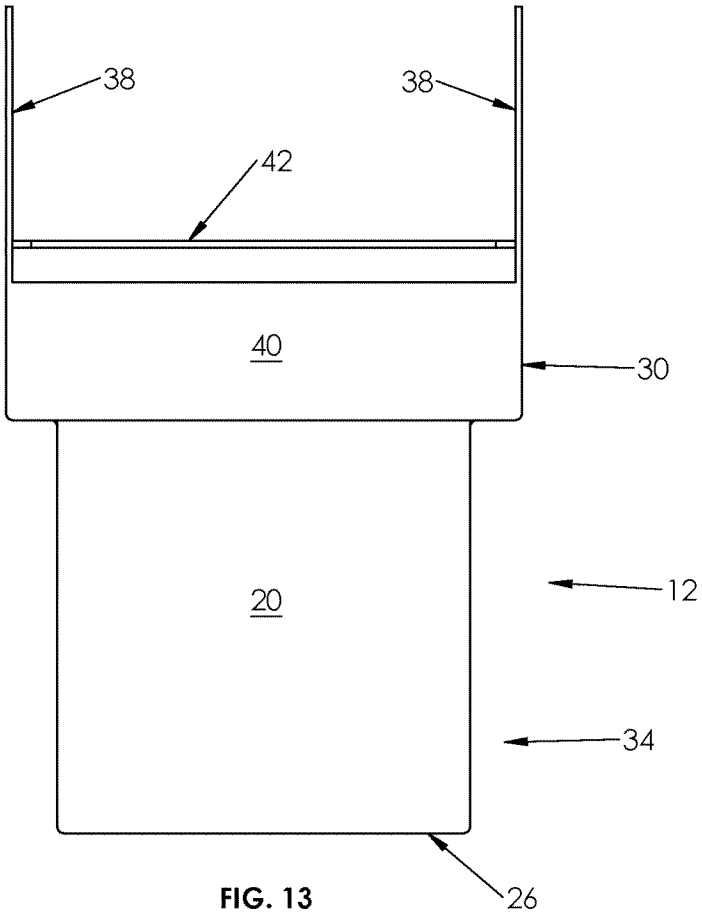
FIG. 13 is a front view of the container portion of the concrete mixing transport truck chute washout system of FIG. 1.

FIGS. 8-12 are various views of the exemplary tray unit 14, wherein FIG. 1 is a top front isometric view looking into the tray unit 14, FIG. 9 is a top front exploded view, FIG. 10 is a bottom view, FIG. 11 is a right bottom isometric view, and FIG. 12 is a detail view of the bottom of the tray unit showing perimeter ridging 70. As previously described, the tray unit 14 has a front wall 50, two side walls 52, a back wall 54, and a bottom 56 with openings 58 formed therein. A handle 60 can be formed in the back wall 54. A strainer 62, such as sheet of perforated metal with predetermined sized hole, will sit on top of an upper surface of the bottom 56 of the tray 14 and will serve to prevent rocks, bits of concrete, or debris larger than the hole size of the strainer 62 from passing through the tray and into the lower region 34 of the container and is the main liquid collection zone. Referring to FIGS. 10-12, the bottom surface of the tray unit 14 is shown from various angles. As can be seen, a protruding rim 66 extends around of the back wall 54 and two opposing side walls 52. A separate protruding rim 70 preferably extends below the front wall 50 and has two rim interruptions 68. These rim interruptions 68 permit any fluid or debris that may splash up against the bottom of the tray unit 14 to drain back down, as will be described further below. Inwardly of the protruding rims 66 and 70 is a perimeter portion of the bottom 56 of the tray unit 14.

Figure 14:
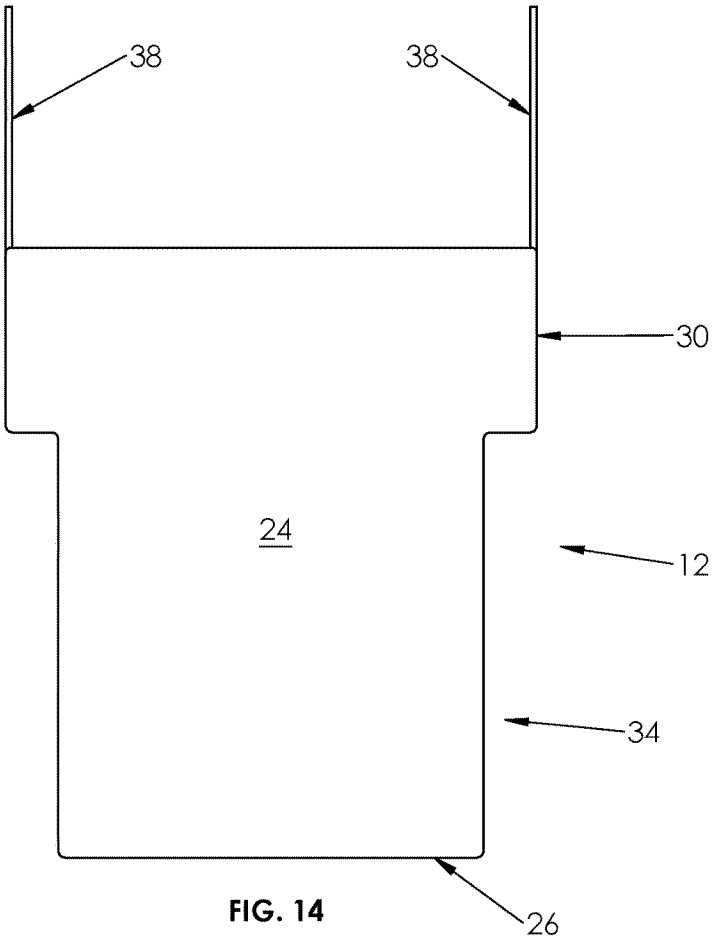
FIG. 14 is a rear view of the container portion of FIG. 12.
Figure 15:
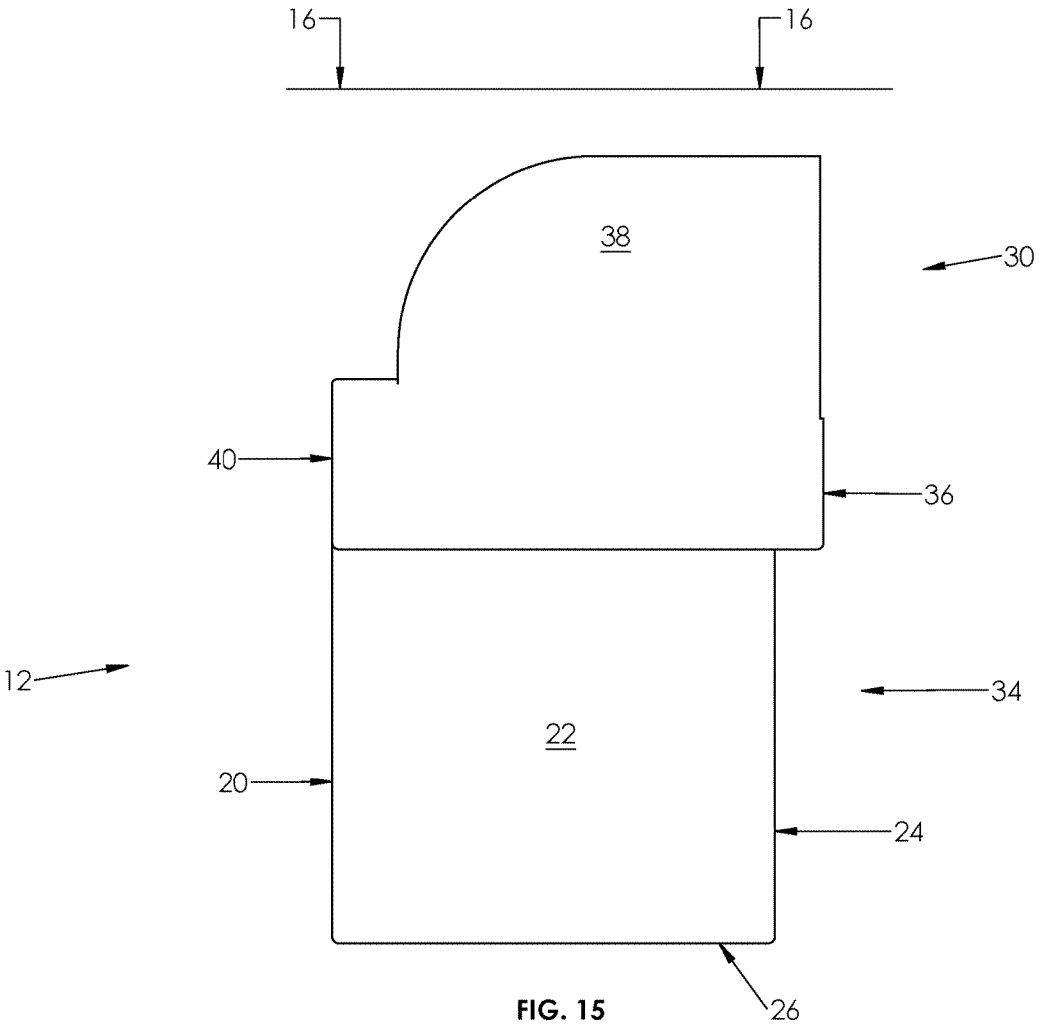
FIG. 15 is a right side view of the container portion of FIG. 12.
Figure 16:
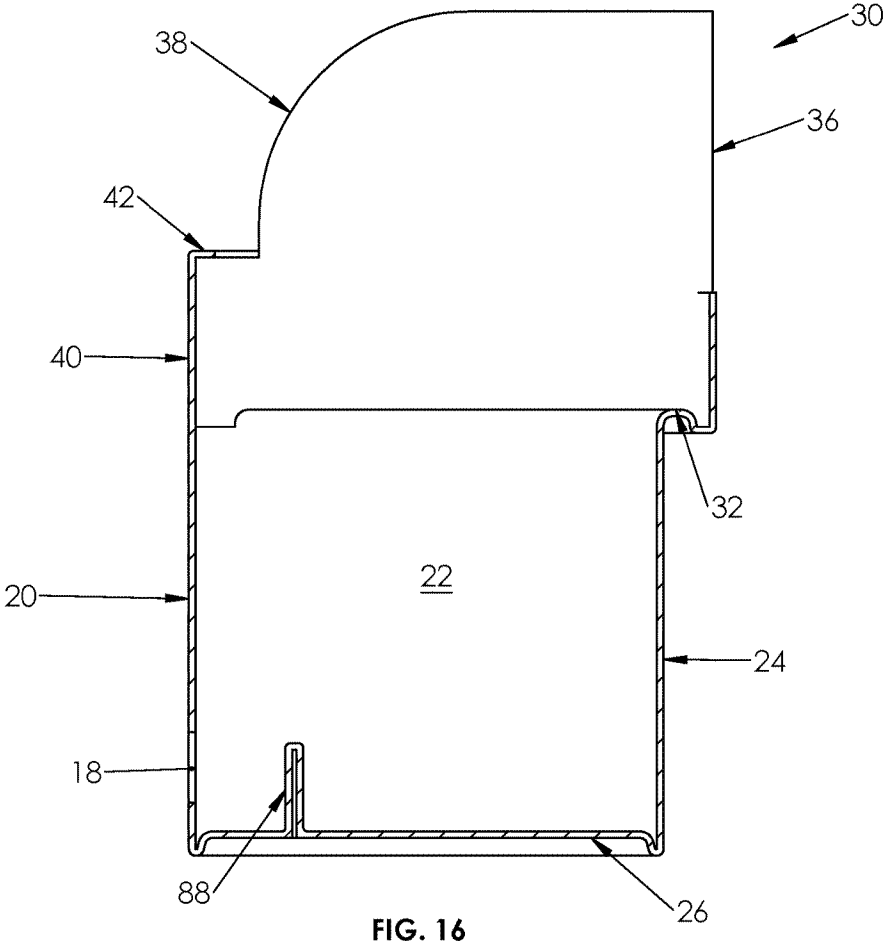
FIG. 16 is a cross-sectional view of the container portion along view lines 16-16 of FIG. 15.
Figure 17:
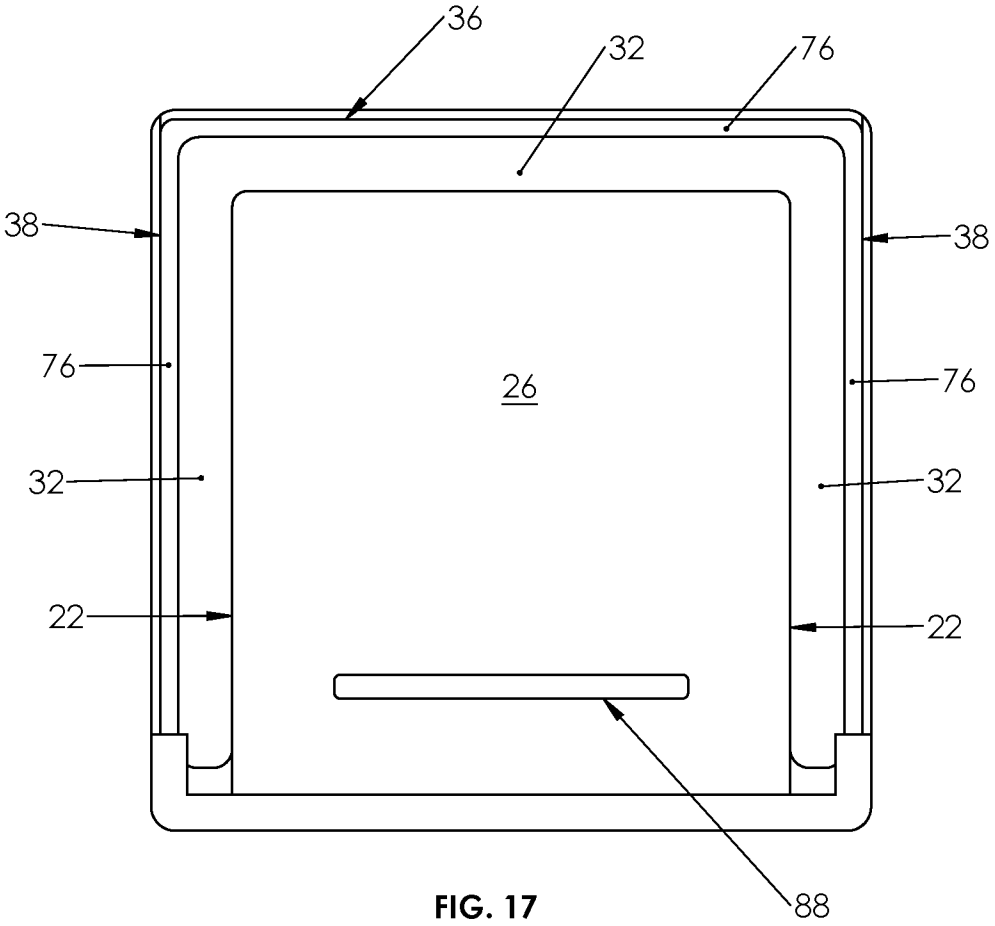
FIG. 17 is a top front isometric view looking down into the container portion of FIG. 13.
Figure 18:
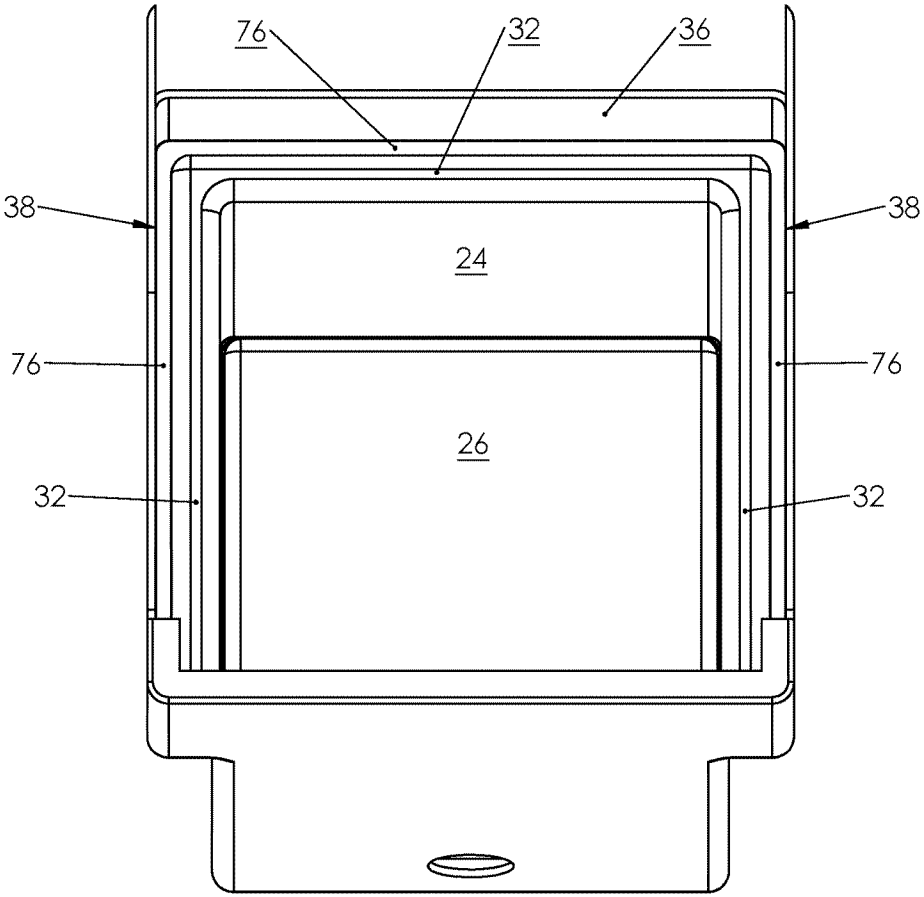
FIG. 18 is a detail view showing a tray seating and sealing feature in the container portion of FIG. 13.

Turning now to FIGS. 13-18, there are shown various views of the container unit 12, wherein FIG. 1 is a front view, FIG. 14 is a rear view, FIG. 15 is a right side view, FIG. 16 is a cross-sectional view of the container unit along view lines 16-16 of FIG. 15, FIG. 17 is a top front isometric view, and FIG. 18 is a detail view showing the tray unit 14 and the raised seat 32 which acts as a seating and sealing feature. The various features of the container unit 12 have been described above, and include the opposing side walls 22, back wall 24, and bottom 26 and an upper region 30 that preferably has a larger cross-sectional area than that of the lower region 34. The upper region 30 has a back wall 36 and opposing side walls 38. The front wall 40 is shorter than the back wall 36, and the front wall 40 may be a continuation of the front wall 20 of the container 12. The back wall 36 is made higher than the front wall 40. As best shown in FIGS. 16-18, the raised seat 32 is located at the bottom of the upper portion 30 of the container 12, and preferably lies at the bottom of the upper region 30 of the container 12. The raised seat 32 is preferably molded together with the rest of the container portion 12 and is spaced away from the side walls 38 and back wall 36 of the upper region 30, leaving a lower border area or a lower gully 76. The area inside of the front wall 78 lacks a section of raised seat 32. This is so that the tray unit 14 can be slid into and out of place in the container portion 12, and so that the protruding rim 66 extending around of the back wall 54 and two opposing side walls 52 at the bottom of the tray unit will seat on the lower border area 76, and so the separate protruding rim 70 extending from the bottom of the tray unit 14 below the front wall 50 will seat on the area inside of the front wall 78 that lacks a section of raised seat. When the tray unit 14 is placed in the upper region 30 of the container portion 12 as shown in FIGS. 1 and 6, the space defined above the raised seat 32 and lower border area 76 of the container portion 12 and below the protruding rims 66 and 70 and perimeter portion of the bottom 56 of the tray unit 14 will provide a seat that will largely prevent liquid from moving out of the lower region 34 of the container, and the rim interruptions 68 will permit any fluid or debris that may splash up against the bottom of the tray unit 14 to drain back down.

Figure 19:
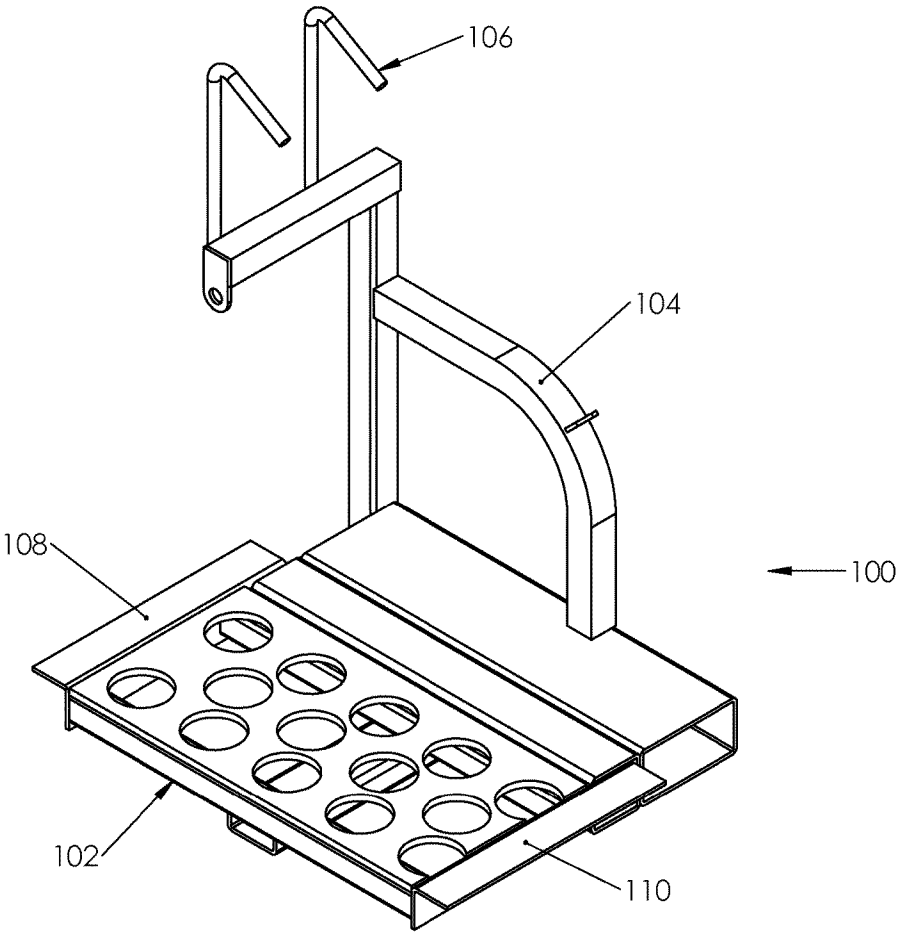
FIG. 19 is a front right isometric view showing an exemplary folding chute washout system rack of the invention.
Figure 20:
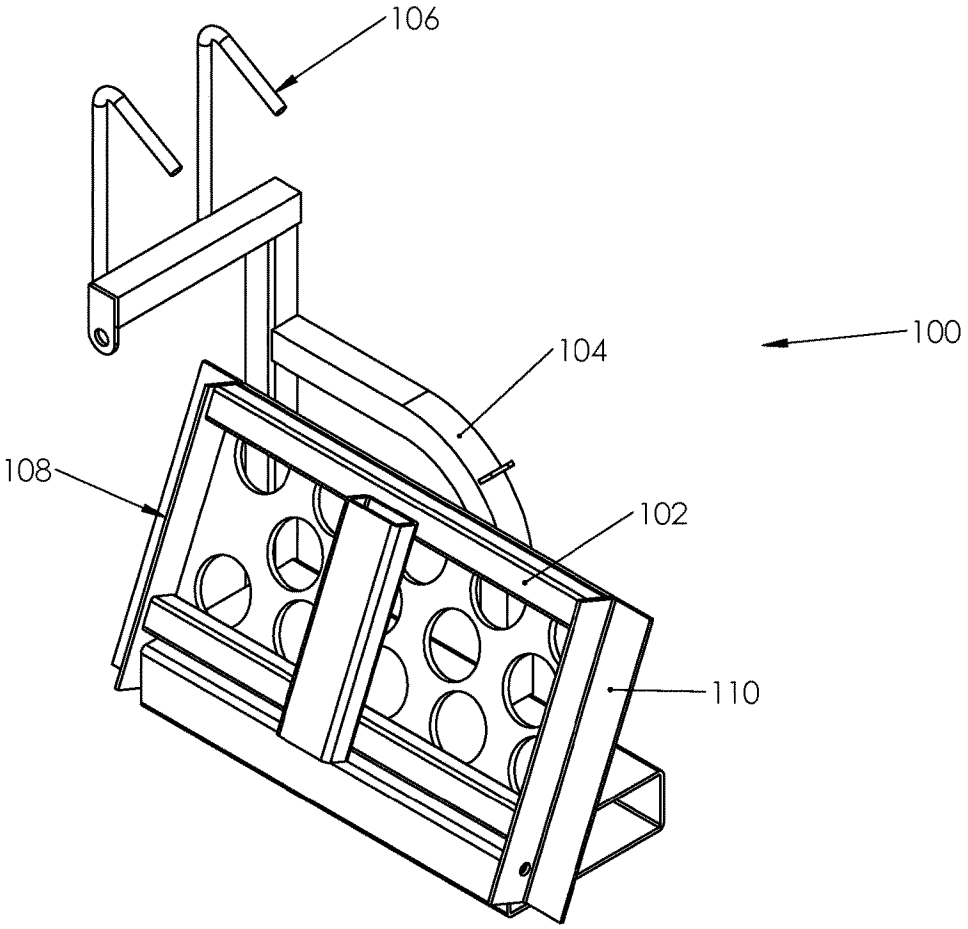
FIG. 20 is another view of the exemplary folding chute washout system rack of the invention of FIG. 19, but this time folded up against a truck to which it is mounted.

FIG. 19 is a front right isometric view showing an exemplary folding chute washout system rack 100 of the invention that is folded down and FIG. 20 is another view of the exemplary folding chute washout system rack 100 that is folded up against a truck T to which it is mounted. The rack 100 has a bottom 102, a front frame 104 with retaining hooks 106, and side pillars 108 and 110. When the rack 100 is folded up, the bottom 102 will be brought against the front frame 104 and the side pillars 108 and 110 will be swung down.

Figure 21:
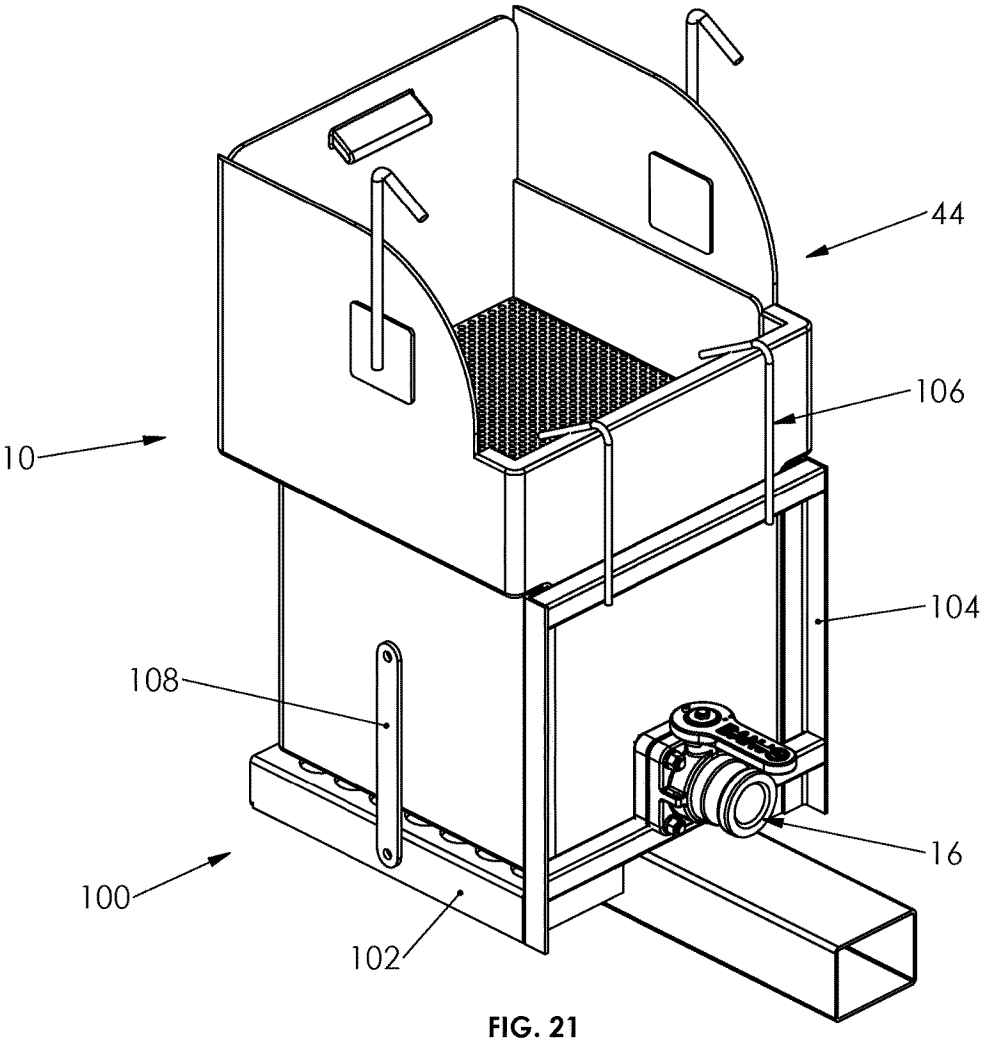
FIG. 21 is a left front isometric view showing the exemplary concrete mixing transport truck chute washout system seated on the exemplary rack of FIG. 19.
Figure 22:
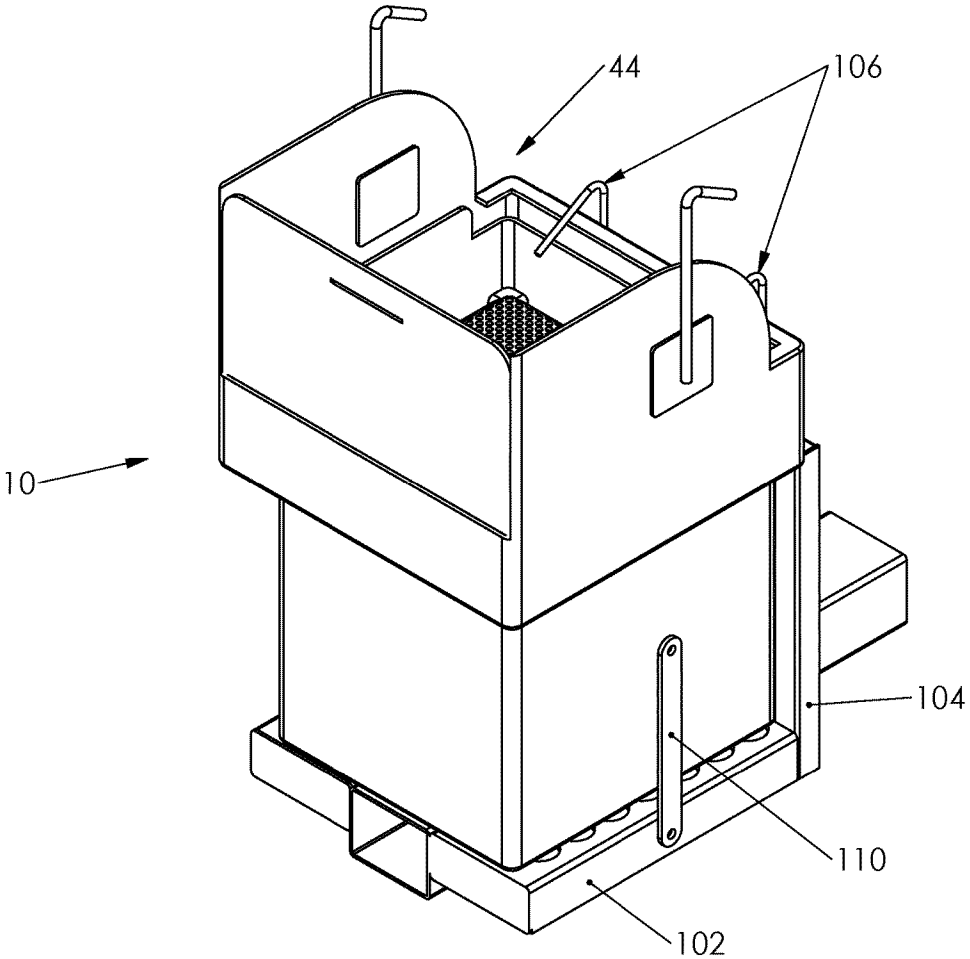
FIG. 22 is a right rear isometric view showing the exemplary concrete mixing transport truck chute washout system seated on the exemplary rack of FIG. 19.

FIG. 21 is a left front and FIG. 22 is right rear isometric view showing the exemplary concrete mixing transport truck chute washout system 10 seated on the exemplary rack 10 of FIG. 19. As can be seen, the retaining hooks 106 of the rack 110 will hook over the front of the washout system 10 and the side pillars 108 and 110 and front frame 104 will hold the washout system 10 in place.

Figure 23A:
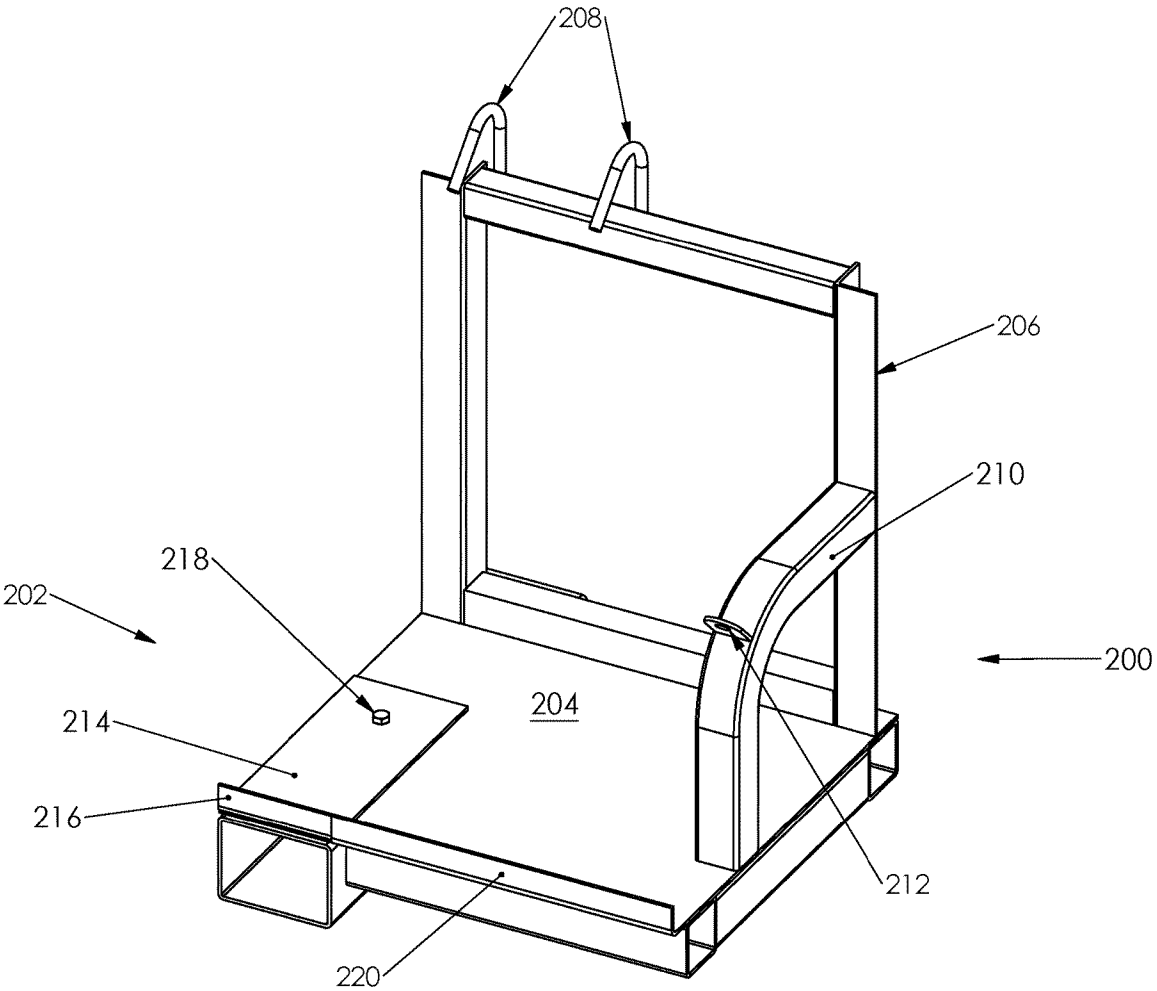
FIG. 23A is a front right isometric view showing another exemplary embodiment of a rack with its extension arm unextended.
Figure 23B:
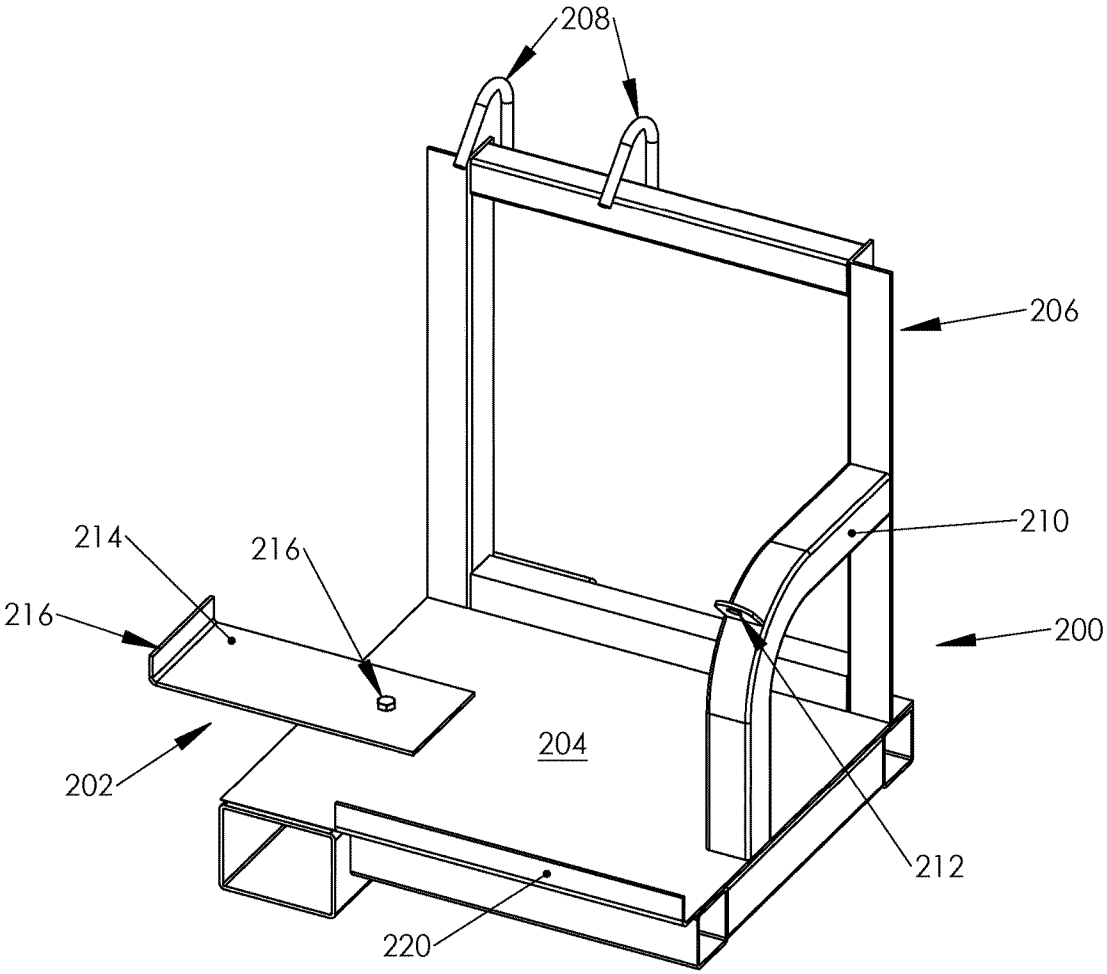
FIG. 23B is a front right isometric view showing the rack of FIG. 23A but with its extension arm extended.

FIG. 23A is a front right isometric view showing another exemplary embodiment of an exemplary folding chute washout system rack 200 of the invention with its extension arm 202 unextended, and FIG. 23B is the same view but with its extension arm 202 extended. The rack 200 has a base 204, a front frame 206 with retaining hooks 208, and a side wall 210. A connection tab 212 may be located on the side wall 210 so that a strap or bungee cord (not shown) can be used. The extension arm 202 preferably has a flat plate bottom 214 and an upturned retention edge 216 and a pivot 218 (e.g., a bolt) pivotally connecting it to the base 214 of the rack 200. When the extension arm 202 is in its unextended position, the upturned retention edge 216 will be flush with a retention edge 220 at the front of the bottom 204 of the rack 200. The retention edge 220 will help retain a container seated thereon. When the extension arm 202 is extended as shown in FIG. 24 by pivoting it on the pivot 216, with effectively widens the base to accommodate a wider container and also allows containers to be shifted on the base 204.

Figure 24A:
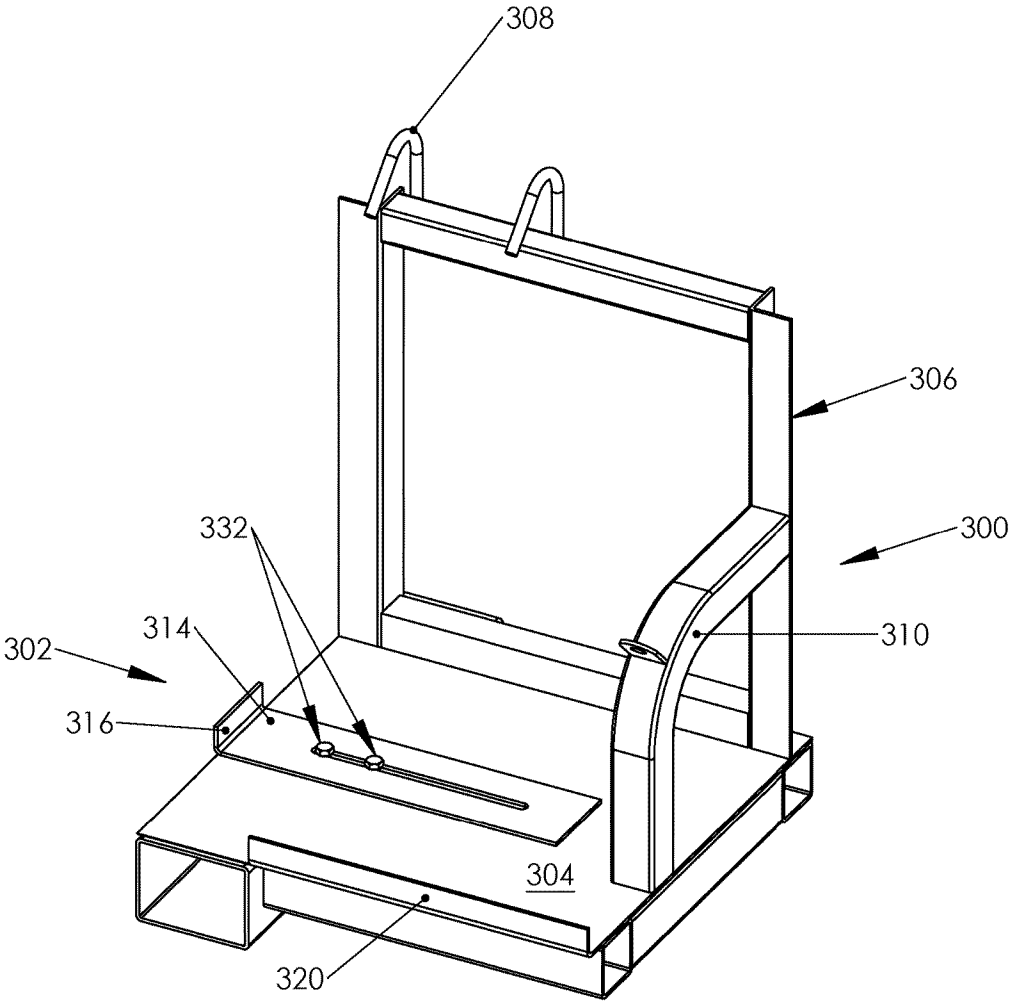
FIG. 24A is a front right isometric view showing yet another exemplary embodiment of a rack with its extension arm unextended.
Figure 24B:
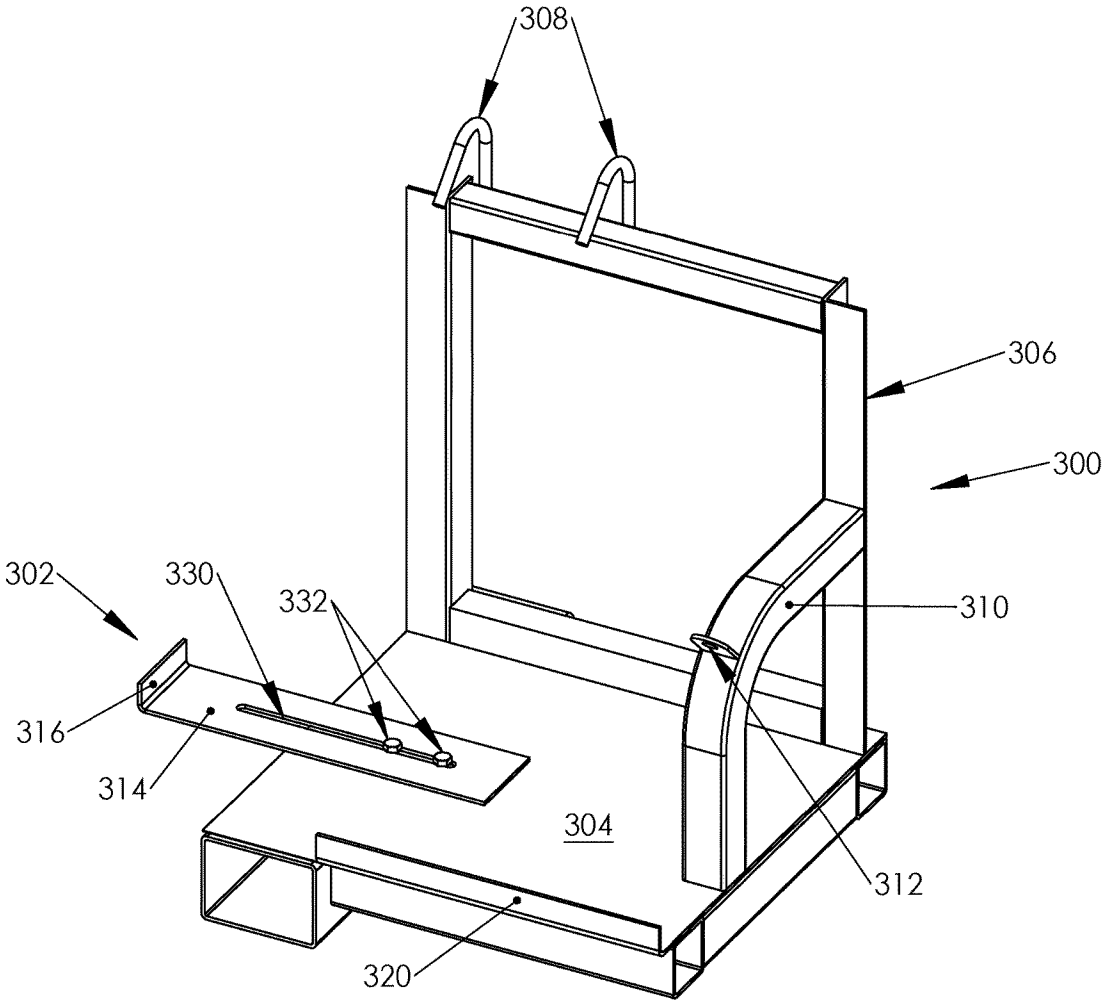
FIG. 24B is a front right isometric view showing the rack of FIG. 24A but with its extension arm extended.

FIG. 24A is a front right isometric view showing yet another exemplary embodiment of a rack 300 with its extension arm 302 unextended, and FIG. 24B is the same view but with its extension arm 302 extended. This embodiment of a rack 300 is very similar to the rack 200 of FIGS. 23A and 23B, and has a base 304, a front frame 306 with retaining hooks 308, and a side wall 310. The base 304 has a retention edge 320 at the front thereof, which will help retain a container seated thereon. A connection tab 312 may be located on the side wall 310 so that a strap or bungee cord (not shown) can be used. The extension arm 302 preferably has a flat plate bottom 314 and an upturned retention edge 316. Unlike the rack 200 of FIGS. 23A and 23B, the extension arm 302 has a slot 330 formed in a flat plate bottom 314 that is slideably retained by two guides 332 affixed to the base 304 that allows the extension arm to be moved between the unextended position of FIG. 24A to the extended position of FIG. 24B. The rack 300 and a pivot 218 (e.g., a bolt) pivotally connecting it to the base 214 of the rack 200. When the extension arm 202 is in its unextended position, the upturned retention edge 216 will be flush with a retention edge 220 at the front of the bottom 204 of the rack 200. When the extension arm 202 is extended as shown in FIG. 24 by pivoting it on the pivot 216, with effectively widens the base to accommodate a wider container and also allows containers to be shifted on the base 204.

Figure 26:
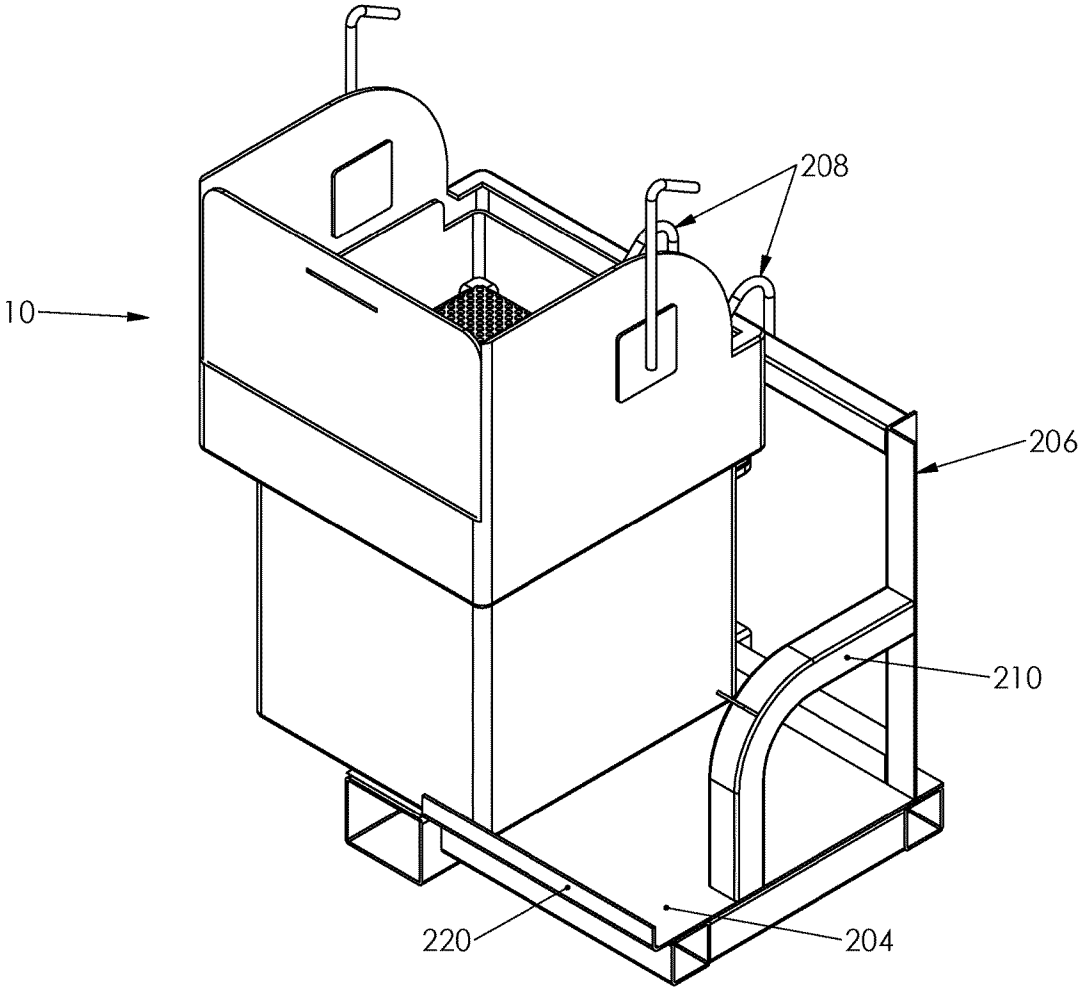
FIG. 26 is a right rear isometric view showing the exemplary concrete mixing transport truck chute washout system seated on an exemplary rack of FIGS. 23A-B with the washout system seated away from its restraining arm.

FIG. 25 is a front right isometric view showing the exemplary concrete mixing transport truck chute washout system 10 seated on an exemplary rack of FIGS. 23A-B with the washout system seated against its back wall 206 and its restraining arm 210, and FIG. 26 is the same view but with the washout system 10 slide away from the restraining arm 210. Not seen, in this position, the washout system will partially rest on the extension arm 202 which has been extended. The upturned retention edge 216 on the base 204 will retain the washout system 10. As can be seen, the retaining hooks 208 of the rack 200 will hook over the front of the washout system 10 and the restraining arm 210 will hold the washout system 10 in place.

Figure 27:
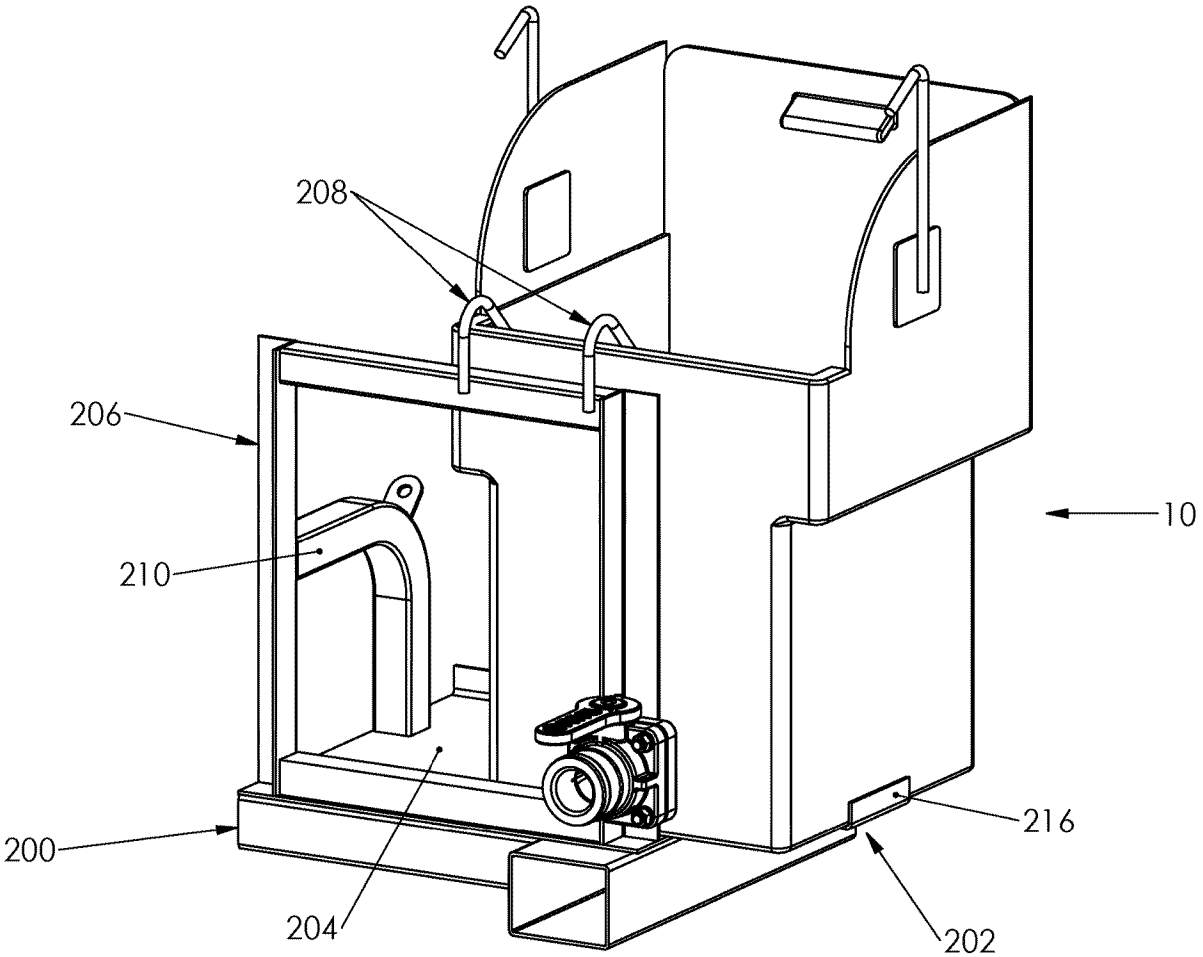
FIG. 27 is a left front isometric view showing the exemplary concrete mixing transport truck chute washout system seated on an exemplary rack of FIGS. 23A-B with the washout system seated away from its restraining arm.

FIG. 26 is a right rear isometric view and FIG. 27 is left front isometric view showing the exemplary concrete mixing transport truck chute washout system seated on an exemplary rack of FIGS. 23A-B with the washout system 10 seated away from its restraining arm 210 on resting on the arm extension 202.

Figure 28:
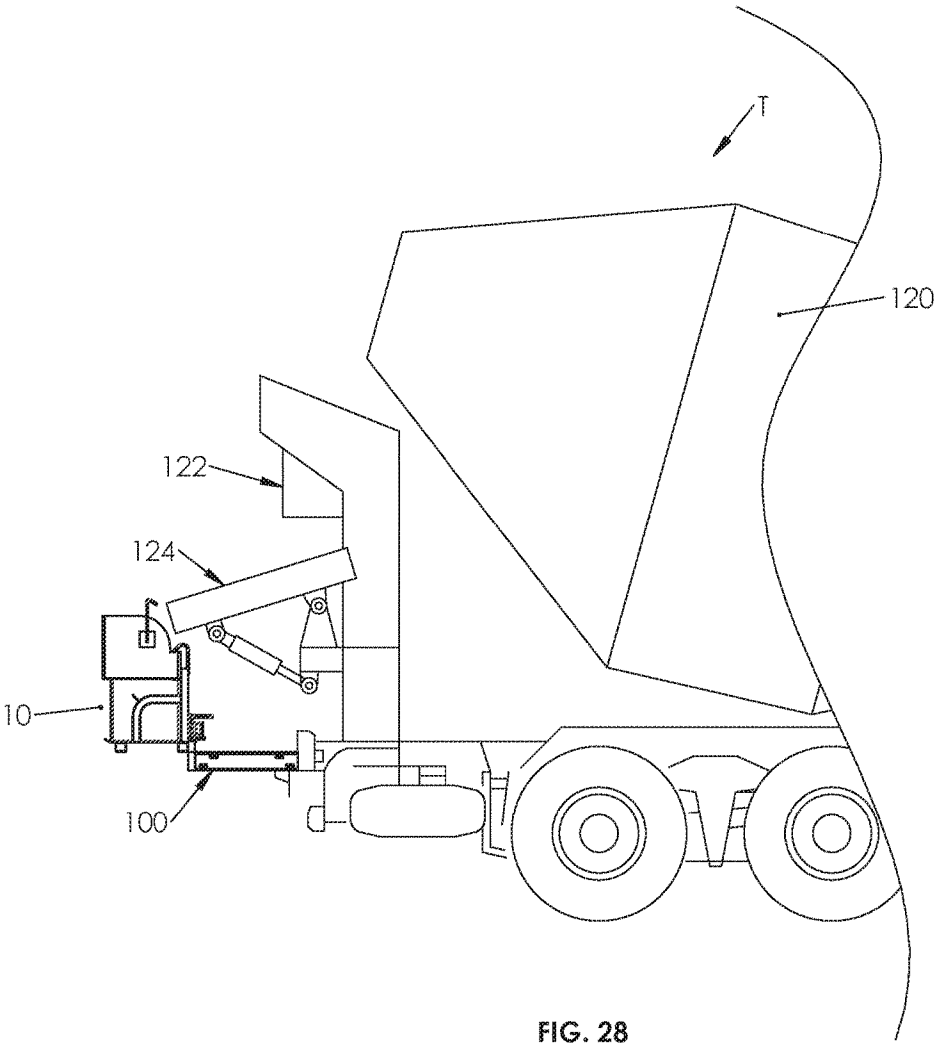
FIG. 28 is a diagrammatic view showing a concrete mixing transport truck equipped with the concrete mixing transport truck chute washout system and rack of the invention.
Figure 29:
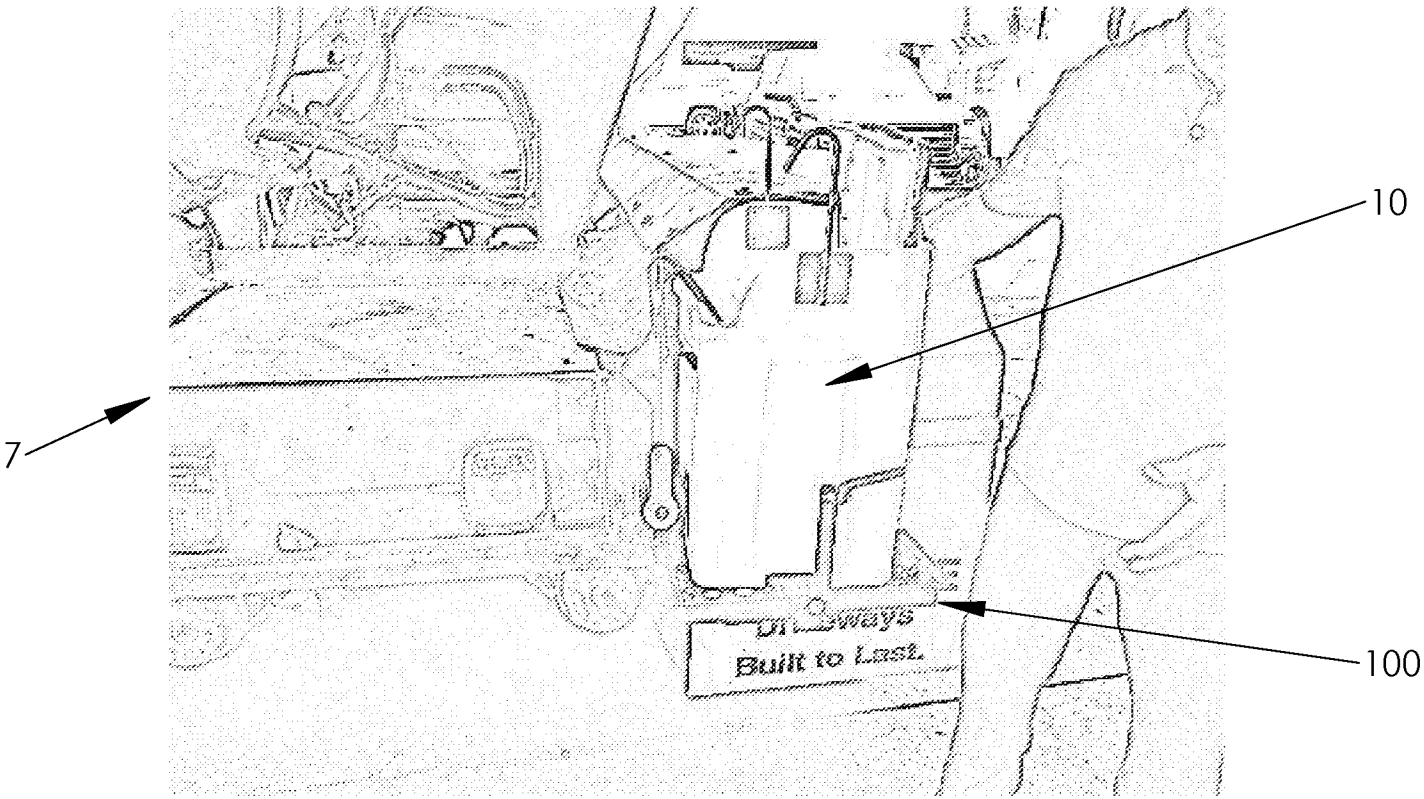
FIG. 29 is a side view showing the concrete mixing transport truck chute washout system and rack of the invention mounted to the side of a truck.
Figure 30:
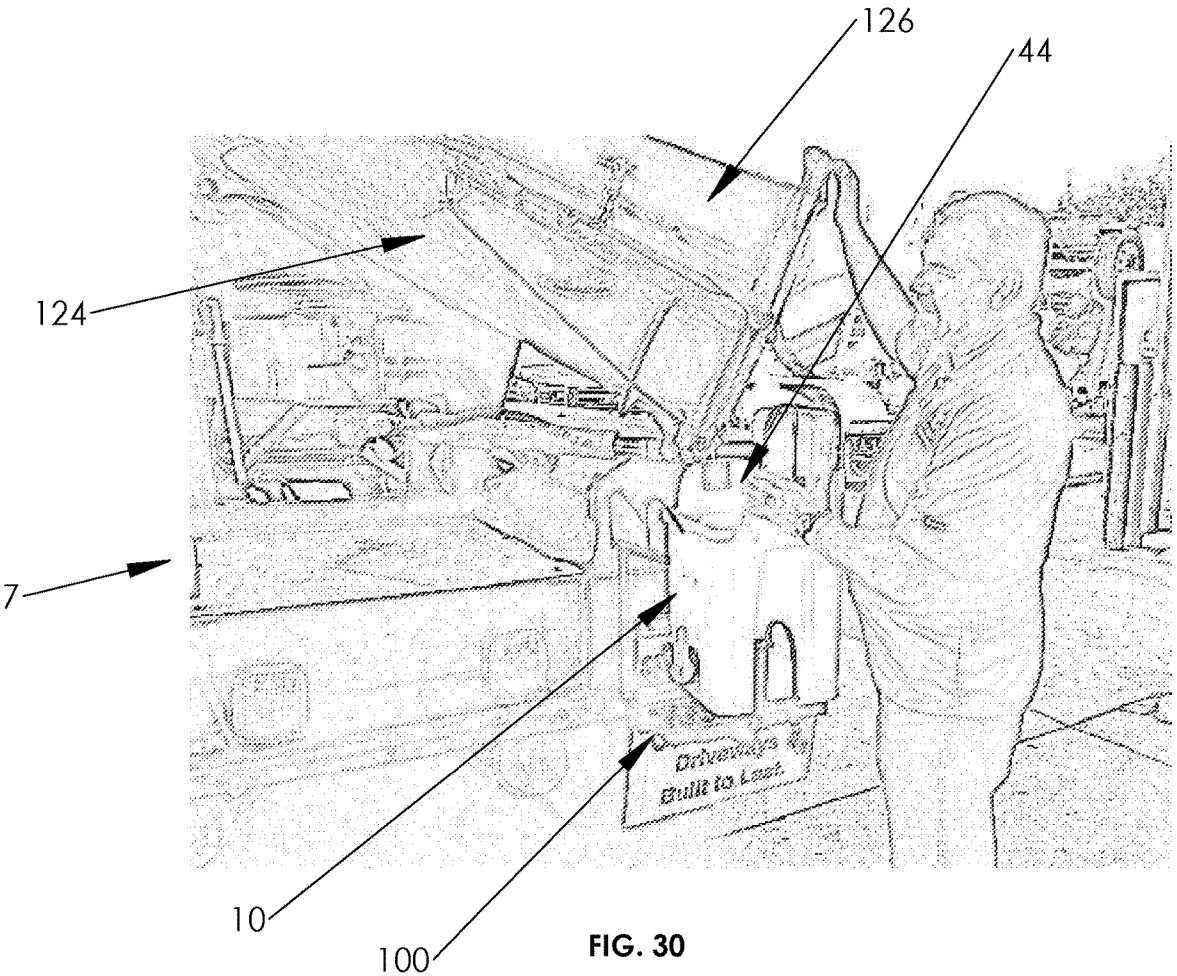
FIG. 30 is a side view showing the concrete mixing transport truck chute washout system and rack of the invention mounted to the side of a truck with a main chute and a flop over chute of the cement truck positions over the washout system.

FIG. 28 is a diagrammatic view showing a concrete mixing transport truck T equipped with the concrete mixing transport truck chute washout system 10 and rack 100 of the invention. The truck T has a mixing drum 120 with an egress 122 that will pass the concrete down a main chute 124, and a flop over chute 126 (seen flopped up over the main chute 124 in FIG. 30), and possible chute extensions that can be added onto the end of the flop over chute to extend the working length of the chute. FIG. 29 is a side view showing the concrete mixing transport truck chute washout system 10 and rack 100 mounted to the side of a truck T.

In use of the concrete mixing transport truck chute washout system 10, the user will first position the concrete mixing transport truck chute washout system 10 on the ground below the terminal end of any chute extension(s) while it/they are still attached to the flop over chute, and spray off with water these chute extension(s). Gravel, large aggregate, and chunks of cement will be collected in the tray unit 14 and the liquid will drain into the lower region of the container unit 12. After any chute extensions are cleaned, they may be detached from the end of the flop over chute 126 and stored on the truck. At this point, the concrete mixing transport truck chute washout system 10 will normally be picked up and placed on the tray 100. The weight of the washout system 10 and its collected liquid and debris should still not be substantial at this point since one or at most two chute extensions would have been washed out at this point. Once the washout system 10 is sitting on the rack 100 mounted on the truck, the flop over chute 126 will be flopped over the main chute 124 and the open ends of the main chute 124 and flop over chute 126 will be positioned over the open mouth 44 of the washout system 10. The user will then spray off the main chute 124 and flop over chute 126 with the runoff draining into the tray unit 14 to collect aggregate and with liquid and small debris, such as sand, being collected in the container unit 12. The washout system 10 will preferably be sized to have a fluid volume of between 5 and 12 gallons. For example, in one embodiment of the invention, the upper region 30 of the container can have a width of about 16", a depth of about 15", and a height of about 5" to the front wall and about 11" at the top of the side walls. The lower region 34 can have interior dimensions of about 13"wide, about 13" deep, and a height of about 12", for a total volume of about 2028 cubic inches, or about 8.8 gallons. If more water is needed to clean out the chutes than can be collected in the container unit 12, the user can connect a hose (not shown between the drainage valve 16 and an auxiliary tank that may be stored on the truck and drain fluid from the container unit 12 to the auxiliary tank, thereby freeing up additional capacity.

Figure 31:
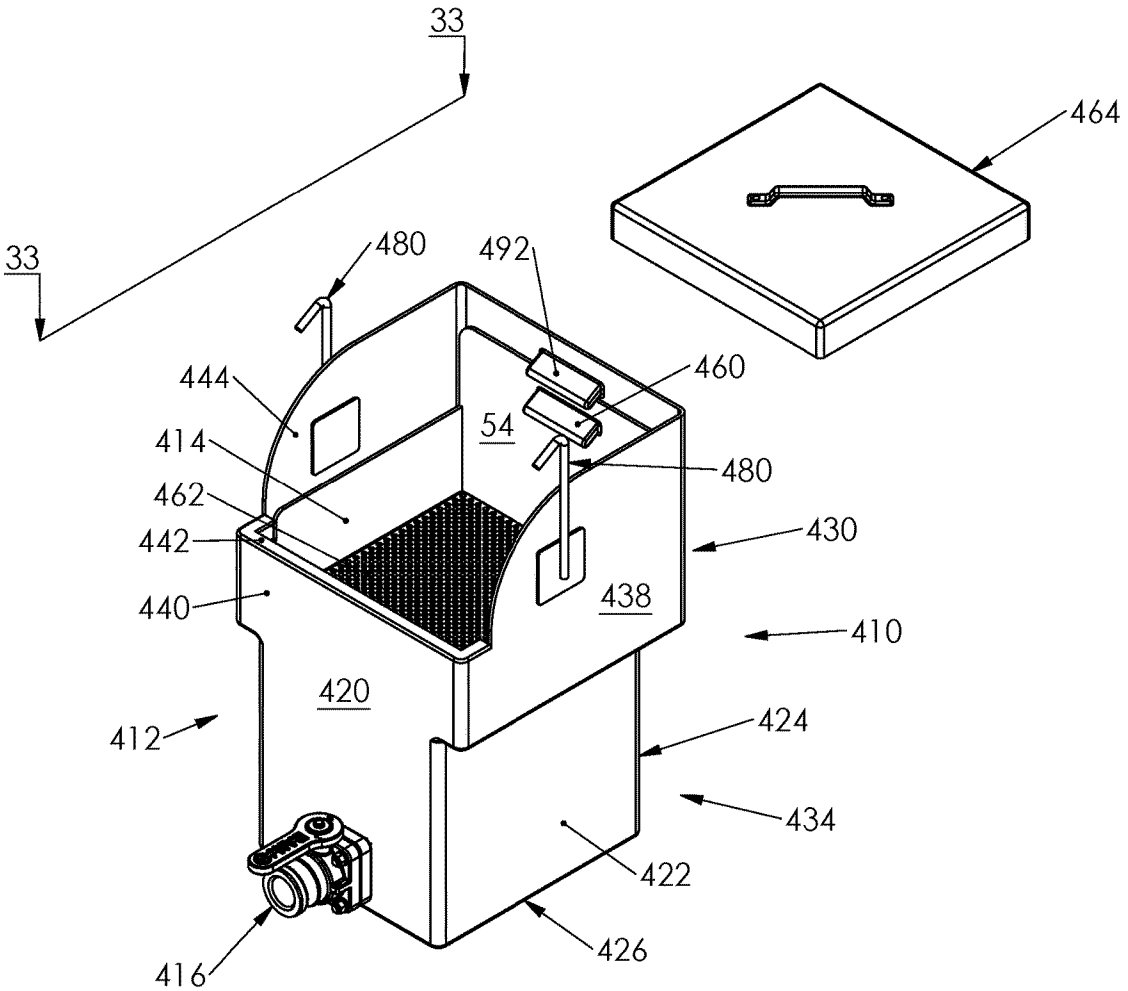
FIG. 31 is a top front right isometric view of another exemplary embodiment of a concrete mixing transport truck chute washout system of the invention.
Figure 32:
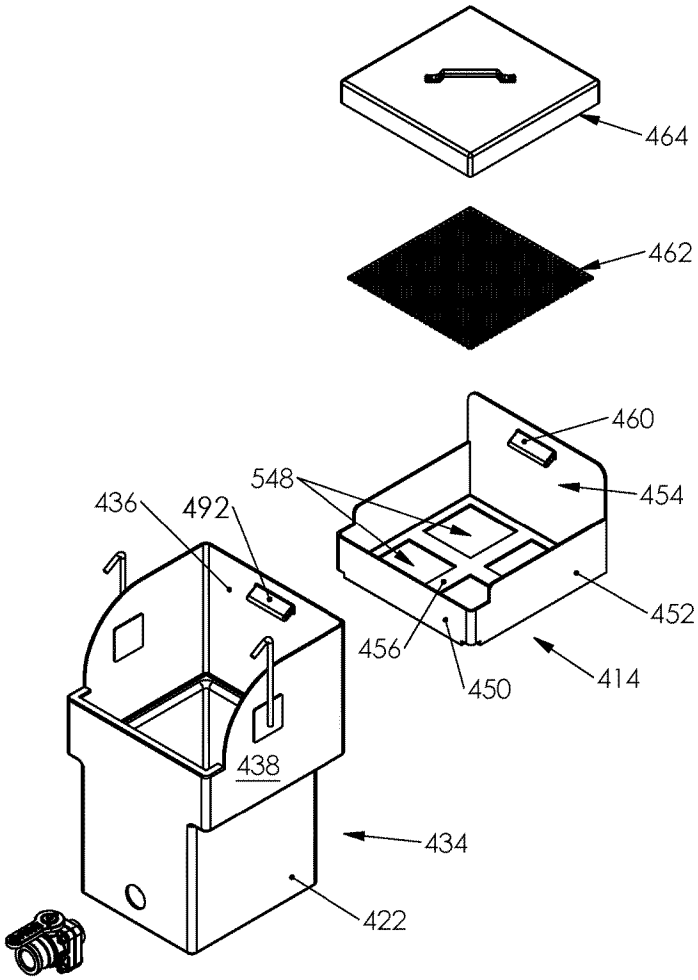
FIG. 32 is an exploded view of the concrete mixing transport truck chute washout system of FIG. 31.
Figure 33:
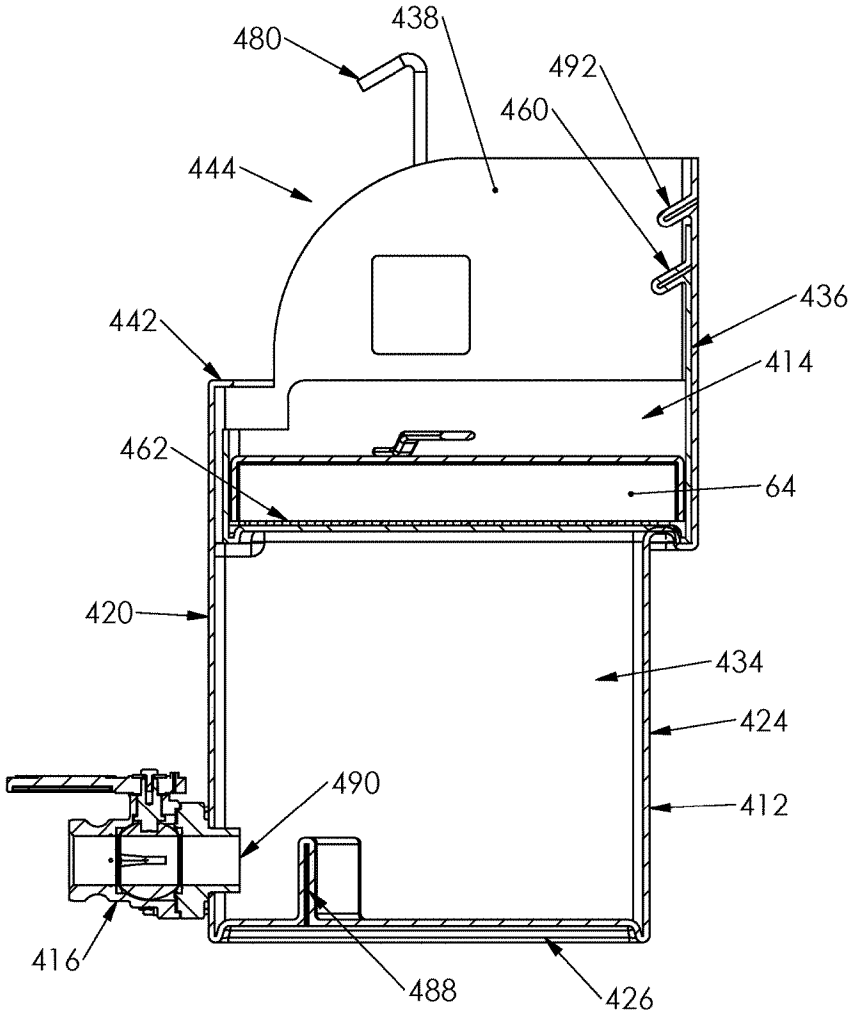
FIG. 33 is a cross-sectional view of the concrete mixing transport truck chute washout system of FIG. 31.
Figure 34:
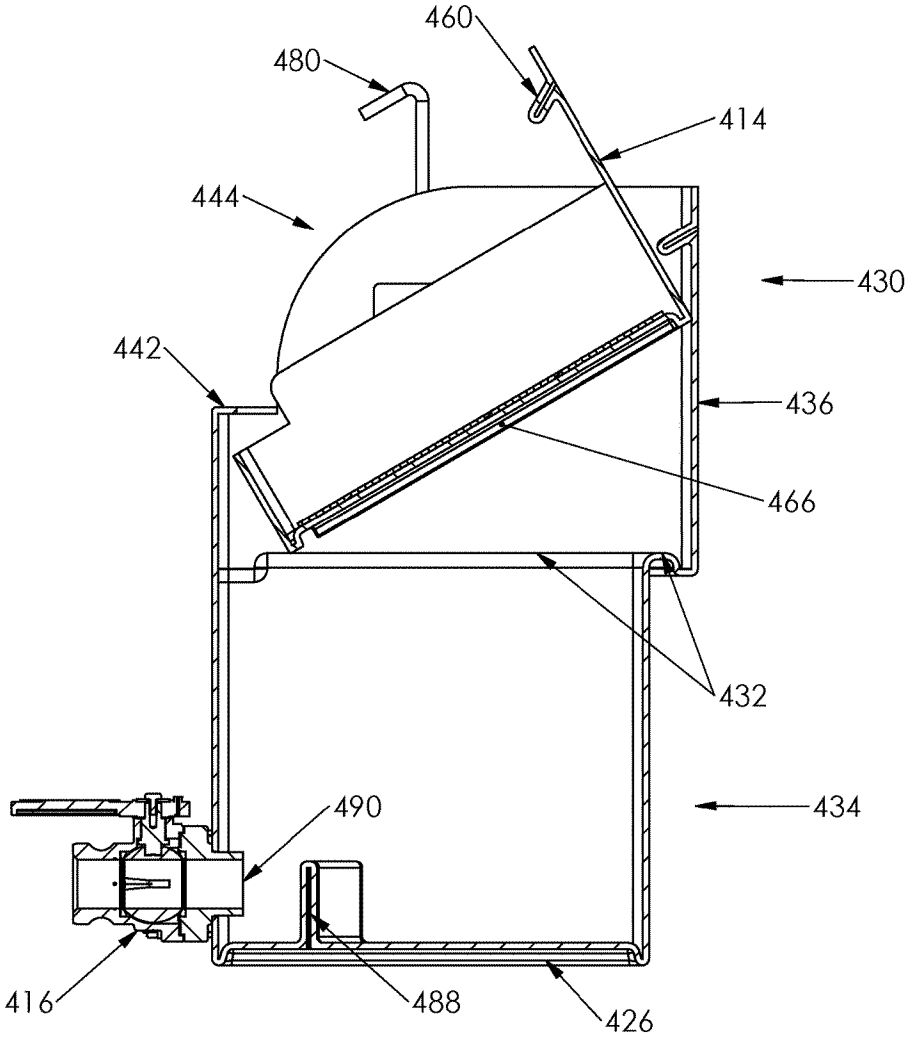
FIG. 34 is a cross-sectional view of the concrete mixing transport truck chute washout system of FIG. 31 but with its tray unit partially removed.

FIGS. 31-34 are views of another exemplary embodiment of a concrete mixing transport truck chute washout system 400 of the invention, wherein FIG. 31 is a top front right isometric view, FIG. 32 is an exploded view, FIG. 33 is a cross-sectional view, and FIG. 34 is a cross-sectional view of the concrete mixing transport truck chute washout system of FIG. 31 but with its tray unit partially removed. The concrete mixing transport truck chute washout system 400 is very similar to the concrete mixing transport truck chute washout system 10 described above, except as described below.

The concrete mixing transport truck chute washout system 400 has a container unit 412 and a tray unit 414 that sits at an upper region 430 of the container unit 412. The container unit 412 has a raised seat 432 at its upper region 430 that engages with the tray 414 to provide a sealing and seating feature. A drainage valve 416 connects via a drain hole 418 in a front wall 420 of the container unit 412. The container unit 412 has opposing side walls 422, a back wall 424, and a bottom 426. The upper region 430 preferably has a larger cross-sectional area than that of a lower region 434. The upper region 430 has a back wall 436 and opposing side walls 438. The front wall 440 is shorter than the back wall 436, and the front wall 440 may be a continuation of the front wall 420 of the container 412. The back wall 436 is made higher than the front wall 440 so that when a cement truck's chute is positioned over an open mouth 444 of the concrete mixing transport truck chute washout system 410, similarly as shown in FIG. 25, there is less chance for the material being cleaned from the chutes will overflow or overspray. A rim 442 preferably extends inwardly from a top of the front wall 440 towards the back wall 436. The tray unit 414 is adapted to slide into the upper region 430 of the container 412 and slide under the rim 442 and sit on the raised seat 432 and fit snuggly into the upper region 430. The tray unit 414 has a front wall 450, two side walls 452, a back wall 454, and a bottom 456 with openings 458 formed therein. A handle 460 can be formed in the back wall 54 for use in removing the tray 414 from the upper region 430 of the container 412. Unlike the concrete mixing transport truck chute washout system 100 noted above where the back wall 54 of the tray 14 fills in a gap in the back side of the container unit 12, in the embodiment of the concrete mixing transport truck chute washout system 400, the container unit 412 has a back wall 436 that is high and has its own integral handle 492. When the tray unit 414 is placed in the container unit 412, a top edge of its back wall 454 will impinge on the handle 492 formed on the back wall of the container unit 412 and help retain the tray unit 414 in place in the container unit 412 and provide enhanced sealing. Moreover, the extra handle 492 on the back wall of the container unit 412 can be used as an additional handhold when handling the device. A strainer 462, such as sheet of perforated metal with predetermined sized hole, will sit on top of an upper surface of the bottom 456 of the tray 414 and will serve to prevent rocks, bits of concrete, or debris larger than the hole size of the strainer 462 from passing through the tray and into the lower region 434 of the container and is the main liquid collection zone. However, water and water with dissolved cement may pass through the tray 414 and drain into the lower region 434 of the container 412. Although the bottom 456 of the tray 414 is shown with a perimeter end and cross bars leaving four openings 458, other arrangement can be provided so long as adequate drainage and support for the strainer 462 is provided. If desired, the strainer 462 may be permanently attached in place to the tray 414, or can be left to be sitting freely on the bottom of the tray 414. As best shown in the cross-sectional views of FIGS. 33 and 34, a dam 488 preferably extends upwardly from the bottom 426 of the container 412 in front of an entrance 490 of the drainage valve 416. The dam 488 will help prevent any non-liquid debris, e.g., small rocks or sand that may have passed into the lower region 434 of the container 412 from possibly clogging or damaging the valve 416.

Figure 35:
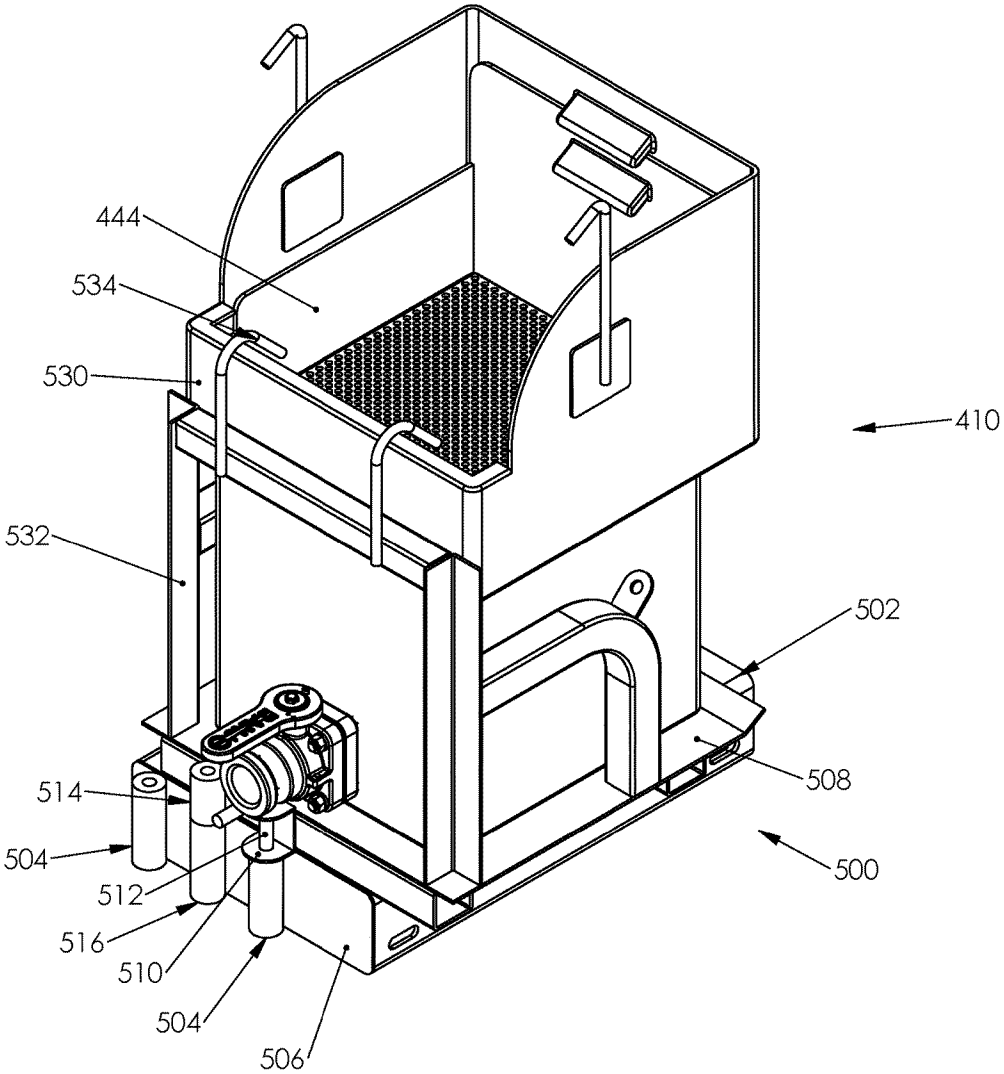
FIG. 35 is a front top isometric view of the concrete mixing transport truck chute washout system of FIG. 31 on a pivoting rack system with the washout system swung over the platform of the rack.
Figure 36A:
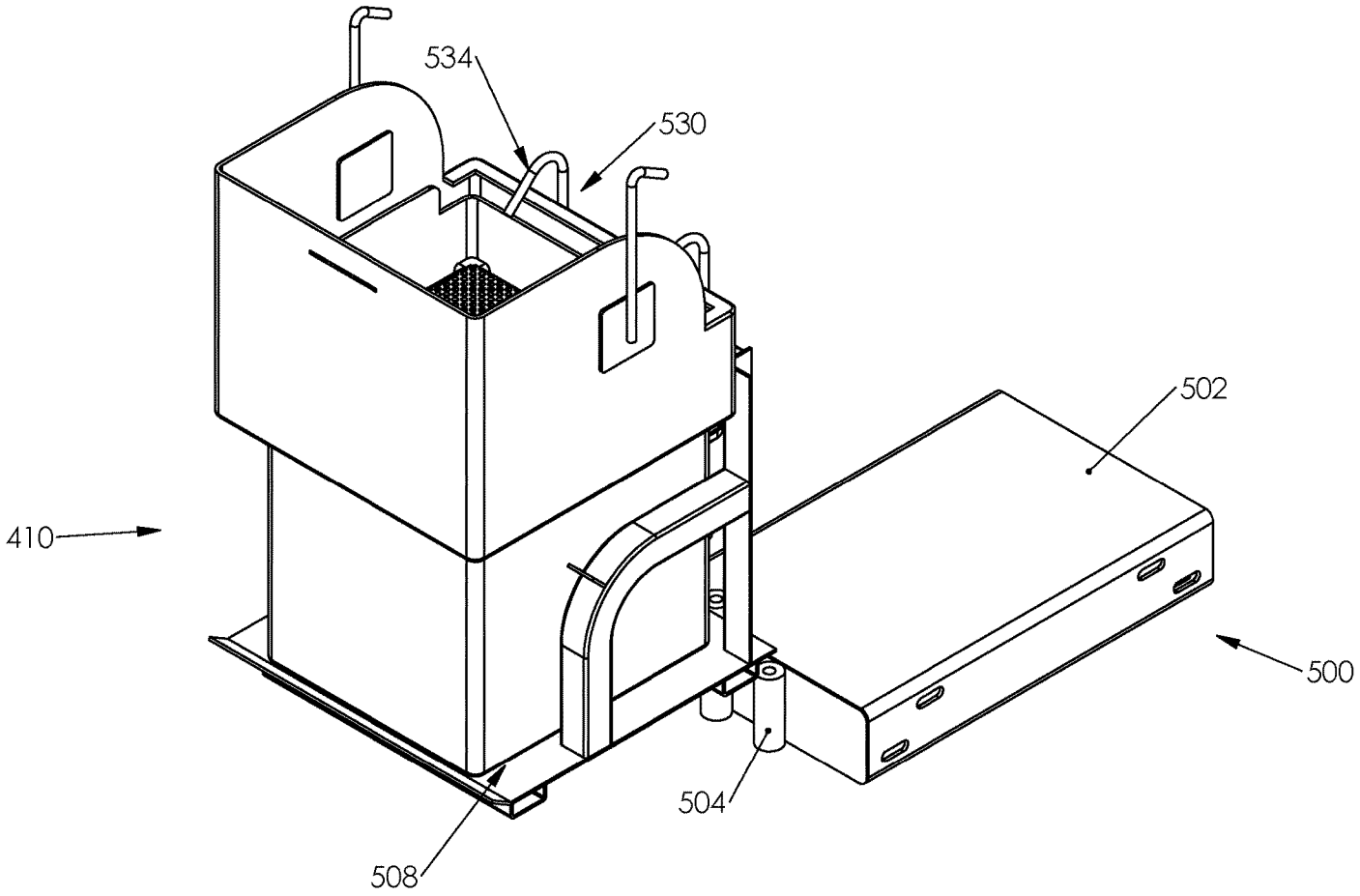
FIG. 36A is a rear top isometric view of the concrete mixing transport truck chute washout system and rack of FIG. 35 but with the washout system pivoted away from the platform of the rack.
Figure 36B:
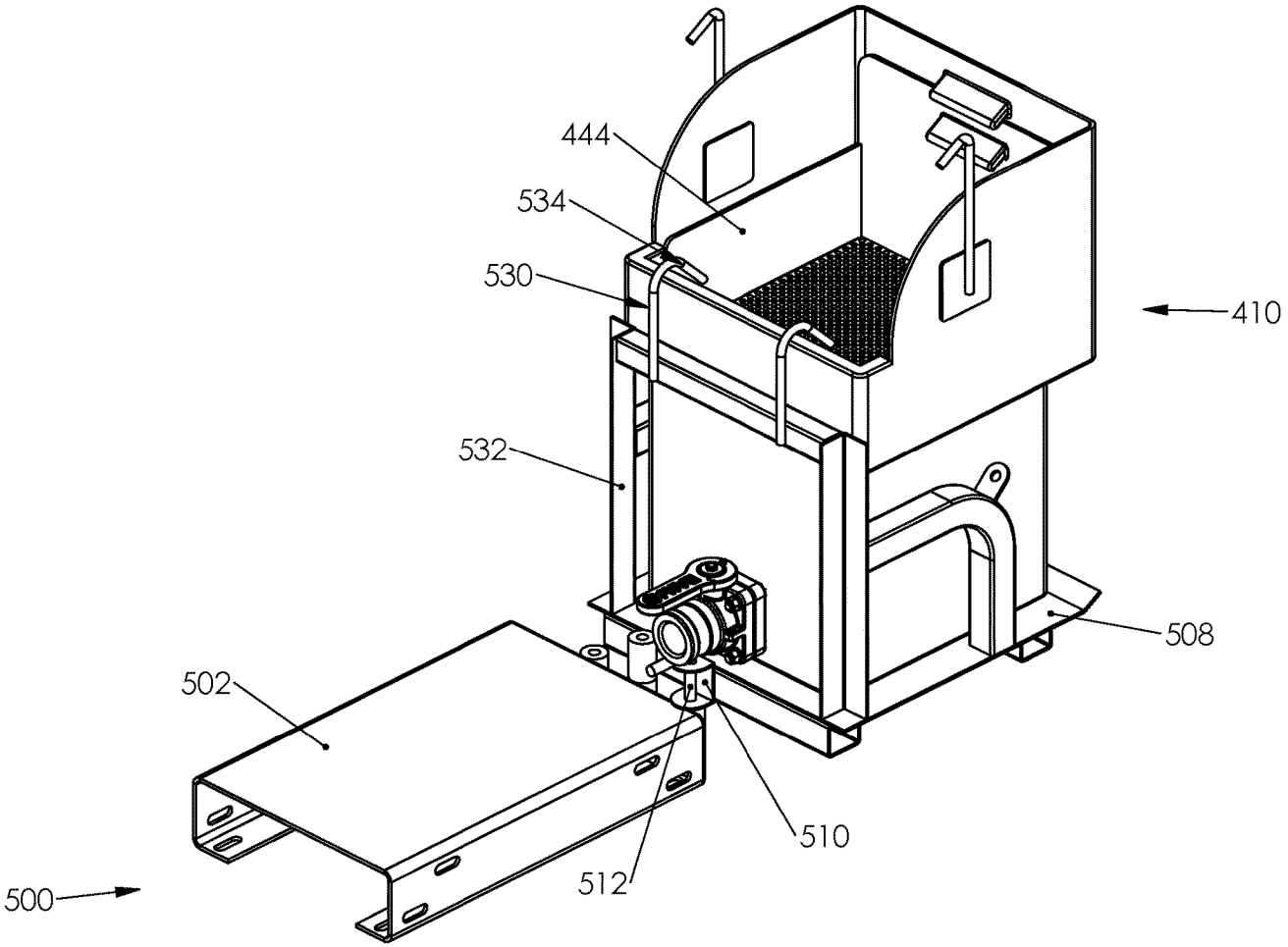
FIG. 36*b* is a front top isometric view of the concrete mixing transport truck chute washout system and rack of FIG. 36A.
Figure 37:
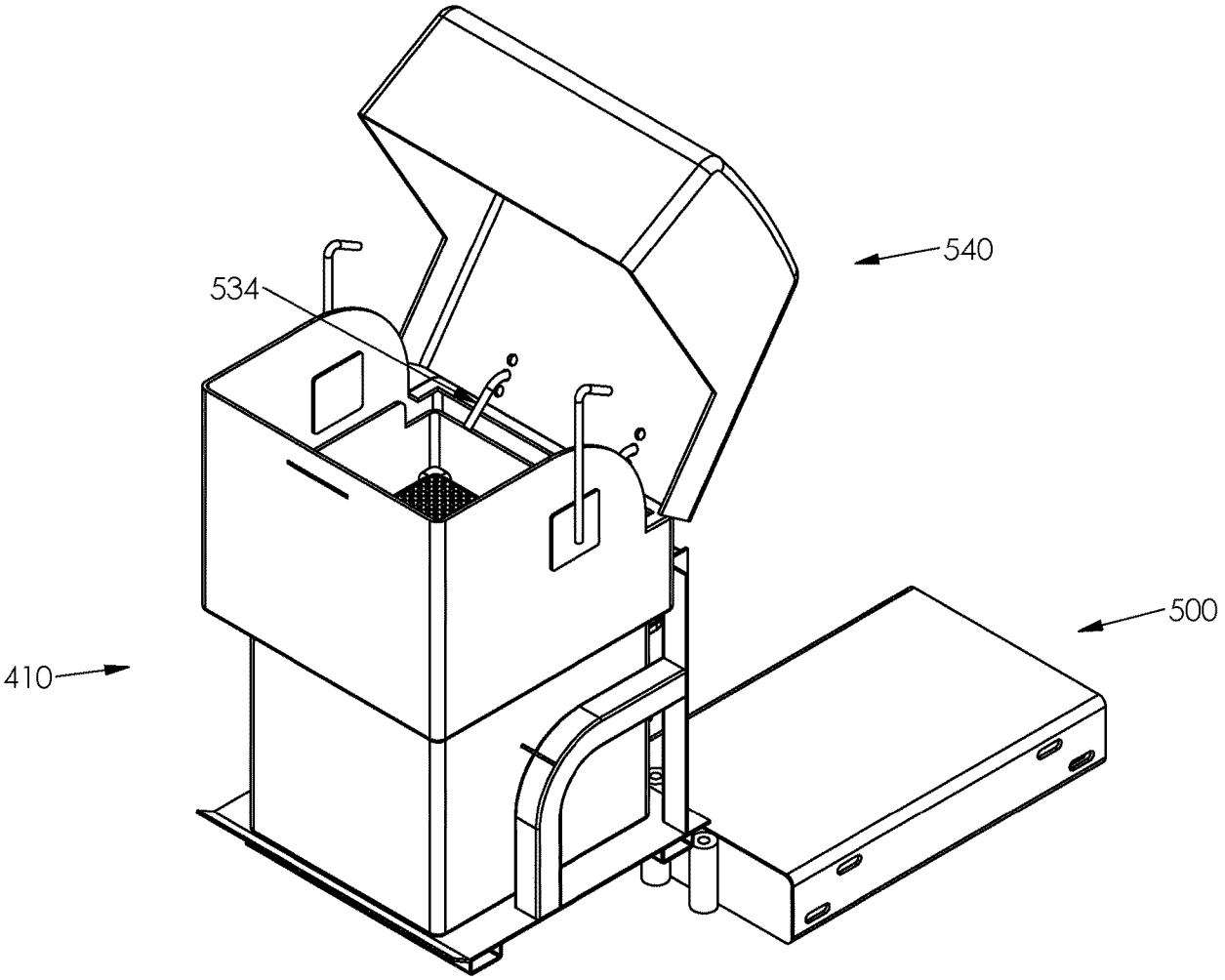
FIG. 37 is a rear top isometric view of the concrete mixing transport truck chute washout system and rack of FIG. 36A but equipped with a hood for the washout system in an opened state.

Referring to FIGS. 35-38, there are shown various isometric views of the concrete mixing transport truck chute washout system of FIG. 31 on a pivoting rack system, with FIGS. 37 an 38 also showing an optional hood cover. More specifically, FIG. 35 is a front top isometric view of the concrete mixing transport truck chute washout system 410 of FIG. 31 on a pivoting rack system 500 with the washout system 410 positioned over a platform 502 of the rack 500, FIG. 36A is a rear top isometric view and FIG. 36B is a front top isometric view of the concrete mixing transport truck chute washout system 410 and rack 500 with the washout system 410 pivoted away from the platform 502 of the rack 500. The platform 502 will be attached to the rear of a concrete truck (not shown.) To provide for the pivot feature, the rack 500 has a pivot, e.g., a tubular portion 504, attached to an end wall 506 of the platform 502 of the rack 500. A washout system stand 508 upon which the washout system 410 is placed has a bracket 510 and a pivot rod 512 to pivotally connect the bracket 510 and tubular portion 504, with the platform 502 of the rack 500 thusly being suspended above the platform 502. The pivot rod 512 is preferably removably attached to the bracket 512 and tubular portion 504 for easy removable. Also, there are preferably more than one tubular portions 504 on the end wall 506 of the platform 502 so that the relative position of the washout system stand 508 can be changed and/or the pivot side of the platform 502 relative to the platform 502. A tubular portion 514 can optionally be mounted to the washout system stand 508 so that it is in alignment with a lock tubular portion 516 when a rod is inserted to join the tubular portion 514 and the lock tubular portion 516, such as to lock the washout system stand 508 in place over the platform 506. This is useful during movement of the concrete truck. The rack 500 includes a pair of spaced apart retention hooks 530 that extend above a back wall 532. The retention hooks 530 have curved over ends 534 that extend into the open mouth 444 of the concrete mixing transport truck chute washout system 410.

Figure 38:
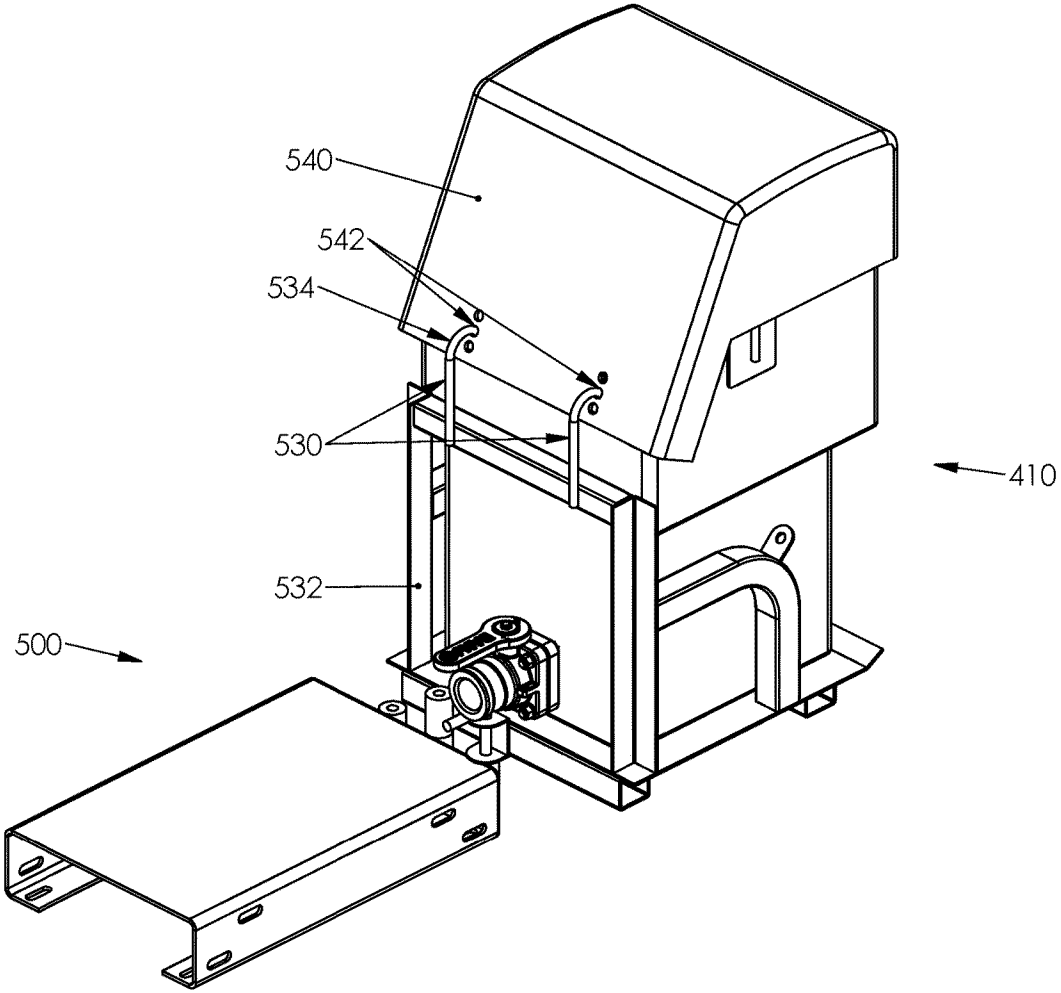
FIG. 38 is a rear top isometric view of the concrete mixing transport truck chute washout system and rack of FIG. 37 with its hood in a closed state.

Referring now to FIG. 37 and FIG. 38, which are a rear top and front top isometric view respectively of the concrete mixing transport truck chute washout system 410 and rack 500 of FIGS. 35-36A&B but equipped with an optional hood 540 for the washout system in an opened state and closed state, respectively. The hood 540 has holes 540 formed therein that are aligned to receive the curved over ends 534 of the retention hooks 530 on the back wall 532 of the rack 500. The hood 540 is shaped to cover the open top of the washout system 410 when the system is not in use, e.g., during transit or storage, and can be swung down on the hooks 530 when a user wishes to access the washout system 410. The hood 540 as shown is just one of many possible embodiments.

Figure 39:
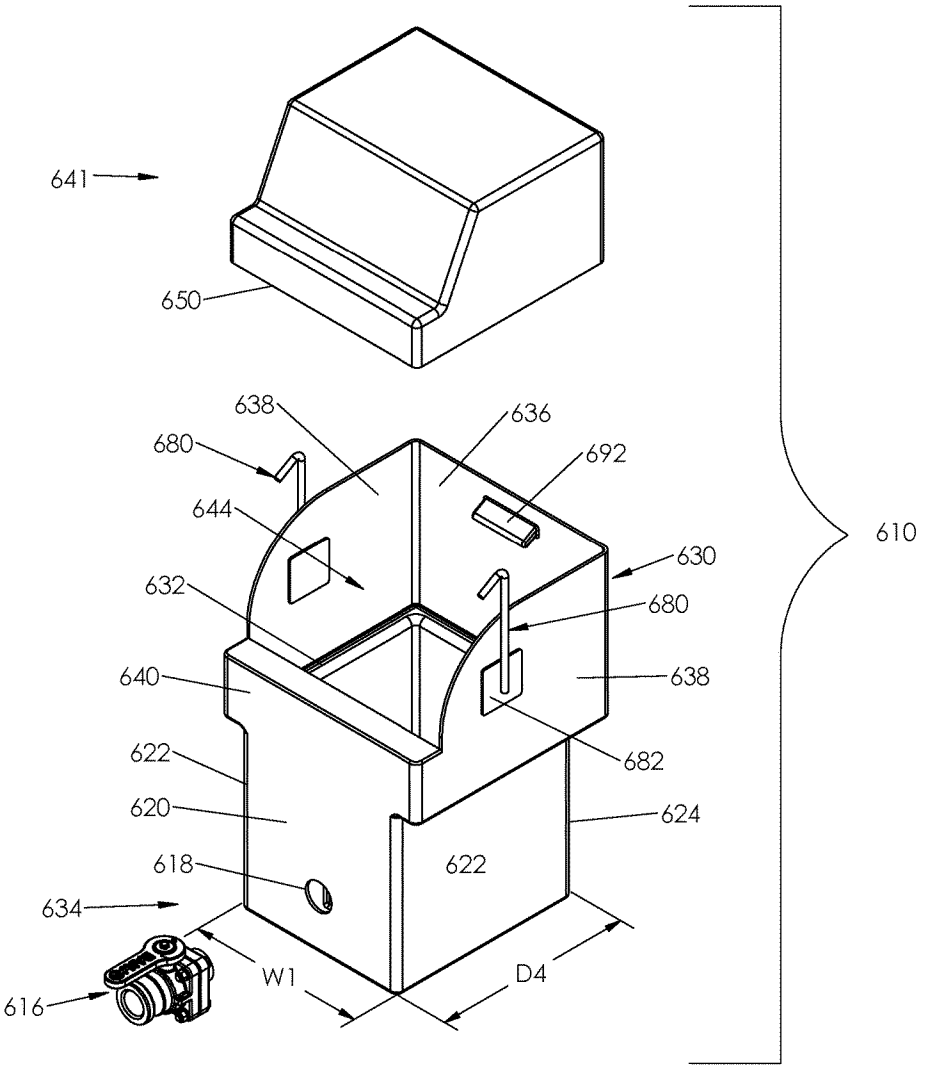
FIG. 39 is an exploded front left isometric view of another embodiment of a concrete mixing transport truck chute washout system showing various parts of a container unit.
Figure 40:
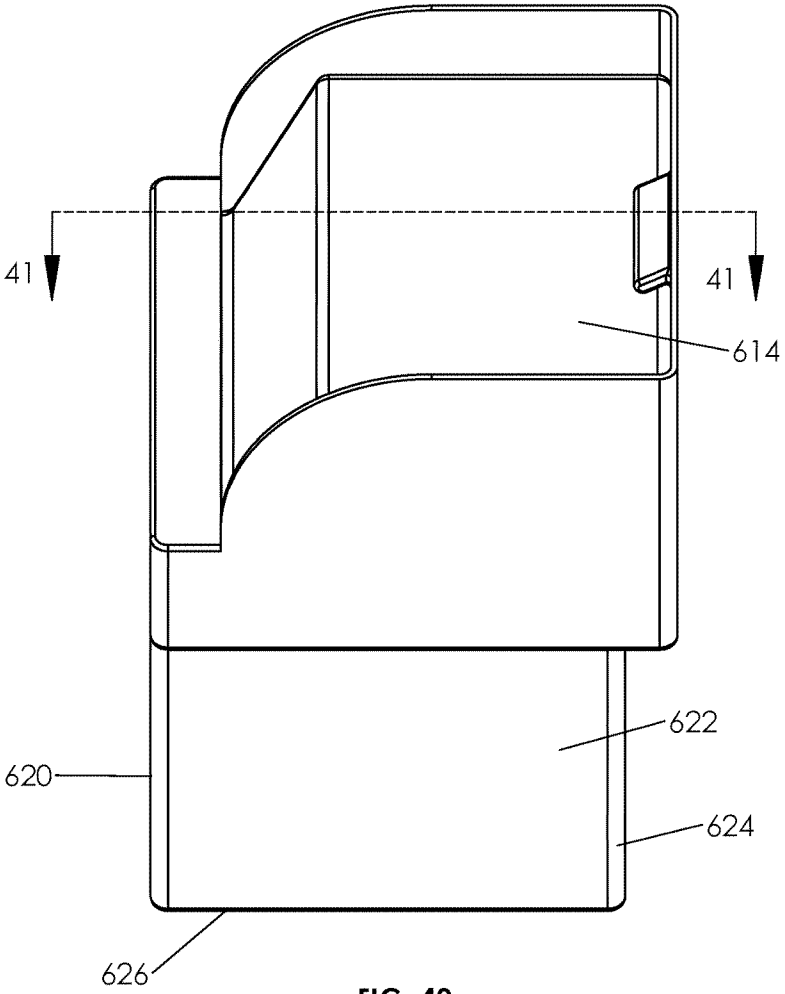
FIG. 40 is a top right isometric assembled view of the container unit of FIG. 40 with its lid placed to cover the open mouth.
Figure 41:
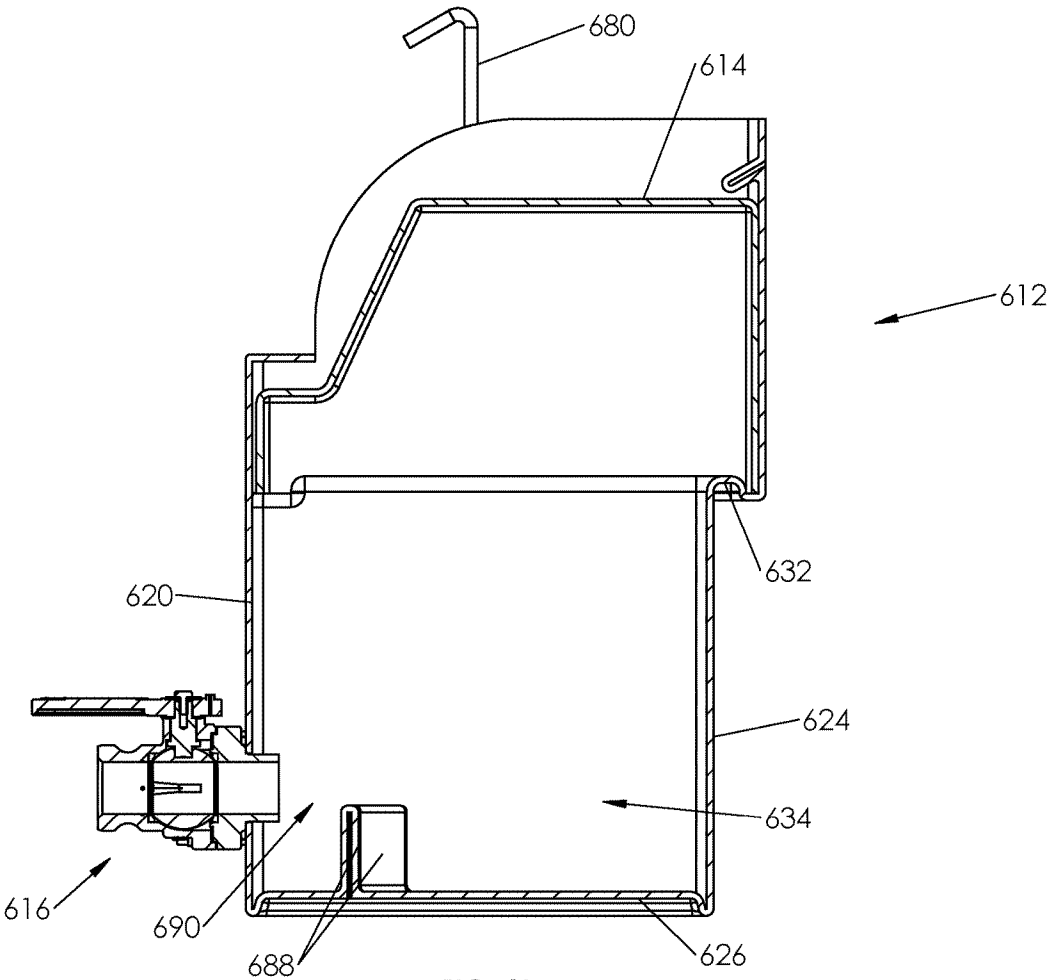
FIG. 41 is a cross-sectional view of the container unit of FIG. 40 through view lines 41-41 of FIG. 40.

Referring now to FIGS. 39-41, there are shown views of another embodiment of a concrete mixing transport truck chute washout system showing various parts of a collection container portion 610 thereof, where FIG. 39 is an exploded front left isometric view, FIG. 40 is a top right isometric assembled view, and FIG. 41 is a cross-sectional view of the collection container portion of FIG. 40 through view lines 41-41 of FIG. 40. The container unit 610 has a container unit 612 and a lid portion 614 that is positioned at an upper region 630 of the container unit 612 and sits on a raised seat 632 at its upper region 630 to provide a sealing and seating feature. A drainage valve 616 connects via a drain hole 618 in a front wall 620 of the container unit 612. The container unit 612 has opposing side walls 622, a back wall 624, and a bottom 626. The upper region 630 preferably has a larger cross-sectional area than that of a lower region 634. The upper region 630 has a back wall 636 and opposing side walls 638. The front wall 640 is shorter than the back wall 636, and the front wall 640 is preferably a continuation of the front wall 620 of the container unit 612. The back wall 636 is made higher than the front wall 640 so that when a cement truck's chute is positioned over an open mouth 644 of the base portion 212 610, similarly as shown in FIG. 25, there is less chance for the material being cleaned from the chutes will overflow or overspray. There is preferably a ledge 642 at the top of the front wall 640 which ledge 642 extends towards the back wall 636. This ledge 642 will provide further rigidity and strength to the container unit 612. The container unit 612 has a pair of lifting hooks 680 with attachment plates 682 for affixing the lifting hooks to the sides 638 of the container unit 612. The lifting hooks 680 can be used to lift the container unit and will also support the container unit 612 should a user wish to hang it on an end of a concrete truck chute. The container unit 612 has a back wall 636 that is high and has its own integral handle 692 that can be used as an additional handhold when handling the container unit 610. The lid portion 614 is sized to fit in and cover the open mouth 644 of the container unit 612 and its lower edge 650 is adapted to sit and sealably seat on the raised seat 632 of the container unit 612. The lid portion 614 can help be retained in place by the integral handle 692. As best shown in the cross-sectional view of FIGS. 41, a dam 688 preferably extends upwardly from the bottom 626 of the container 612 in front of an entrance 690 of the drainage valve 616. The dam 688 will help prevent any non-liquid debris, e.g., small rocks or sand that may have passed into the lower region 634 of the container 612 from possibly clogging or damaging the valve 616.

Figure 42A:
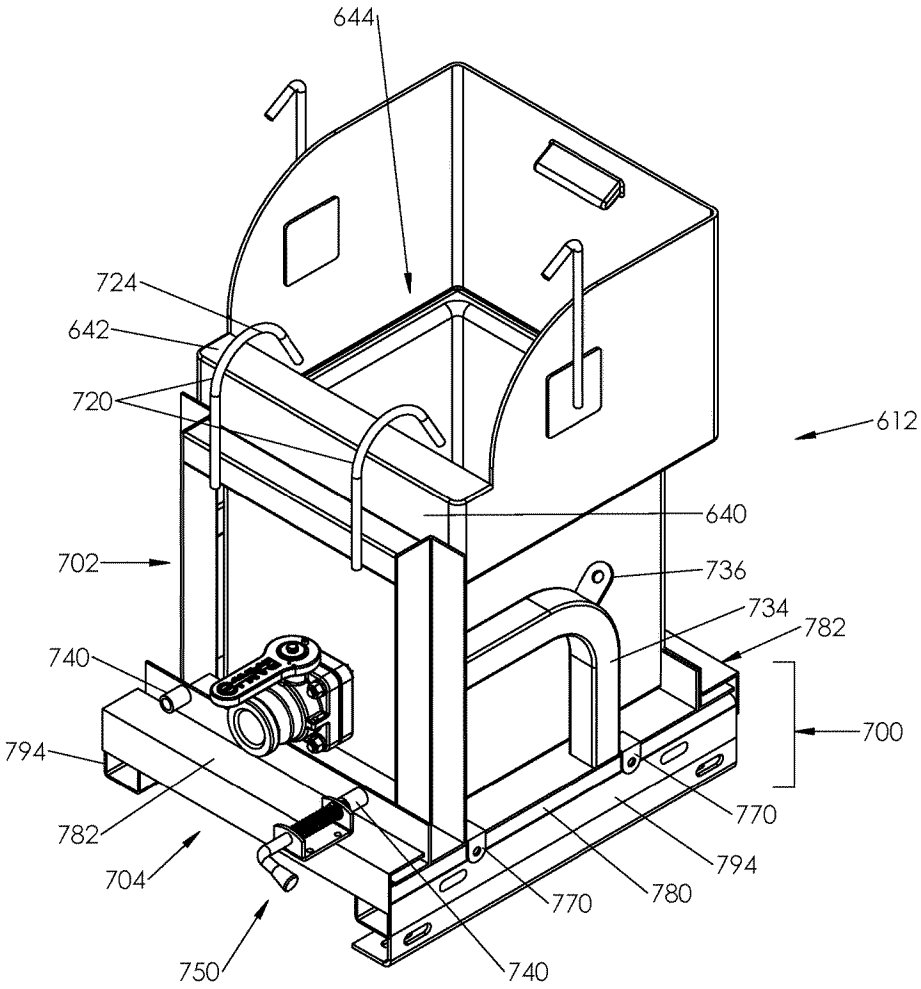
FIG. 42A is a top right isometric assembled view of the container unit of FIG. 41 position on a sliding rack of the invention, in an un-deployed position.
Figure 42B:
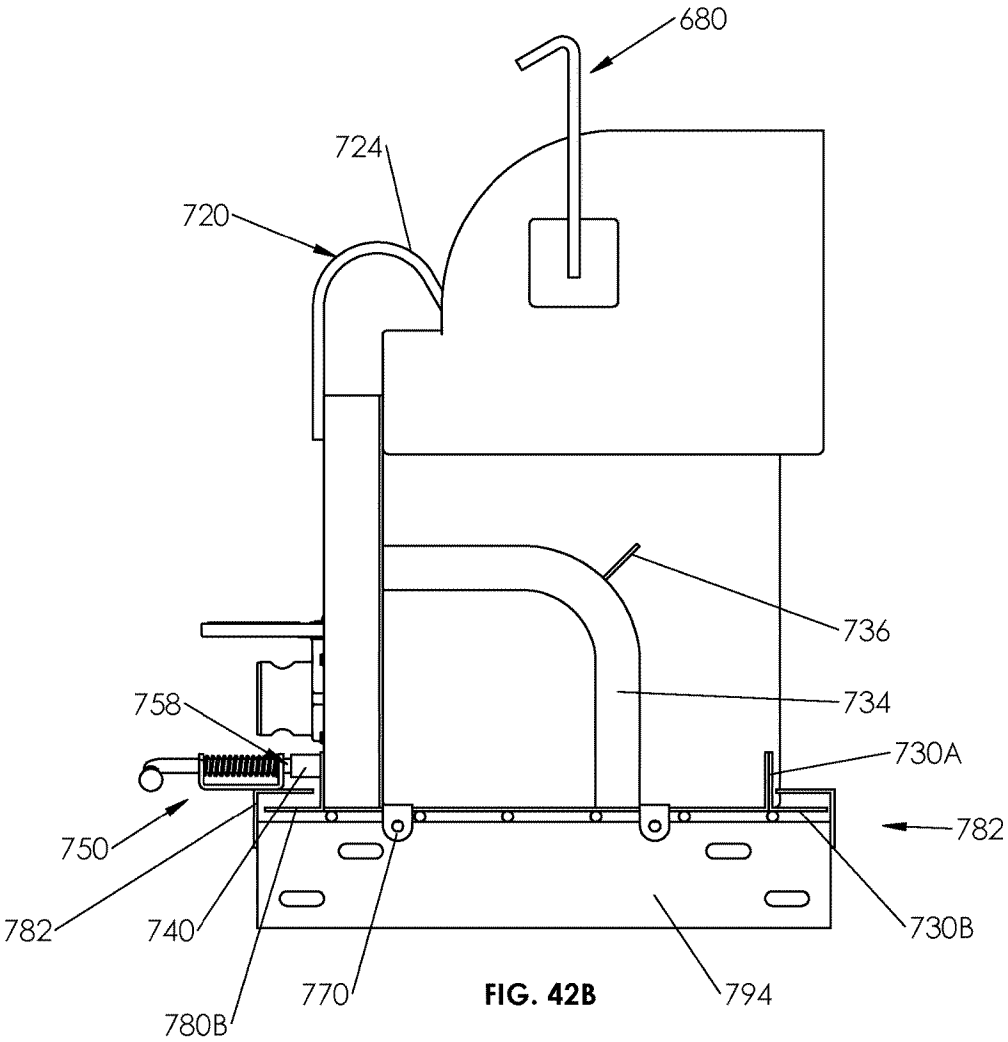
FIG. 42B is a right side view of the container unit and rack of FIG. 42A.
Figure 42C:
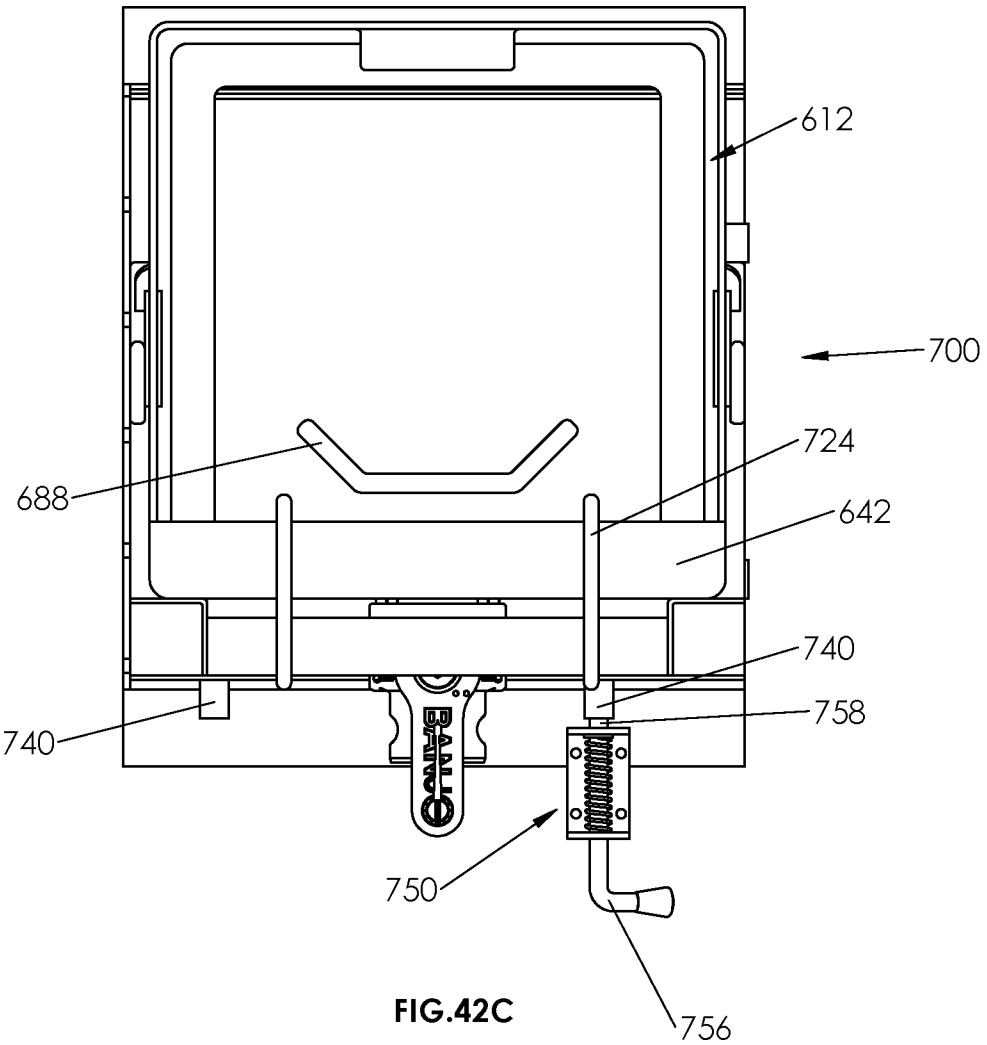
FIG. 42C is a top view of the container unit and rack of FIG. 42A.
Figure 43A:
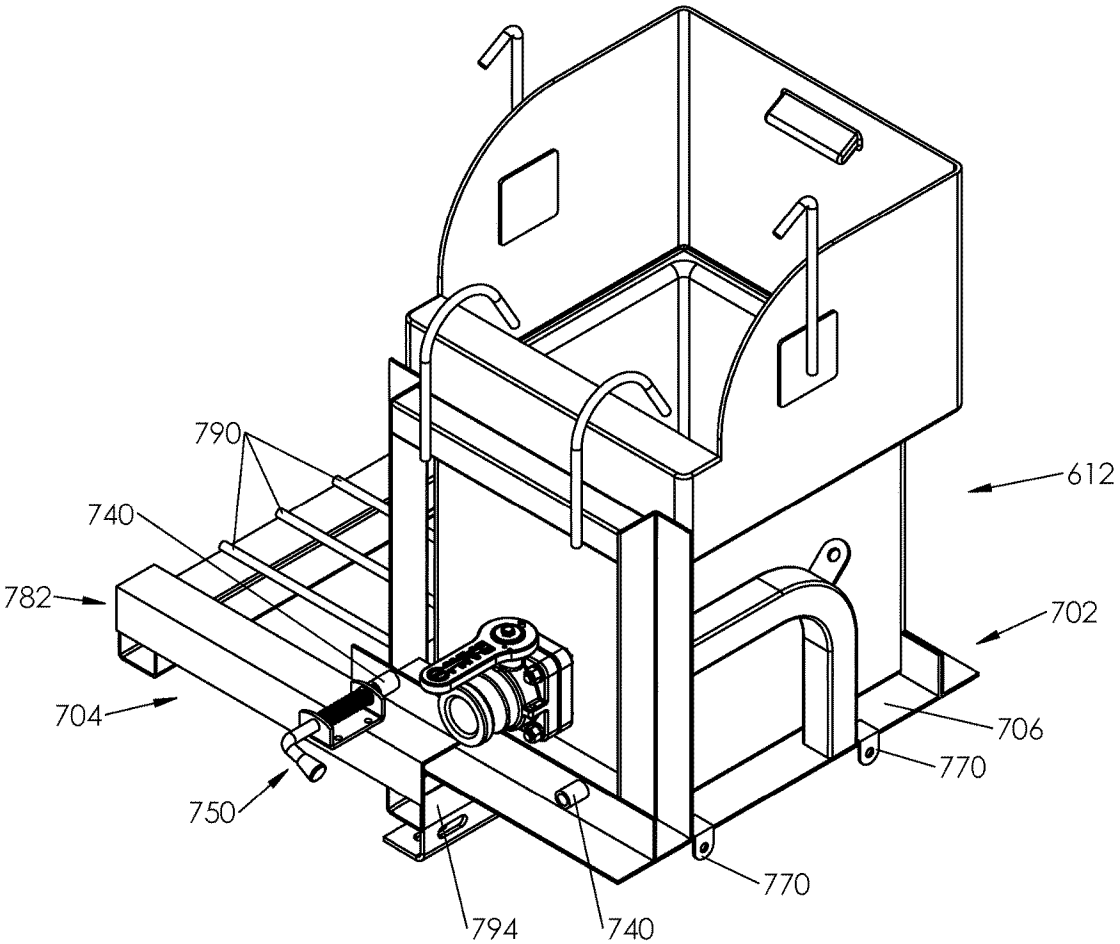
FIG. 43A is a top right isometric assembled view of the container unit and rack of FIG. 42A, with the container unit in a deployed position.
Figure 43B:
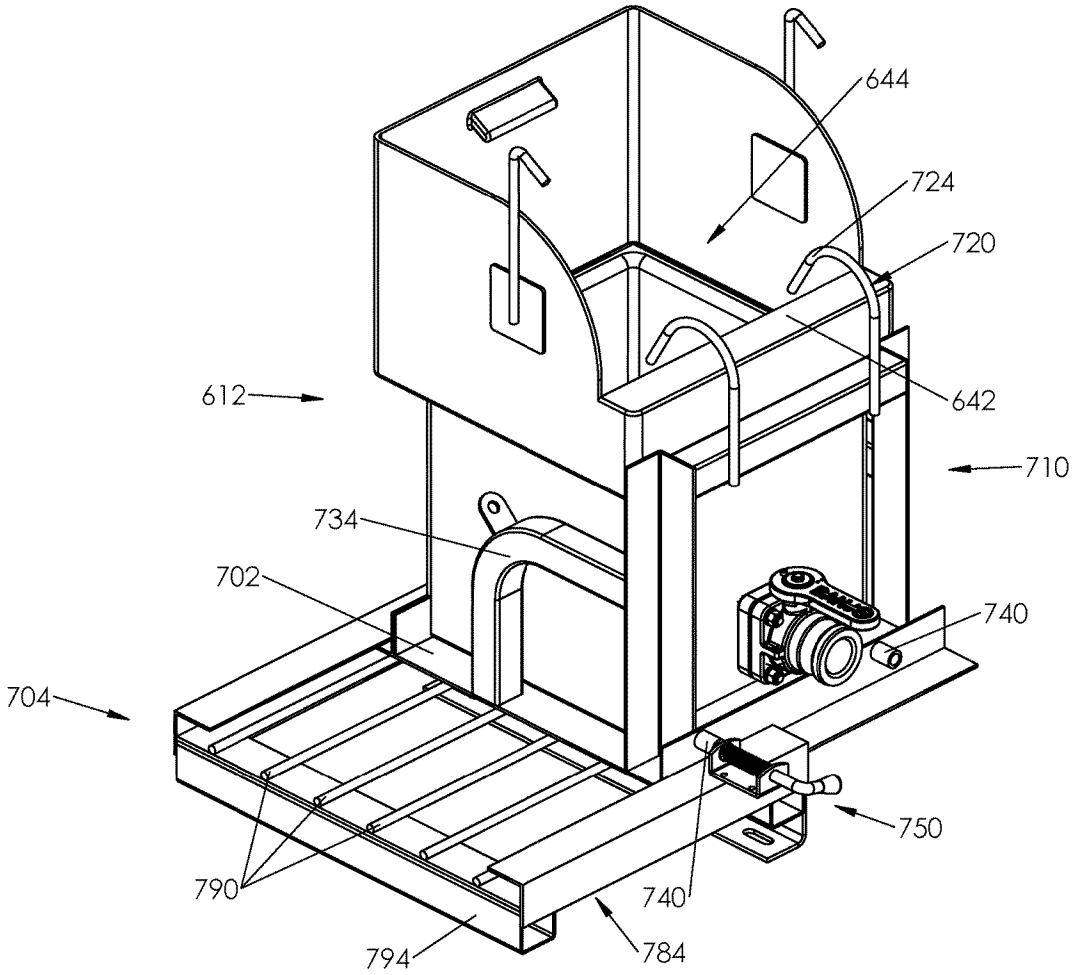
FIG. 43B is a top left isometric assembled view of the container unit and rack of FIG. 43A.
Figure 44A:
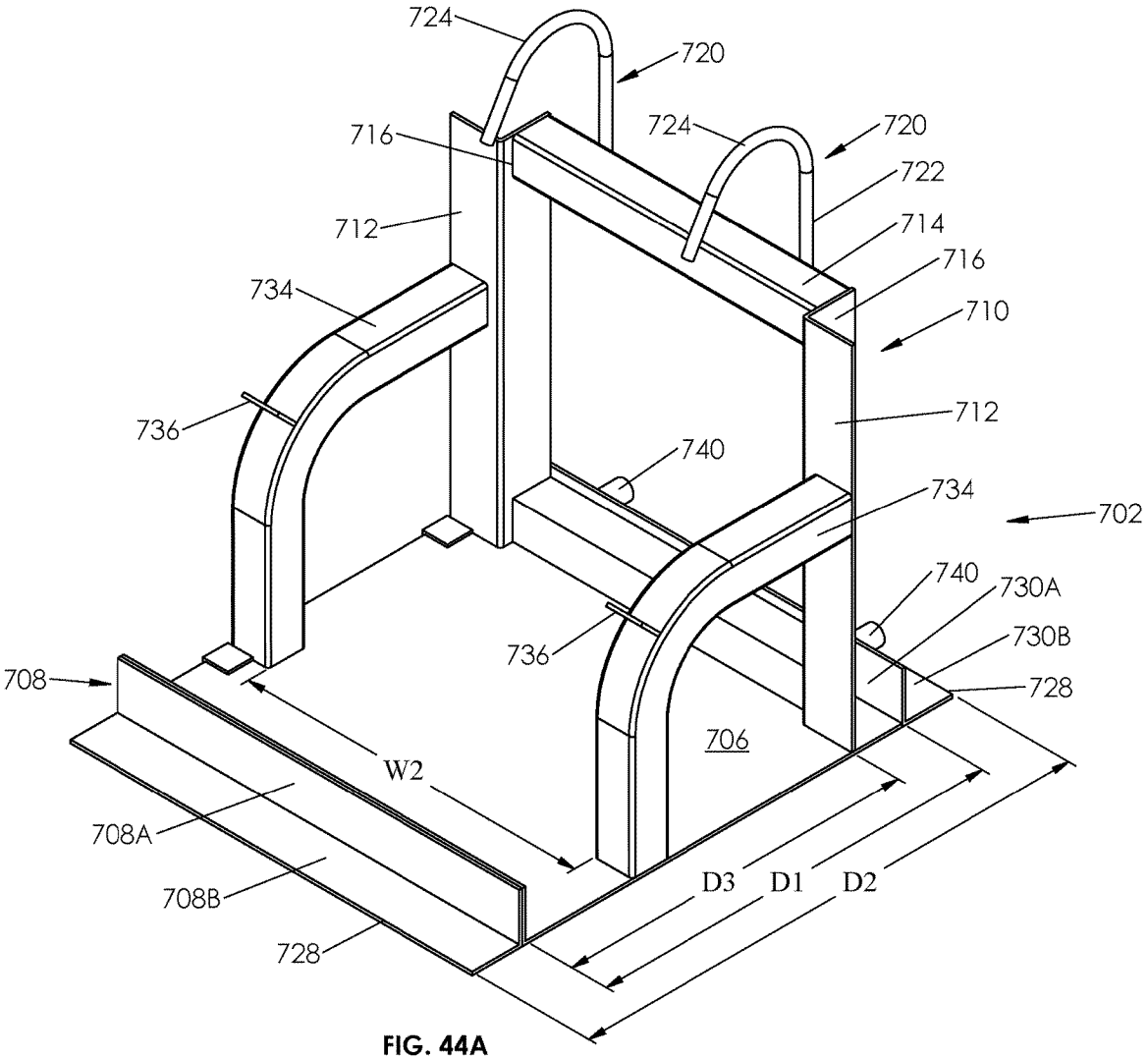
FIG. 44A is a front top right isometric view of a sliding portion of the rack of FIG. 42A.
Figure 44B:
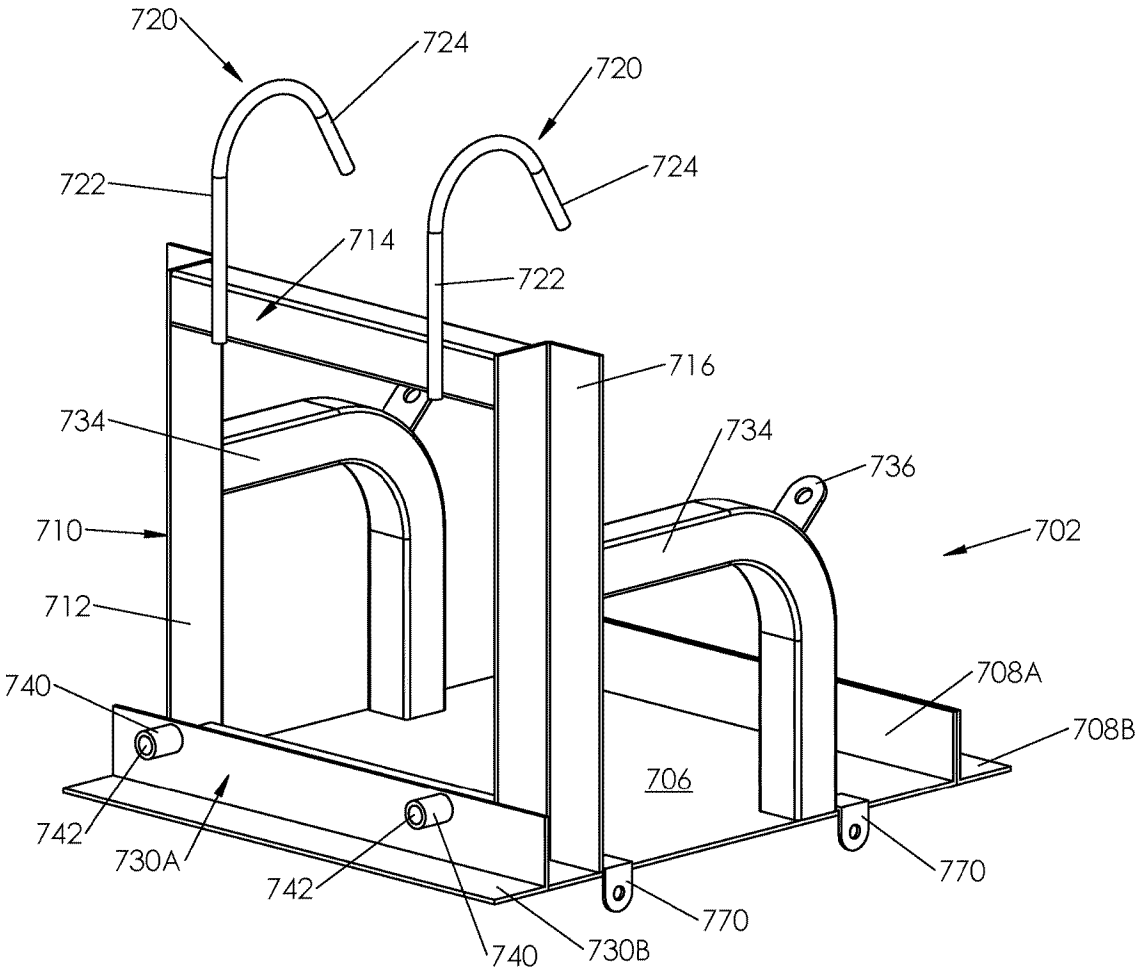
FIG. 44B is a rear left isometric view of a sliding portion of the rack of FIG. 42A.
Figure 45:
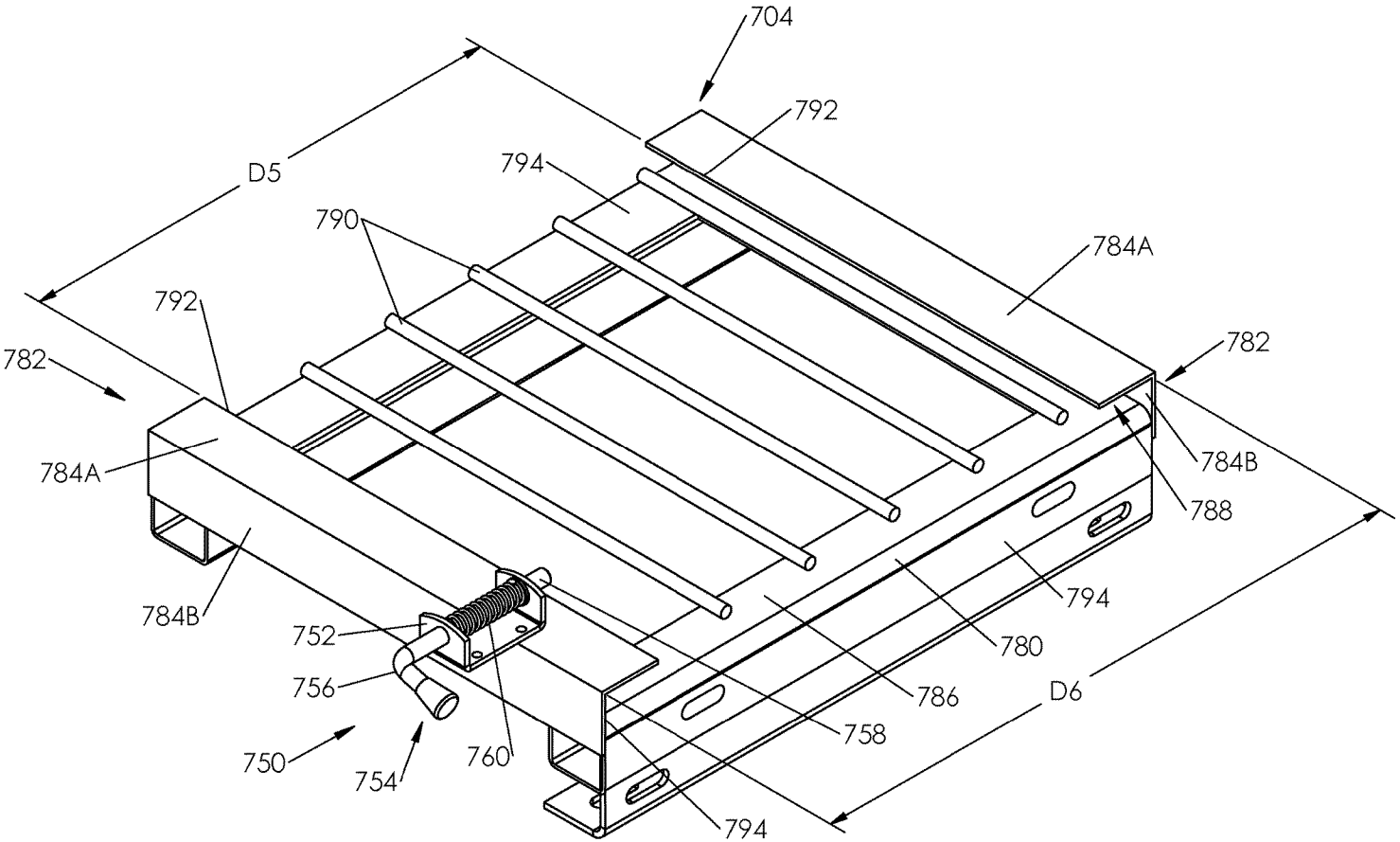
FIG. 45 is a front top right isometric view of a stationary base portion of the rack of FIG. 42A.

FIG. 42A is a top right isometric assembled view, FIG. 42B is a right side view, and FIG. 42C is a top view of the container unit 610 of FIGS. 39-41 positioned on an exemplary embodiment of a sliding rack 700 of the invention, in a un-deployed position. FIG. 43A is a top right isometric assembled view and FIG. 43B is a top left isometric assembled view of the container unit 610 and rack 700 of FIG. 42A, with the container unit 610 in a deployed position. FIG. 44A is a front top right isometric view and FIG. 44B is a rear left isometric view of a sliding portion 702 of the rack of FIG. 42A, and FIG. 45 is a front top right isometric view of a stationary base portion 704 of the rack 700 of FIG. 42A. The features of the container unit 610 are as described with reference to FIGS. 39-41. Turning to the rack 700, its sliding portion 702 has a flat base 706, and an upraised retention wall 708A and a horizontal portion 708B at a rear side thereof. A raised front wall 710 is located at a front side thereof. The raised front wall 710 preferably has two spaced apart vertical risers 712 with a top bar 714 bridging the tops 716 of the two spaced apart vertical risers 712. A pair of spaced apart retention hooks 720 are attached to the top bar 714. Each retention hook 720 has a generally vertical portion 722 and a hook end 724 that extends rearwardly and downwardly towards the rear side of the rack 700. When the container unit 612 is positioned on the rack 700, the hook ends 724 will pass over the ledge 642 and partially extend into the open mouth 644 of the container unit 612 and further retain the container unit 612 in place on the rack 700. At the front side of the flat base 706 there is a raised front wall 730A and a horizontal portion 730B at a front side thereof. The width between the raised front wall 730A and raised rear wall 708A is $D_1$, and the spacing between the outer edges 728 of the horizontal portions 708B and 730B is $D_2$. The distance between the raised rear wall 708A and the front of the vertical risers 712 is width $D_3$. Joining each vertical risers 712 to the flat base 706 are side arms 734. The side arms 734 are spaced a distance apart $W_2$. The container unit 610 has a width W1 and depth $D_4$ that allow the container unit 610 to fit into the sliding portion 702 of the rack 710, as shown in FIGS. 42A, 42B, 43A, 43B, and 43C. Preferably there are engagement tab 736 on the side arms 734 to allow bungee cords and the like (not shown) to retain the container unit 612 to the rack unit. Extending frontwardly from the raised front wall 730A are spaced apart catch cylinder 740 with openings 742, the purpose of which is to engage with spring loaded L-latch 750 mounted to the stationary portion of the rack 704. The spring loaded L-latch 750 has a holder 752, a throw bolt 754 with an L-shaped proximal end 756 and a straight distal end 758 that extends out of the holder 752, and has a spring 760 that biases the proximal end out of the holder 752 and into an opening 742 of one of two of the catch cylinder 740 depending on whether the sliding portion 702 is retracted relative to the stationary base portion 704 of the rack 700, as shown in FIGS. 42A and 42B, or extended, as shown in FIGS. 43A and 43B. On a right side edge 760 of the flat base 706 of the sliding portion 702 are slide limiting stops 770 that preferably extend downwardly below the flat base 706. As shown in FIG. 42A and 42B, the slide limiting stops 770 impinge on a left side rail 780 of the stationary base portion 704, thereby preventing further movement of the sliding portion 702 and its carried container unit 612, and also aligning the sliding portion 702 so that its spring loaded L-latch 750 with one of the catch cylinder 740 to lock the portions of the rack 700 to its unextended mode. Whereas, when the sliding portion 702 is slid out so that its spring loaded L-latch 750 aligns with and captures in the other catch cylinder 740, this will prevent further withdrawal of the sliding portion 702 relative to the stationary base portion 704 of the rack 700. Referring to FIG. 45, the stationary rack portion 704 has two spaced apart guide rails 782 with horizontal portions 784A and vertical portion 784B, the horizontal portions 784A being are spaced above from a lower platform 786, defining a space 788 therebetween to slideably receive the horizontal portion 708B and 730B of the sliding portion 702 of the rack 700. The lower platform 786 can in turn have further cross-members 794 that that join and hold apart the two spaced apart guide rails 872. The distance between inside edges 792 of the spaced apart horizontal portions 784A is $D_5$ and the distance between inside surfaces of the spaced apart vertical portions 784B is $D_6$. Distance $D_2$ between the ends of the horizontal portions 708B and 730B and distance $D_3$ between the raised vertical walls 708A and 730B of the sliding portion 702 are less than distances $D_6$ and $D_5$, respectively and allow the sliding portion 702 to smoothly slide relative to the stationary portion 704. On a floor of the stationary portion 704 there is a support structure, such as spaced apart rods 790, are used to slideably carry the sliding portion 702 on the stationary portion 704. However, other arrangement can be made such as a solid floor, perforated metal, plastic, and the like. The stationary portion 704 of the rack unit 700 will be mounted to a truck in a desired location and position so that the sliding portion 702 and its carried container unit 712 will be slideable to a more convenient as accessible position during use for collection of concrete washout, and for emptying the container unit 712.

Figure 46A:
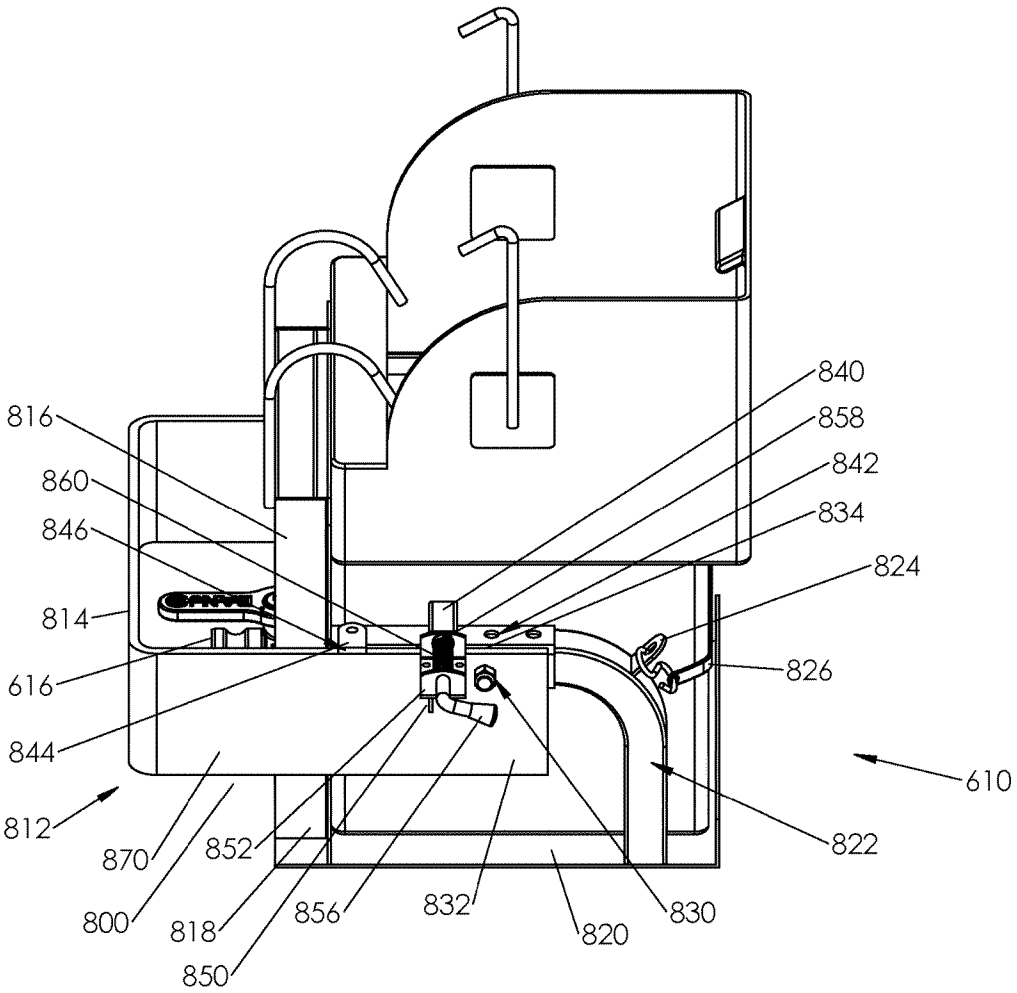
FIG. 46A is a top left isometric view of another exemplary embodiment of tipping concrete mixing transport truck chute washout system and rack, with the container portion in its upright untipped position.
Figure 46B:
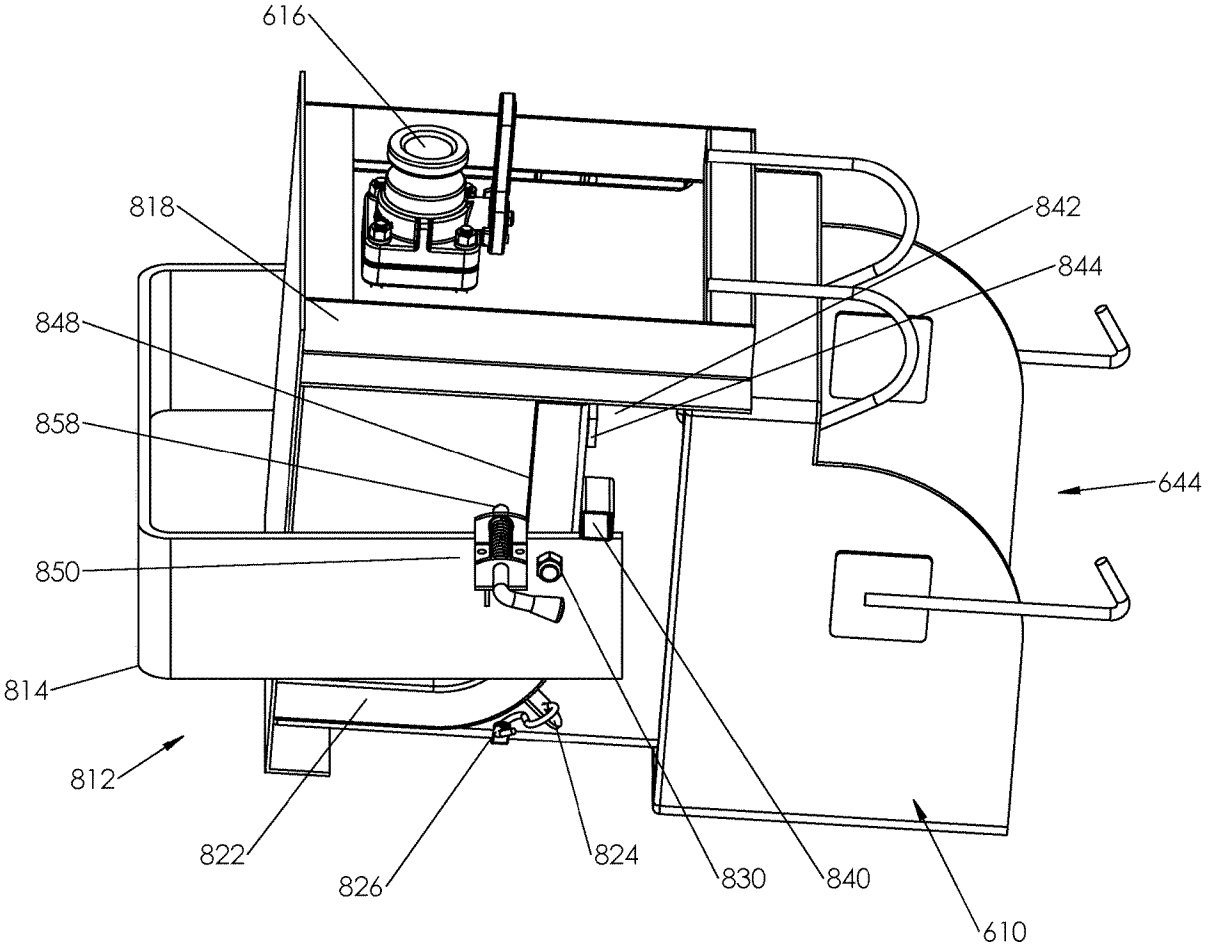
FIG. 46B is a top left isometric view of another exemplary embodiment of tipping concrete mixing transport truck chute washout system and rack, with the container portion in its completely tipped position.

FIG. 46A is a top left isometric view of another exemplary embodiment of tipping concrete mixing transport truck chute washout system and rack 800, with the container portion 610 (as has been previously described) in its upright untipped position on a tipping rack portion 812 that is pivotally mounted to a stationary portion 814, and FIG. 46B is a similar view but with the container portion 610 in its completely tipped position. The tipping rack portion 812 has a standout wall portion 816 with vertical risers 818 that extend upwardly from a base portion 820. Extending between the base portion 820 and the vertical risers 818 are a pair of side arms 822. Preferably there are engagement tabs 824 on the side arms 822 to allow bungee cords 826 to retain the container unit 610 to the rack unit 812. The tipping rack portion 812 is pivotally attached to the stationary portion 814 with pivots 830, which can comprise a bolt 834 which passes from the side arms 822 through a hole in an end 832 of the stationary portion 814. A mounting bracket 842 can conveniently bear the bolt 834 and be attached to the side arm 822. A similar arrangement is found on the side arm 22 on the other side of rack 812. The mounting bracket 842 also includes a catch 840 adapted to catch a bolt 858 of a spring loaded L-latch 850. The spring loaded L-latch 800 has a holder 852, a throw bolt 858 with an L-shaped proximal end 856 and a straight distal end that extends out of the holder 852, and has a spring 860 that biases the proximal end out of the holder 852 and into the catch 840 to prevent the tipping rack portion 812 from rotating relative to the stationary portion 814 when desired. A stop plate 844 is also affixed to the mounting bracket 842 and extend laterally outwardly so that a lower surfaced thereof will impinge on a upper surface 846 of side brackets 870 of the stationary portion 814 and prevent further tipping back of the tipping rack portion 816 relative to the stationary portion 814. In FIG. 46B, the spring loaded L-latch 850 is released from the catch 840 so that the tipping rack portion 816 can be moved to its tipped orientation relative to the stationary portion 814 so that any contents in the container unit 610 will be dumped out of its open mouth 644. This mode is particularly useful to dump out any solids that have collected in the bottom of the container unit 610 that are otherwise not drained out via the valve 616 of the container unit 610. In this orientation, the container unit 610 can also be rinsed out if desired. After the container unit 610 is emptied, the tipping rack portion 816 carrying the container unit 610 may be brought back to its upright position as shown in FIG. 46A.

While the washout systems 10, 410, 610, and 800 are shown equipped with drainage valves 16, 416, and 616 for certain uses where no supplemental holding tanks are required, drainage valves need not be included in the system, and the container units 12, 412, and 610 can be closed off. Once returned to the concrete mixing facility, the collected water can be drained by first removing the trays holding any solid debris and then dumping out the water collected in the container units.

The preferred embodiments of this invention have been disclosed, however, so that one of ordinary skill in the art would recognize that certain modifications would come within the scope of this invention.

What is claimed is:

1. A concrete mixing transport truck chute washout system, comprising:

a container unit with an upper region located above and fluidly communicating with a lower region, the upper region having a container unit sealing and seating feature, the upper region having a container unit open mouth; and a rack unit having a stationary portion and a movable portion, the movable portion having a length and a width that is sized to carry the container unit, the movable portion being movably connected to the stationary portion.

2. The concrete mixing transport truck chute washout system of claim 1, wherein the upper region of the container unit has a front wall, two opposite side walls, and a rear wall, wherein the rear wall is taller than the front wall and wherein the container unit sealing and seating feature comprise a raised seat that in located in an interface region between the upper region and the lower region and which raised seat run generally parallel to and is spaced away from the two opposite side walls and the rear wall leaving a lower gully around the raised seat, and wherein the upper region of the container unit has a larger cross-sectional area than the cross-sectional area of the lower region of the container unit.

3. The concrete mixing transport truck chute washout system of claim 2, further comprising a detachable cover that detachably fits in the upper region of the container unit in the container unit open mouth to block the mouth and prevent egress of contents from the container.

4. The concrete mixing transport truck chute washout system of claim 3, wherein the detachable cover has a unit further comprises a front wall, two opposite side walls, and a rear wall which walls extend up from the bottom wall, wherein the rear wall is taller than the front wall, and wherein detachable cover has a lower edge that seats and seals on the raised seat of the container unit.

5. The concrete mixing transport truck chute washout system of claim 2, further comprising a generally horizontal rim extends from a top of the front wall of upper region of the container unit inwardly towards the back wall of the upper region.

6. The concrete mixing transport truck chute washout system of claim 1, further comprising a drainage valve positioned on the lower region of the container portion and wherein the lower region of the container unit has a front wall, two opposite side walls, and a rear wall extending up from a bottom wall, and wherein a drainage valve aperture is formed in the front wall of the lower region of the container unit which drainage valve aperture receives the drainage valve, and wherein a dam extends upwardly from the bottom wall and is spaced apart from an entrance of the drainage valve in the container unit.

7. The concrete mixing transport truck chute washout system of claim 1, further comprising suspension hooks affixed to the container unit.

8. The concrete mixing transport truck chute washout system of claim 1, wherein the movable portion comprising a rectangular base having two opposite side edges, a raised front wall, and two spaced apart side arms at opposite sides of the raised front wall that are spaced apart to receive the container unit therebetween, and wherein the stationary portion comprises a platform with two upraised and spaced apart guide rails adapted to slideably receive the rectangular base therein.

9. The concrete mixing transport truck chute washout system of claim 8, where the movable portion of the rack has retention hooks which engage with the container unit when the container unit is placed on the rack.

10. The concrete mixing transport truck chute washout system of claim 9, further comprising a latch to selective lock the position of the movable portion relative to the stationary portion in one of a retracted position and an extended position.

11. The concrete mixing transport truck chute washout system of claim 1, wherein the stationary portion of the rack comprises a back wall and two spaced apart sides, and wherein the movable portion comprising a rectangular base having two opposite side edges, a raised front wall, and two spaced apart side arms at opposite sides of the raised front wall that are spaced apart to receive the container unit therebetween, and wherein the movable portion is pivotally mounted at its sides to the sides of the stationary portion of the rack to allow pivoting of the movable portion relative to the stationary portion between a untipped position wherein the container unit's mouth is directed upwardly, and a tipped position wherein the container unit's mouth is directed at least partially downwardly.

12. The concrete mixing transport truck chute washout system of claim 11, further comprising latch to lock the position of the movable portion relative to the stationary portion in an untipped position.

13. A concrete mixing transport truck chute washout system, comprising:

a container unit with an upper region located above and fluidly communicating with a lower region, the upper region having a container unit sealing and seating feature, the upper region having a container unit open mouth;

a detachable cover that detachably fits in the upper region of the container unit in the container unit open mouth to block the mouth and prevent egress of contents from the container; and a rack unit having a stationary portion and a movable portion, the movable portion having a length and a width that is sized to carry the container unit, the movable portion being movably connected to the stationary portion, wherein the movable portion comprising a rectangular base having two opposite side edges, a raised front wall, and two spaced apart side arms at opposite sides of the raised front wall that are spaced apart to receive the container unit therebetween, and wherein the stationary portion comprises a platform with two upraised and spaced apart guide rails adapted to slideably receive the rectangular base therein.

14. The concrete mixing transport truck chute washout system of claim 13, where the movable portion of the rack has retention hooks which engage with the container unit when the container unit is placed on the rack.

15. The concrete mixing transport truck chute washout system of claim 13, further comprising a latch to selective lock the position of the movable portion relative to the stationary portion in one of a retracted position and an extended position.

16. The concrete mixing transport truck chute washout system of claim 13 further comprising a drainage valve positioned on the lower region of the container portion and wherein the lower region of the container unit has a front wall, two opposite side walls, and a rear wall extending up from a bottom wall, and wherein a drainage valve aperture is formed in the front wall of the lower region of the container unit which drainage valve aperture receives the drainage valve, and wherein a dam extends upwardly from the bottom wall and is spaced apart from an entrance of the drainage valve in the container unit.

17. The concrete mixing transport truck chute washout system of claim 14, where the rack has retention hooks which engage with the container unit when the container unit is placed on the rack.

18. A concrete mixing transport truck chute washout system, comprising:

a container unit with an upper region located above and fluidly communicating with a lower region, the upper region having a container unit sealing and seating feature, the upper region having a container unit open mouth;

a detachable cover that detachably fits in the upper region of the container unit in the container unit open mouth to block the mouth and prevent egress of contents from the container; and a rack unit having a stationary portion and a movable portion, the movable portion having a length and a width that is sized to carry the container unit, the movable portion being movably connected to the stationary portion, wherein the stationary portion of the rack comprises a back wall and two spaced apart sides, and wherein the movable portion comprising a rectangular base having two opposite side edges, a raised front wall, and two spaced apart side arms at opposite sides of the raised front wall that are spaced apart to receive the container unit therebetween, and wherein the movable portion is pivotally mounted at its sides to the sides of the stationary portion of the rack to allow pivoting of the movable portion relative to the stationary portion between a untipped position wherein the container unit's mouth is directed upwardly, and a tipped position wherein the container unit's mouth is directed at least partially downwardly.

19. The concrete mixing transport truck chute washout system of claim 18, further comprising latch to lock the position of the movable portion relative to the stationary portion in an untipped position.

* * * * *